US009361747B2

(12) United States Patent
Bauer et al.

(10) Patent No.: US 9,361,747 B2
(45) Date of Patent: Jun. 7, 2016

(54) DISPENSER WITH WEDGE FOR ROLLING PRODUCTS

(71) Applicants: Giraffx Design, LLC, Lake Worth, FL (US); RTC Industries, Inc., Rolling Meadows, IL (US)

(72) Inventors: Jamie D. Bauer, Greenacres, FL (US); Stephen N. Hardy, Wadsworth, OH (US)

( * ) Notice: Subject to any disclaimer, the term of this patent is extended or adjusted under 35 U.S.C. 154(b) by 0 days.

(21) Appl. No.: 14/472,354

(22) Filed: Aug. 28, 2014

(65) Prior Publication Data

US 2015/0001244 A1 Jan. 1, 2015

Related U.S. Application Data

(60) Provisional application No. 61/871,711, filed on Aug. 29, 2013, provisional application No. 61/871,705, filed on Aug. 29, 2013, provisional application No. 61/871,692, filed on Aug. 29, 2013.

(51) Int. Cl.

| | |
|---|---|
| ***B65H 1/00*** | (2006.01) |
| ***G07F 11/28*** | (2006.01) |
| ***A47F 1/08*** | (2006.01) |
| ***A47F 1/04*** | (2006.01) |
| ***B65D 71/36*** | (2006.01) |

(52) U.S. Cl.

CPC . *G07F 11/28* (2013.01); *A47F 1/04* (2013.01); *A47F 1/087* (2013.01); *B65D 71/36* (2013.01); *B65D 2571/0066* (2013.01); *B65D 2571/00141* (2013.01); *B65D 2571/00574* (2013.01); *B65D 2571/00728* (2013.01)

(58) Field of Classification Search

CPC ..... G07F 11/28; A47F 1/087; A47F 1/04; B65D 71/36

USPC ..... 221/197, 31, 32; 229/122

See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |

(Continued)

FOREIGN PATENT DOCUMENTS

| | | | |
|---|---|---|---|
| EP | 1539607 | B1 | 3/2009 |
| JP | 07124041 | A | 5/1995 |

(Continued)

OTHER PUBLICATIONS

International Search Report and Written Opinion for International Application No. PCT/US2014/027165. Issued on May 26, 2014.

(Continued)

*Primary Examiner* — Rakesh Kumar

(74) *Attorney, Agent, or Firm* — Shutts & Bowen LLP

(57) ABSTRACT

A serpentine dispenser and cartridge system provides simplified stocking and restocking of the dispenser, as well as jam-free dispenser feeding. Cartridge opening flaps allow a cartridge be inverted and inserted into a dispenser while products in the cartridge are prevented from falling out. A dispenser wedge applies pressure on rolling products as the cartridge is inserted into the dispenser, forcing a retaining flap open so that rolling products may exit the cartridge and enter the dispenser. The wedge may also constrain rolling products to exit the cartridge in an order that prevents jamming.

8 Claims, 54 Drawing Sheets

(56) References Cited

U.S. PATENT DOCUMENTS

| | | | | |
|---|---|---|---|---|
| 1,898,056 | A | 2/1933 | Johnson | |
| 2,382,191 | A | 8/1945 | Weichselbaum | |
| 2,996,344 | A | 8/1961 | Garman | |
| 3,055,293 | A | 9/1962 | Lariccia | |
| 3,178,242 | A | 4/1965 | Ellis et al. | |
| 3,203,554 | A | 8/1965 | Pendergrast, Jr. et al. | |
| 3,300,115 | A | 1/1967 | Schauer | |
| 3,784,022 | A | 1/1974 | Beesley, Jr. | |
| 3,923,159 | A | 12/1975 | Taylor et al. | |
| 4,228,903 | A | 10/1980 | Eckert | |
| 4,435,026 | A | 3/1984 | Johnson | |
| 4,598,828 | A | 7/1986 | Young et al. | |
| 4,823,982 | A | 4/1989 | Aten et al. | |
| 4,915,571 | A | 4/1990 | Toshihiko et al. | |
| 5,289,943 | A | 3/1994 | Powell | |
| 5,314,078 | A | 5/1994 | Morikiyo et al. | |
| 5,328,258 | A | 7/1994 | Scalise | |
| 5,390,821 | A | 2/1995 | Markel | |
| D363,174 | S | 10/1995 | Fletcher | |
| 5,462,198 | A | 10/1995 | Schwimmer | |
| 5,540,315 | A | 7/1996 | Haiki et al. | |
| 5,788,117 | A * | 8/1998 | Zimmanck | A47F 1/08 211/59.2 |
| 5,836,478 | A | 11/1998 | Weiss | |
| 5,878,862 | A | 3/1999 | Dewsnap | |
| 5,894,942 | A | 4/1999 | Miyashita et al. | |
| 6,253,930 | B1 | 7/2001 | Freidus et al. | |
| 6,991,116 | B2 | 1/2006 | Johnson et al. | |
| 7,207,447 | B2 | 4/2007 | Medcalf et al. | |
| 7,552,857 | B2 | 6/2009 | Harrelson | |
| 7,717,321 | B2 | 5/2010 | Spivey, Sr. et al. | |
| 7,922,437 | B1 | 4/2011 | Loftin et al. | |
| 7,992,747 | B2 | 8/2011 | Bauer | |
| 8,047,400 | B1 | 11/2011 | Luberto | |
| 8,127,980 | B2 | 3/2012 | Spivey, Sr. et al. | |
| 8,162,206 | B2 | 4/2012 | Harrelson | |
| 8,302,809 | B1 | 11/2012 | Bogdziewicz, III et al. | |
| 8,308,023 | B2 * | 11/2012 | Gelardi | A47F 1/087 221/31 |
| 8,322,543 | B2 | 12/2012 | Gelardi et al. | |
| 8,448,815 | B2 | 5/2013 | Sholl et al. | |
| 8,550,261 | B2 | 10/2013 | Loftin et al. | |
| 8,628,003 | B2 | 1/2014 | Thomas et al. | |
| 8,833,601 | B2 * | 9/2014 | Zacherle | B65D 71/36 221/30 |
| 2004/0200789 | A1 | 10/2004 | Woodbury | |
| 2005/0127015 | A1 | 6/2005 | Medcalf et al. | |
| 2006/0091191 | A1 | 5/2006 | DeBusk | |
| 2006/0180488 | A1 | 8/2006 | Spivey, Sr. et al. | |
| 2007/0007221 | A1 | 1/2007 | Mann | |
| 2009/0212066 | A1 | 8/2009 | Bauer | |
| 2009/0308885 | A1 | 12/2009 | Sainato et al. | |
| 2010/0072150 | A1 | 3/2010 | Takashima et al. | |
| 2010/0096401 | A1 | 4/2010 | Sainato et al. | |
| 2010/0187295 | A1 | 7/2010 | Spivey, Sr. et al. | |
| 2010/0252619 | A1 | 10/2010 | Harrelson | |
| 2011/0121010 | A1 | 5/2011 | Loftin et al. | |
| 2011/0121011 | A1 | 5/2011 | Gelardi et al. | |
| 2012/0018391 | A1 | 1/2012 | Gelardi et al. | |
| 2012/0074160 | A1 | 3/2012 | Thomas et al. | |
| 2012/0074164 | A1 | 3/2012 | Walling et al. | |
| 2012/0097694 | A1 | 4/2012 | Gelardi | |
| 2012/0104082 | A1 | 5/2012 | Spivey, Sr. et al. | |
| 2012/0211510 | A1 | 8/2012 | Gelardi et al. | |
| 2012/0211522 | A1 | 8/2012 | Gelardi et al. | |
| 2012/0217213 | A1 | 8/2012 | Thomas | |
| 2012/0217261 | A1 | 8/2012 | Bailey et al. | |
| 2012/0223090 | A1 | 9/2012 | Thomas et al. | |
| 2012/0228247 | A1 | 9/2012 | Loftin et al. | |
| 2012/0279893 | A1 * | 11/2012 | Gelardi et al. | 206/526 |
| 2012/0285976 | A1 | 11/2012 | Bogdziewicz, III et al. | |
| 2012/0285977 | A1 | 11/2012 | Bates et al. | |
| 2012/0318817 | A1 | 12/2012 | Zacherle et al. | |
| 2012/0325839 | A1 | 12/2012 | Bates et al. | |
| 2013/0020341 | A1 | 1/2013 | Bogdziewicz, III et al. | |
| 2013/0062360 | A1 | 3/2013 | Bogdziewicz, III et al. | |
| 2013/0062361 | A1 | 3/2013 | Loflin et al. | |
| 2013/0105509 | A1 | 5/2013 | Gelardi et al. | |
| 2013/0134119 | A1 | 5/2013 | Loftin et al. | |
| 2013/0134177 | A1 * | 5/2013 | Loftin | 221/1 |
| 2013/0221017 | A1 | 8/2013 | Zacherle et al. | |
| 2013/0221020 | A1 | 8/2013 | Zacherle et al. | |
| 2013/0233813 | A1 | 9/2013 | Zacherle et al. | |
| 2013/0248468 | A1 | 9/2013 | Burton et al. | |
| 2013/0270203 | A1 | 10/2013 | Burton et al. | |
| 2013/0277321 | A1 | 10/2013 | Zacherle | |
| 2013/0277385 | A1 * | 10/2013 | Zacherle | 221/197 |
| 2014/0001200 | A1 | 1/2014 | Bates et al. | |
| 2014/0054310 | A1 | 2/2014 | Loftin et al. | |
| 2014/0061217 | A1 | 3/2014 | Fortuna et al. | |
| 2014/0076922 | A1 | 3/2014 | Binshtok et al. | |
| 2014/0102942 | A1 | 4/2014 | Thomas et al. | |
| 2014/0103056 | A1 | 4/2014 | Thomas et al. | |
| 2015/0001244 | A1 * | 1/2015 | Bauer | A47F 1/04 221/197 |

FOREIGN PATENT DOCUMENTS

| | | | |
|---|---|---|---|
| JP | 11346880 | A | 12/1999 |
| JP | 2008080058 | A | 4/2008 |
| JP | 2013537443 | A | 10/2013 |
| JP | 2013540663 | A | 11/2013 |
| WO | 2011063177 | A1 | 5/2011 |
| WO | 2012012201 | A1 | 1/2012 |
| WO | 2012012677 | A1 | 1/2012 |
| WO | 2012040053 | A1 | 3/2012 |
| WO | 2012082233 | A1 | 6/2012 |
| WO | 2012115727 | A1 | 8/2012 |
| WO | 2012115728 | A1 | 8/2012 |
| WO | 2012118776 | A1 | 9/2012 |
| WO | 2013036439 | A1 | 3/2013 |
| WO | 2013036443 | A1 | 3/2013 |
| WO | 2013078113 | A2 | 5/2013 |
| WO | 2013081810 | A1 | 6/2013 |
| WO | 2013081814 | A1 | 6/2013 |
| WO | 2013126215 | A1 | 8/2013 |
| WO | 2013126218 | A1 | 8/2013 |
| WO | 2013158434 | A1 | 10/2013 |
| WO | 2013162942 | A1 | 10/2013 |
| WO | 2013163014 | A1 | 10/2013 |

OTHER PUBLICATIONS

International Search Report and Written Opinion for International Application No. PCT/US2014/053432. Issued on Nov. 14, 2014.
International Search Report and Written Opinion for International Application No. PCT/US2014/053372. Issued on Dec. 12, 2014.
International Search Report and Written Opinion for International Application No. PCT/US2014/053417. Issued on Nov. 21, 2014.

* cited by examiner

DISPENSER WITH WEDGE FOR ROLLING PRODUCTS

REFERENCE TO RELATED APPLICATIONS

This application claims one or more inventions which were disclosed in Provisional Application No. 61/871,705, filed Aug. 29, 2013, entitled "Product Dispenser With An S-Shaped Down Chute"; Provisional Application No. 61/871,692, filed Aug. 29, 2013, entitled "Dispenser For Rolling Product And Dispenser Cartridges"; and, Provisional Application No. 61/871,711, filed Aug. 29, 2013, entitled "Dispenser With Wedge For Rolling Products". The benefit under 35 USC §119(e) of the United States provisional applications is hereby claimed, and the aforementioned applications are hereby incorporated herein by reference.

BACKGROUND OF THE INVENTION

1. Field of the Invention

The invention pertains to the field of product dispensers and bulk packed cartridges for stocking them. More particularly, the invention pertains to product dispensers that open bulk packed cartridges for rolling products during stocking.

2. Description of Related Art

A dispenser with a cartridge containing multiple rolling product packages, Bauer (U.S. Pat. No. 7,992,747, for example), accommodates a variety of different bulk packed product shipping cartons [henceforth referred to as "cartridge (s)"] with a variety of can counts or arrangements packed therein. As shown in prior art FIGS. 1 and 2, it is often desirable to stack cans two or more wide in the cartridge 10 in its shipping orientation (with the cans vertical therein), or one or more rows (lower row 1, upper row 2) high in the "at use" position (when the cartridge 10 is inside the dispenser 20 as shown in prior art FIGS. 4-18). In some prior art examples, a cartridge may contain a single row of rolling product packages. In some of these prior art examples, the row may comprise, for examples, a single row cartridge may comprise a single row of six individual rolling products. In other prior art examples, a cartridge may contain a single row of six stacks of rolling products, such that, for example a cartridge containing twenty-four rolling products may comprise six stacks wherein each stack comprises four rolling products that may be nested to act as a single rolling product. In other prior art examples, a cartridge may comprise two or more rows of products, with each row comprising a number of individual rolling products, or a number of stacks of rolling products and the stacks may be nested or unnested.

The configuration most commonly known to the public is a cartridge 10 for canned soda and other carbonated beverages comprising four rows of six cans each. Alternatively, for example, in cartridges 10 containing cat food cans known in the prior art, the cartridge may comprise a one or more rows of rolling products, with each row comprising nested stacks of two or more cat food cans. Generally almost any product packed in cans, bottles, or other configuration capable of rolling can be so packaged in one or more rows. This is also true for stacks of nested cans, as shown in prior art FIG. 3, where each nested stack (lower row 1 and upper row 2) functions the same as if it was a single can.

One skilled in the art of dispensers 20 and bulk shipping cartridges 10 will therefore appreciate that the operation of dispensers 20 and cartridges 10 described herein applies equally to one or more rows of single cans, stacks of nested cans, and any packaging configuration of one or more rows of product packages that are capable of rolling.

Henceforth, "can" or "cans" includes, but is not limited to, a conventional metal can or cans, a stack of nested cans, stacks of nested cans, and any other packaging form that is capable of rolling. Such bulk shipping cartridges 10 and associated dispensers 20 are more flexible for retailers or brand marketers and assist with the efficient management of their supply chains and sales.

Referring to prior art FIGS. 4-11, a dispenser 20 is shown with a cartridge 10 holding area 24, an entry port 45 that is aligned with a cartridge dispensing port 20*a* (shown in FIG. 5), a down chute 30, a lower feed ramp 40, and a cartridge loading ramp 35. When a pre-filled bulk packed cartridge 10 is inserted into the cartridge holding area 24 (FIG. 4) of completely empty matching dispenser 20, such as shown in prior art FIGS. 4-11, products (cans in lower row 1 and upper row 2) generally load and feed through the dispenser 20, and are dispensed to shoppers according to design expectations. Prior art FIG. 4 shows a prior art cartridge 10 being loaded into a prior art dispenser 20 cartridge holding area 24 after a dispensing port (not shown in this figure, see FIG. 5, reference 20*a* has been made in the bottom of the cartridge 10 adjacent to the rear-most edge of the cartridge 10 to allow cans to exit the cartridge 10 through the dispensing port 20*a* and the entry port 45.

A sequence of events after loading is shown in prior art FIGS. 5-11 in detail. Starting with prior art FIG. 5, wherein the dispensing port20*a* of a cartridge 20 that has been fully inserted into a dispenser 10 is aligned with the entry port 45, the first four cans 1, 2, 3, 4 that exit the cartridge 10 during feeding into the dispenser 20 are critical to the proper operation of the cartridge 10 and dispenser 20 system. It has been found that, after these first four cans 1, 2, 3, 4, exit the cartridge 10 the balance of cans in the cartridge 10 have sufficient room to move inside the cartridge 10 so that no jamming occurs thereafter. The exiting of these first four cans 1, 2, 3, 4, no matter the size or weight of the cans, therefore determines the efficient and reliable feeding of all the cans from the cartridge 10 through the dispensing port20*a* and into and through the dispenser 20 to a product selection location 25 where they can be selected by the consumer.

Referring again to prior art FIG. 5, immediately after the cartridge 10 is loaded into the dispenser 20 and the dispensing port20*a* is aligned with the entry port 45, can 1 is free to exit the cartridge 10, drop vertically downward through the dispensing port 20*a* and the entry port 45, roll along the down chute 30, and then roll along the lower feed ramp 40 to the product selection area 25. Similarly, as shown in prior art FIG. 6, can 2 is generally free to also follow can 1, falling vertically downward inside the cartridge 10, through the dispensing port 20*a* and entry port 45, into the dispenser 20, and then rolling to the product selection area 25.

However, experience has shown that successful feeding of cans 3, 4 is largely due to the impacts and vibrations caused by the first cans 1, 2 transiting the dispenser 20. Impacts and vibrations dislodge products lodged in the cartridge 10 or stuck in between the dispenser down chute 30 and loading ramp 35, or behind another can, as illustrated in prior art FIGS. 7, 8, and 10 for example. Thus, reliable dispenser 20 feeding is more a matter of chance rather than a result of a truly functional dispenser 20/cartridge 10/can 1, 2, 3, 4 interaction.

As shown in prior art FIGS. 7-8, after cans 1 and 2 exit the cartridge 10, cans 3 and 4 may be positioned such that they cause a feed jam. While the impact of cans 1 and 2 with the down chute 30 (prior art FIG. 7), or the product selection area 25 (prior art FIG. 8) may cause sufficient vibration in the dispenser 20 to dislodge the feed jam, this is by no means guaranteed and is not always the case. However, assuming such impacts do occur and free can 4 (prior art FIG. 9), can 4 is then free to roll along the down chute 30 to the product selection area 25, and can 3 may follow suit (prior art FIG. 10), followed by the rest of the cans in the cartridge 10 until the dispenser 20 is full of product (prior art FIG. 11).

Prior art FIGS. 12-18 show the partially filled dispenser 20 of prior art FIGS. 4-11 during a restocking operation. When restocking the dispenser 20 by inserting a new cartridge 10 full of cans into the cartridge holding area 24 when the lower feed ramp 40 is not empty, there is insufficient can 1, 2, 3, 4 movement to cause dislodging impacts and vibrations. The sequence of events in this circumstance is similar to the events, illustrated in prior art FIGS. 5-8, that occur when filling an empty dispenser 20.

Prior art FIG. 12 shows a full cartridge 10 being inserted into the cartridge holding area 24 of a dispenser 20 that remains partially filled with previously loaded cans. Immediately after inserting the cartridge 10 and the dispensing port 20*a* is aligned with the entry port 45 (prior art FIG. 13), can 1 is free to move through dispensing port 20*a*, through the entry port 45, and roll along the down chute 30, but only until it contacts the rearmost previously loaded can in the lower channel. As shown in prior art FIG. 14, can 2 drops immediately down behind can 1, and can 4 is biased to roll over can 3. This restocking situation thus shortens the distance cans 1 and 2 move in the dispenser, which significantly reduces the previously described impacts and vibrations. As shown in prior art FIG. 15, when a can is removed from the product selection area 25, can 1 and can 2 move along the down chute 30, with can 4 biased to follow by rolling over the top of can 3. At this point, shown in prior art FIGS. 15-16, can 3 and can 4 are in a position that may potentially result in a jam. While the cans remaining in the dispenser 20 lower feed ramp 40 may still be selected, the jam (prior art FIG. 17) prevents product movement from the cartridge 10 through the dispensing port 20*a* and entry port 45.

As a result of this sequence of events, products tend to jam either inside the cartridge 10 prior to exiting the entry port 45, as shown in prior art FIGS. 12-17, or within the down chute 30 of the dispenser (prior art FIG. 18), depending on the various relationships between the entry port 45 size, the can diameter, the down chute 30 configuration, and other factors. Such jams are unacceptable because dispensing cans to shoppers becomes unreliable and increases, rather than decreases, the manual labor and time needed to maintain the system, as presently occurs with similar prior art dispensers in stores.

Additionally, for a dispenser which displays and dispenses rolling product packages to be stocked/loaded, or restocked/reloaded, using bulk packed cartridges 10 of generally cylindrical products, the cartridges 10 must be both easy and safe to open and load into the dispensers 20. In order to effectively reduce stocking/restocking time and labor, this process must also be accomplished quickly.

Prior art cartridges 10 employ a simple tear tab and removable flap opening that is removed by the stocking person prior to define a dispensing port 20*a* prior to loading the cartridge 10 into the dispenser 20. However, in order to load the cartridge 10 into the dispenser 20, the cartridge 10 must be inverted after removing the flap, so that the open dispensing port 20*a* is in the downward and a rearward facing position.

When the opened cartridge 10 is in the inverted position, products simply fall out the dispensing port 20*a* if the stocking person does not hold their hand over the dispensing port 20*a* during cartridge 10 inversion and insertion. This necessary action by the stock person is clumsy, difficult, and danger prone in busy commercial environments. If the stock person forgets to cover the opening, or their hand slips off the opening, the least that may happen is that products will fall out of the cartridge 10 and onto the floor, denting them and rendering them unsalable. However, heavy canned products may also fall out of the cartridge 10 and hit the stock person, causing injury. This possibility is especially of concern if the cartridge 10 is being lifted into an overhead dispenser 20, from which a falling can could hit the stock person in the head. Further, neat, rapid, and efficient displaying, dispensing, and restocking devices and methods encourage retailers to perform restocking during the business day. During business hours, when shoppers are present, stocking and restocking mishaps represent a hazard that could also endanger a shopper or child, which is a liability concern that retailers obviously desire to avoid.

SUMMARY OF THE INVENTION

A serpentine dispenser and rolling product cartridge system provides for simplified stocking and restocking of the dispenser, as well as jam-free feeding of rolling products (e.g., cans) from a cartridge through the dispenser. In various embodiments, a perforated opening flap and retaining flap allow a cartridge containing rolling products to be inverted and prepared for insertion into a dispenser while rolling products in the cartridge are prevented from falling out of the cartridge. A dispenser wedge is provided that enters a slot in the cartridge and applies downward pressure on rolling products in the cartridge, causing a perforated retaining flap in the cartridge bottom to open as the cartridge is pushed into the dispenser.

In some embodiments, the wedge also impedes movement of some rolling products in the cartridge until other rolling products have exited the cartridge in a dispensing order that prevents jamming. In still other embodiments, the dispenser wedge may include a channel along one side of the wedge to accept circumferential surface features, such as rims about the top of a can, to further guide nested cans in a single row, and more evenly apply pressure to multiple cans in a nested stack.

DETAILED DESCRIPTION OF THE INVENTION

Figure 1:
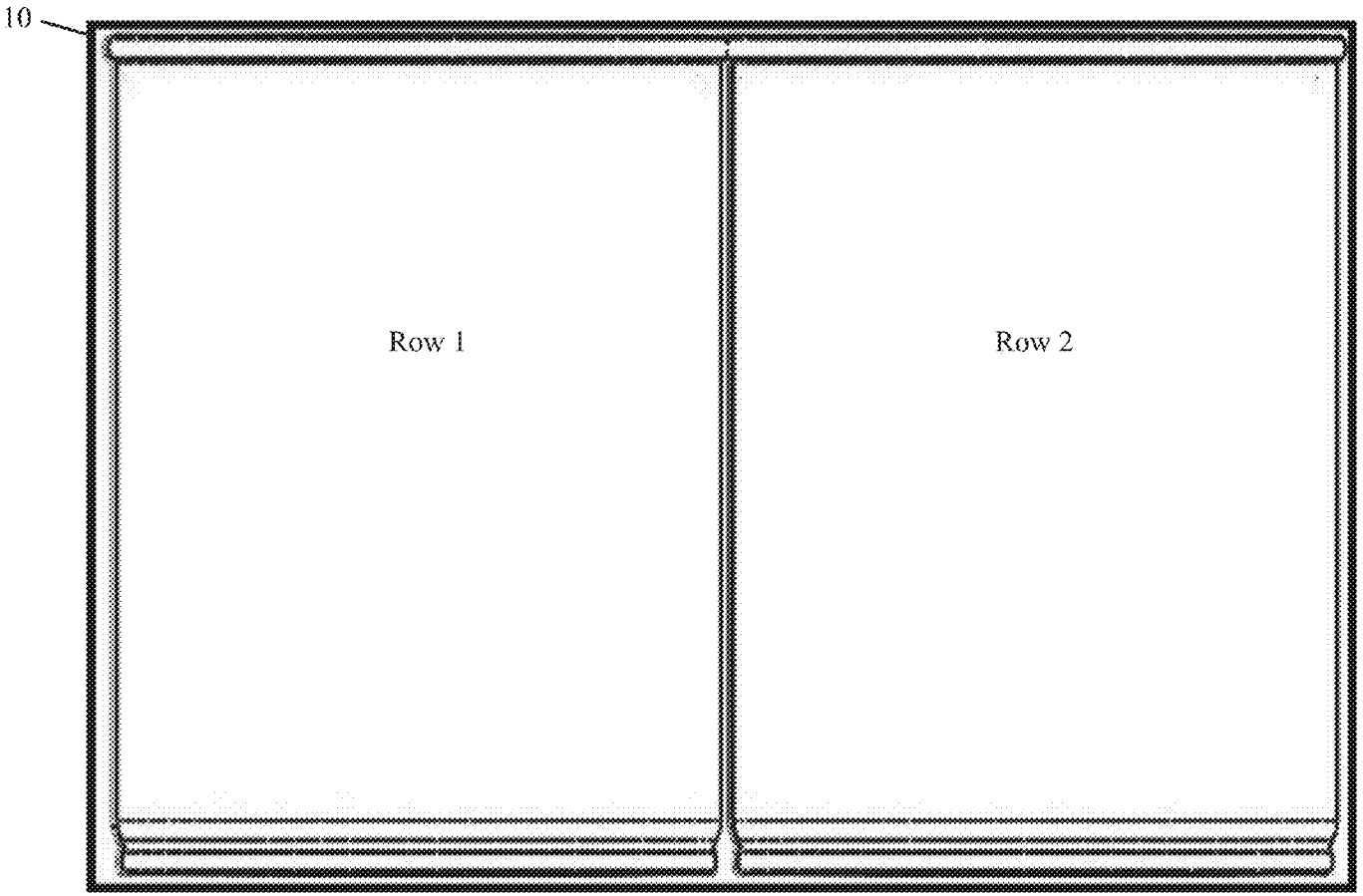
FIG. 1 PRIOR ART
FIG. 1 shows an open end view of a prior art double row product cartridge.
Figure 2:
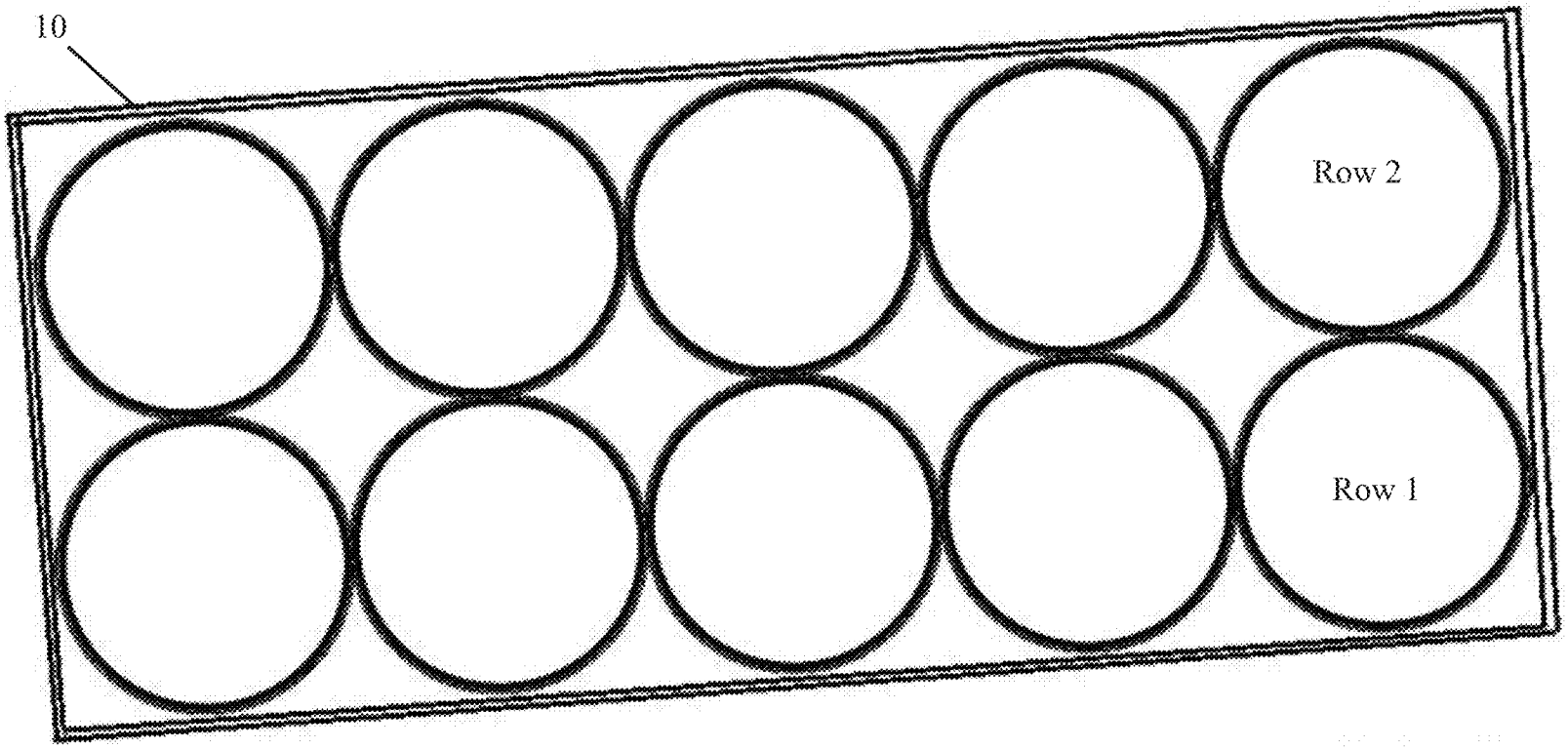
FIG. 2 PRIOR ART
FIG. 2 shows an open side view of a prior art double row product cartridge.

Improved product dispensers and cartridges preferably provide a dispensing system that facilitates loading without danger of product prematurely exiting the cartridge thereby reducing risk to personnel, and simplifying the loading process thereby saving time and expense. Additionally, a preferred cartridge and dispenser system biases, or forces, cans contained in a cartridge to dispense in a natural or preferred sequence which will prevent jamming of the critical first four cans in the cartridge.

A preferred dispenser embodiment is now presented that also fulfills the goals of safety and rapidity previously described, and does so through a combination of dispenser improvements working in conjunction with various die-cut perforations in a cartridge as described herein.

Specifically, a combination of dispenser and cartridge embodiments, shown in FIGS. 19-54, provides a modified dispenser and a cartridge with specific types of die cut perimeters, perforations, folds, and assembly methods which, together, automatically actuates the quick, safe, easy opening of cartridges during their dispenser insertion operation. The dispenser 20 shown in these figures includes two sides 21, 23, a resting ledge 34, a cartridge loading ramp 32, an entry port 45, a lower feed ramp 40, and a product selection area 25. The dispenser also has a cartridge holding area 24 having a top 26 and a rear wall 22 FIGS. 19-20, FIGS. 22-32, and FIGS. 39-41 show a dispenser 20 with a conventional arcuate down chute 30, while FIGS. 33-37 and FIG. 48 show a dispenser 20 with an S-shaped down chute 50.

Figure 19:
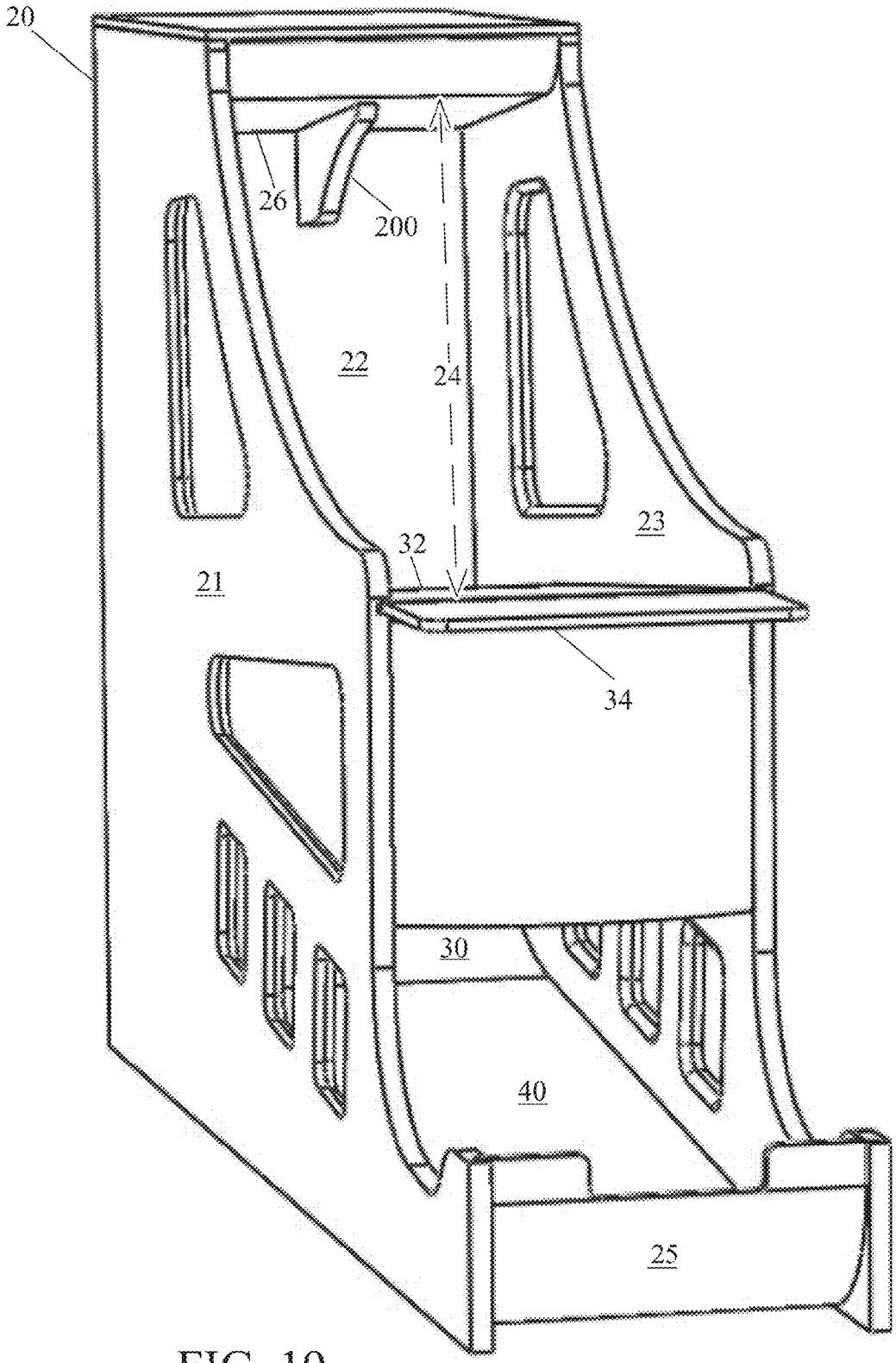
FIG. 19 shows a perspective view of a modified dispenser with cartridge opening wedge.
Figure 20:
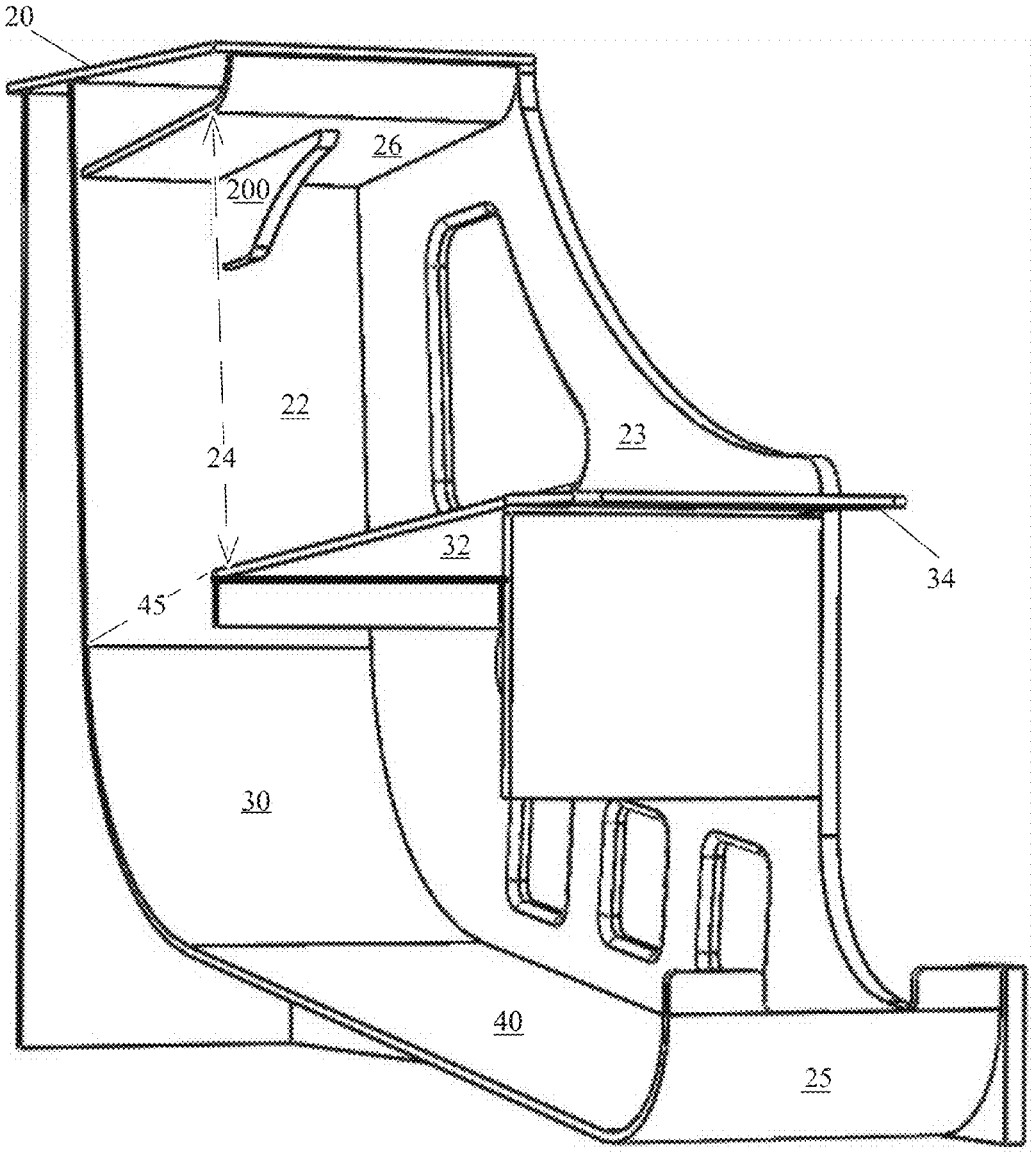
FIG. 20 shows a partial cut away perspective of a dispenser having a cartridge opening wedge.
Figure 22:
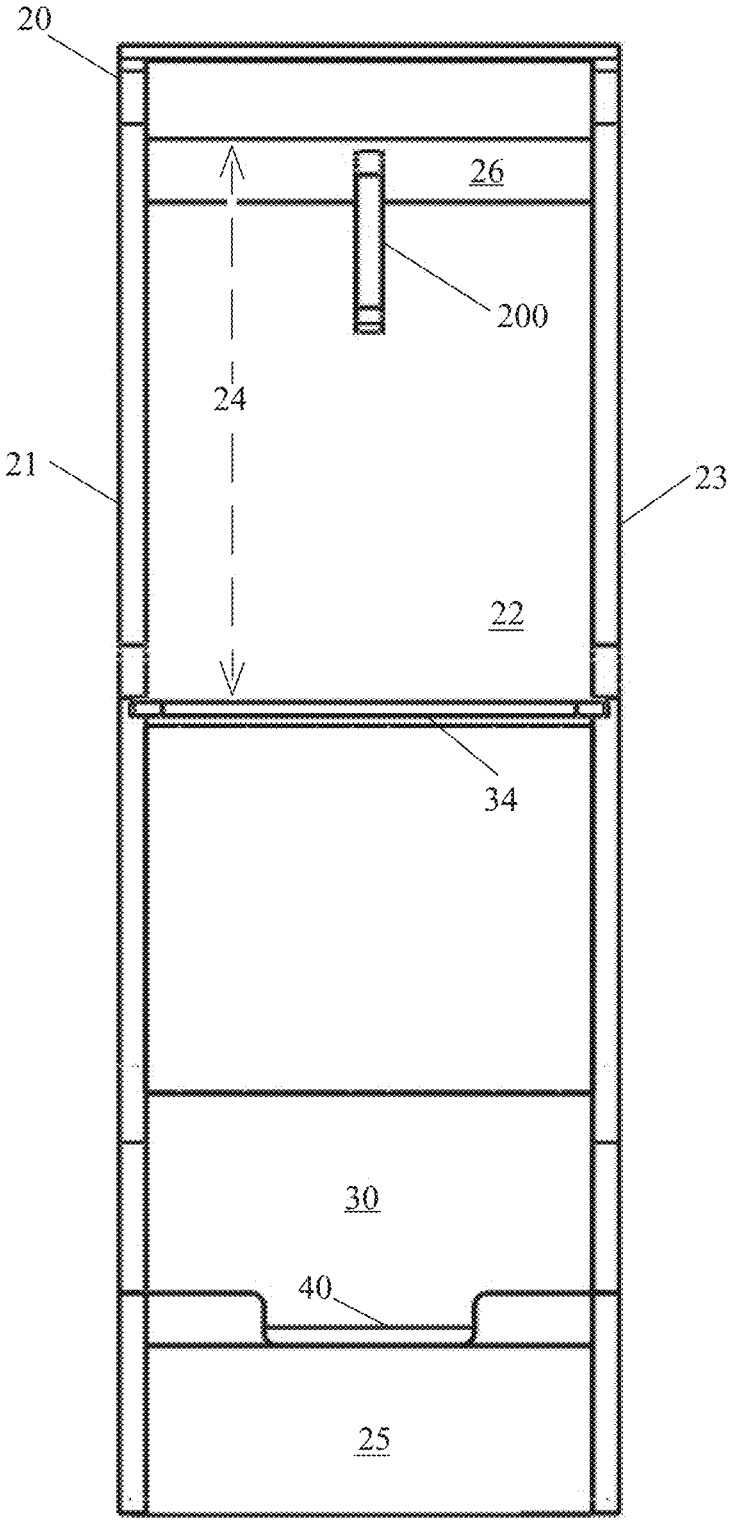
FIG. 22 shows a front view of a dispenser having a cartridge opening wedge.

The dispenser 20 of FIGS. 19-20 and FIG. 22 includes a generally wedge-shaped projection 200 centrally located at and affixed to both the top 26 and rear 22 of the cartridge holding area 24, and is hereafter referred to as a "wedge" 200. The wedge 200 may be an integral part of the dispenser 20, or may be retrofitted to an existing dispenser 20 with screws, adhesives, or other similar robust attachment means. Although only one wedge 200 is shown, a plurality of identical wedges 200 spaced horizontally across the cartridge holding area top 26 and rear wall 22 may be alternatively used accordingly to, for example, distribute force against multiple cans in a row in a cartridge 92, 93 (see FIGS. 42 and 43) by the plurality of wedges 200 rather than a single wedge 200.

Figure 21:
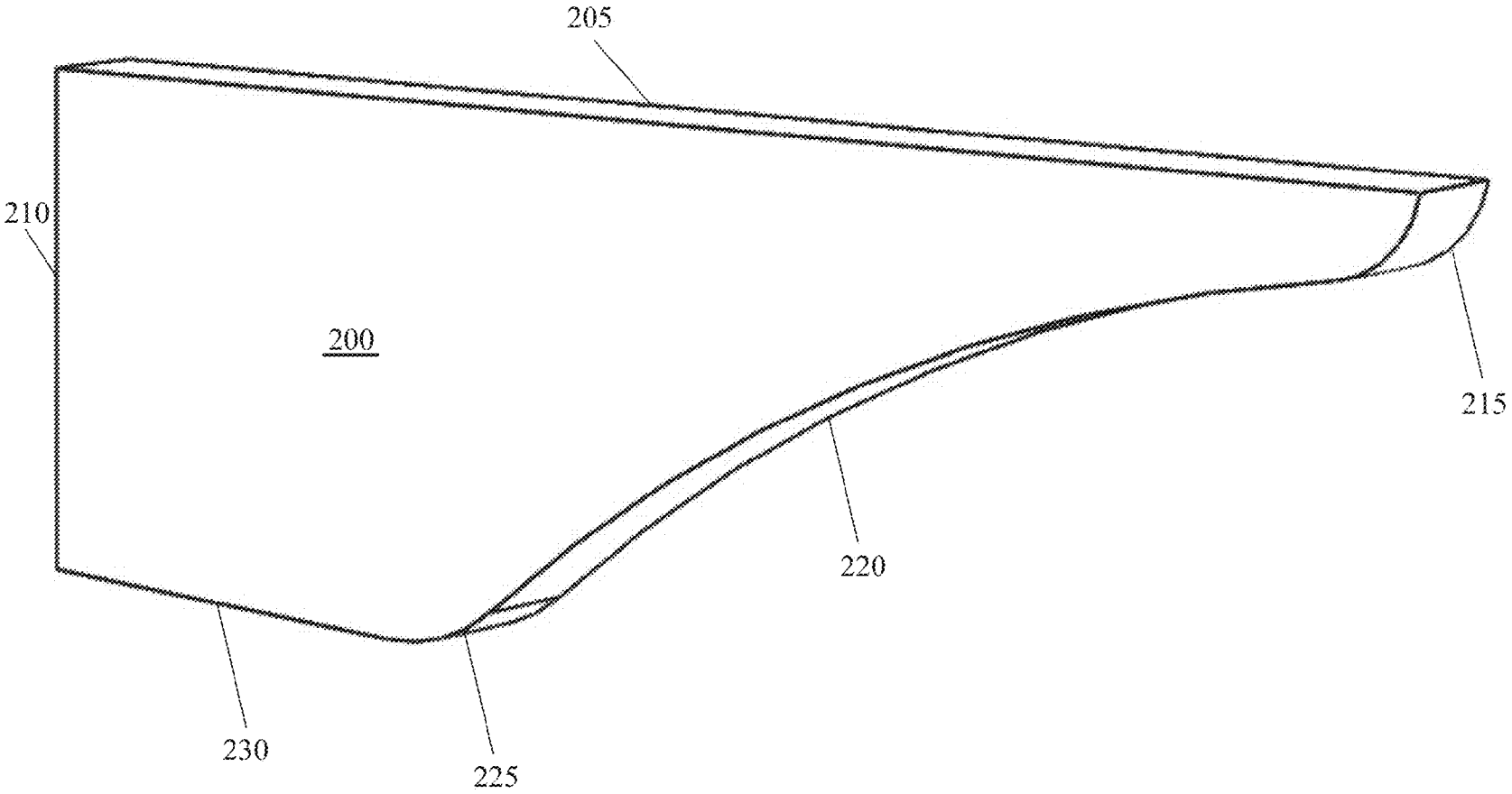
FIG. 21 shows a perspective detail of a cartridge opening wedge.

In one preferred embodiment, shown in FIG. 21, the wedge 200 is generally trapezoidal, having a base 205, a first side 210 perpendicular to the base 205, a top 230 parallel to the base 205 for a portion of the base 205 length, and a second side that connects the shorter top 230 and longer base 205. This second side is generally formed by three arcuate sections 215, 220, 225. A front-most arcuate section 215 forms a small convex, arcuate surface which begins approximately perpendicular to the base 205, and ends approximately tangent to a central arcuate section 220.

Figure 23:
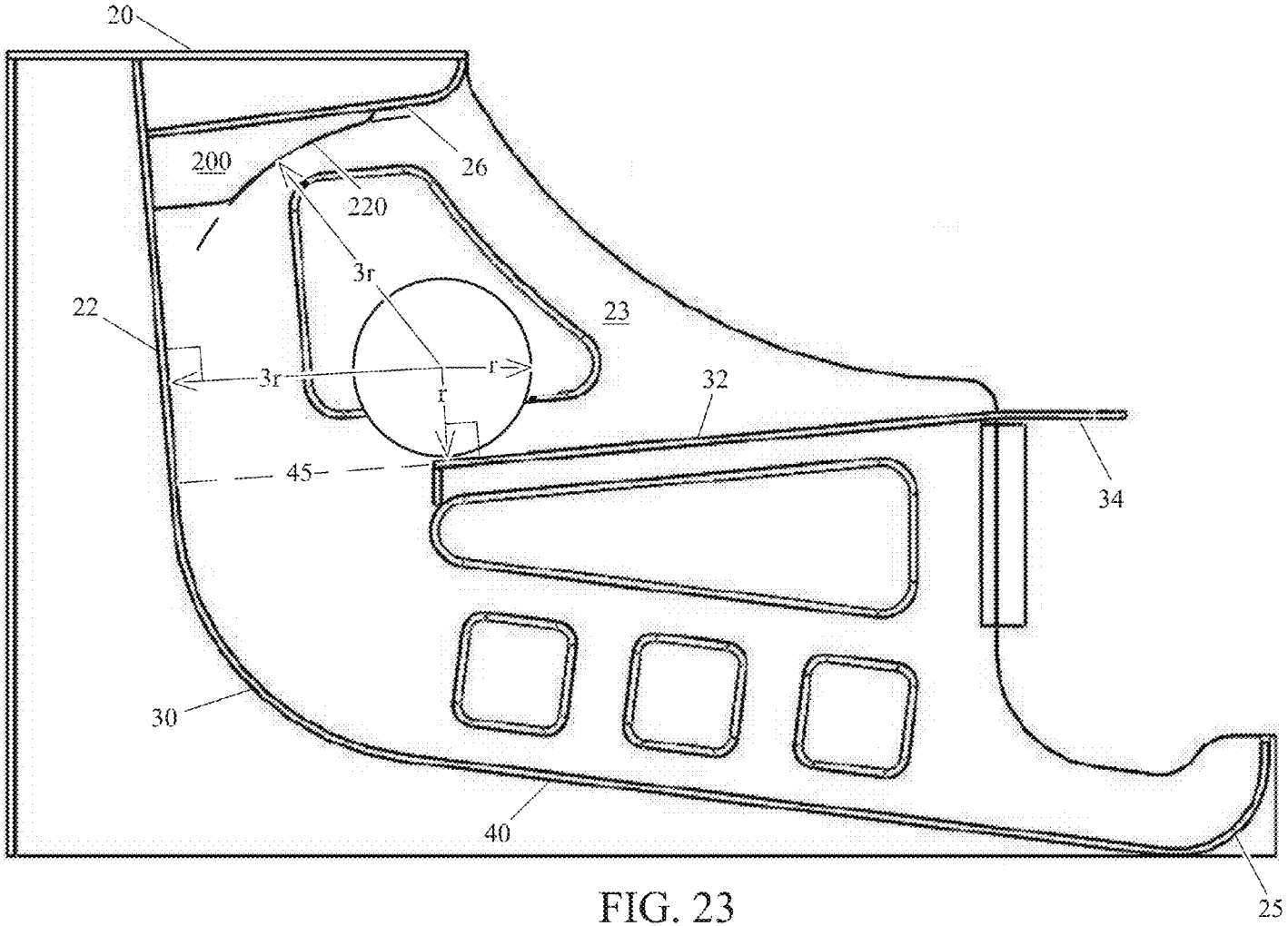
FIG. 23 shows a radius of curvature of a cartridge opening wedge.

The central arcuate section 220 is a generally concave arcuate surface which, as shown in FIG. 23, is roughly concentric to the outermost circumference of can 3 when a cartridge is completely inserted into the dispenser 20. In some preferred embodiments, the radius of curvature of the central arcuate section 220 is approximately 3 times the radius, "r", of can 3. In some preferred embodiments the origin of the central arcuate section 220 radius of curvature is located at a distance approximately "r" perpendicularly above the cartridge loading ramp 32, and a distance approximately "3r" perpendicularly forward of the cartridge holding area rear wall 22. Deviations from these dimensions are considered within the scope of this description, provided the function of the wedge 200 when interacting with the cartridge 92, 94 is maintained.

A third arcuate section 225 connects the central arcuate section 220 with the wedge 200 top 230 and forms a smooth transition between the two that will not dent or puncture cans as they move past the wedge 200.

Figure 24:
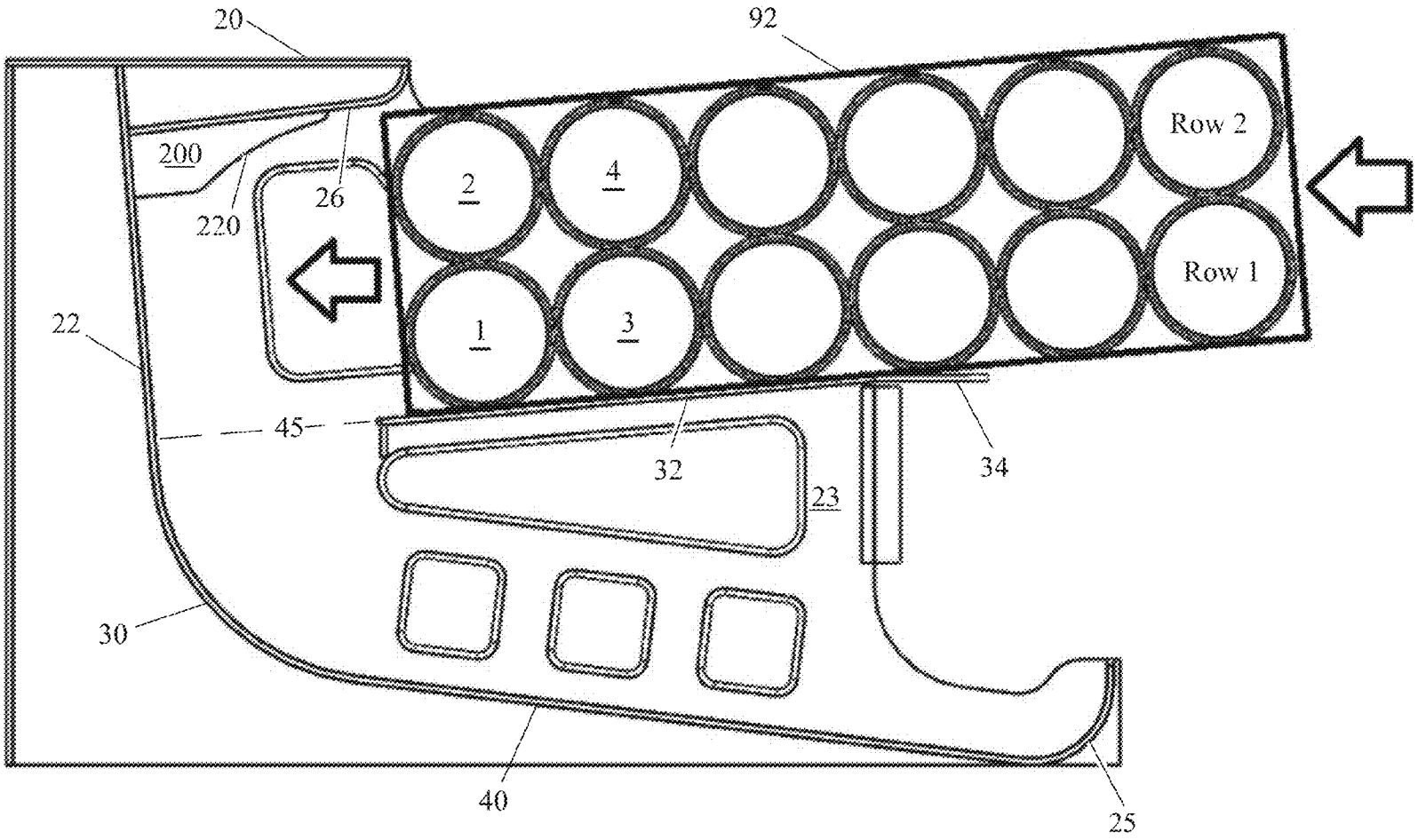
FIG. 24 shows an open side view of a cartridge having a perforated slot and bridge being inserted into a dispenser with a cartridge opening wedge.
Figure 25:
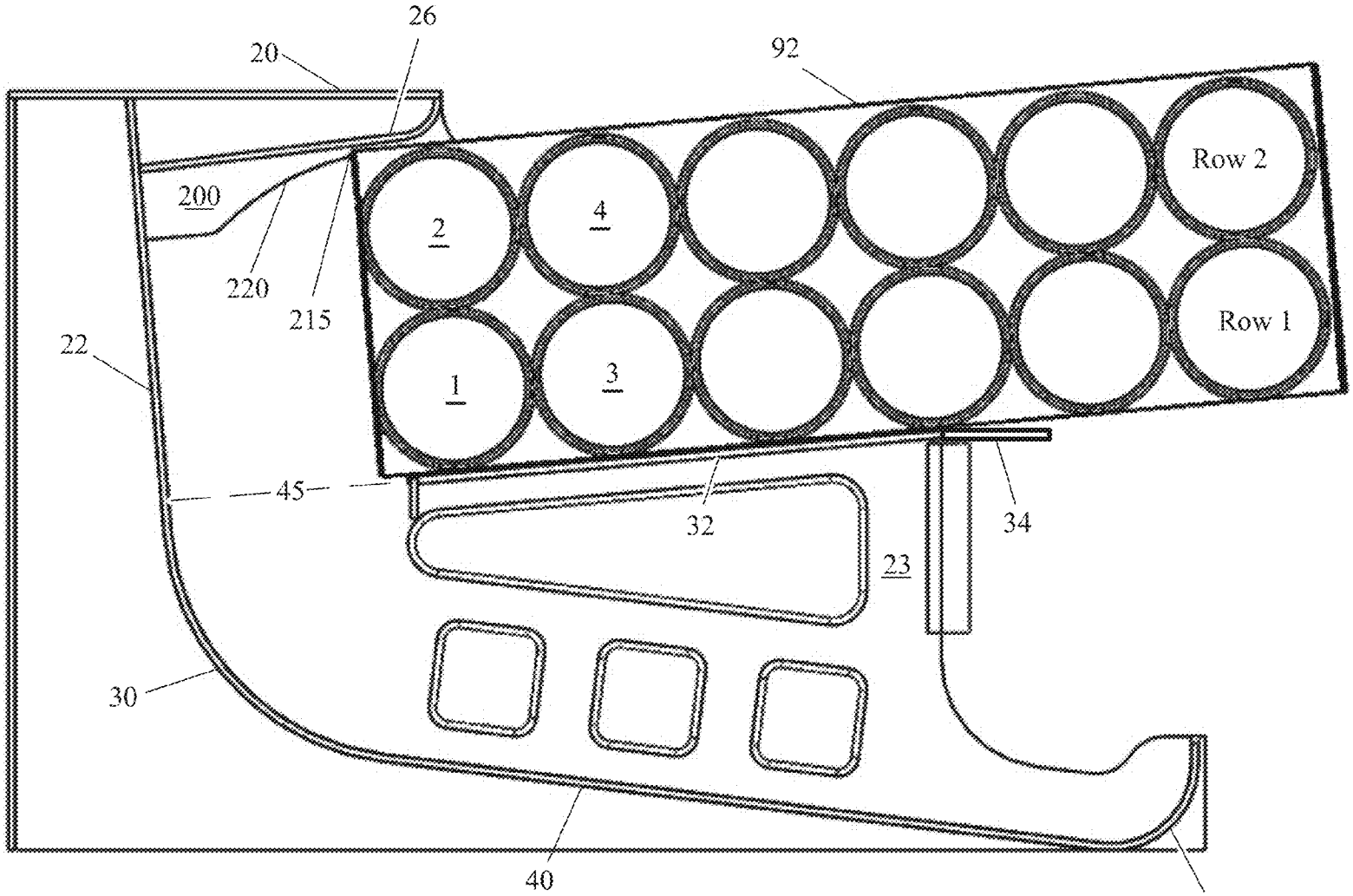
FIG. 25 shows an open side view of a cartridge having a perforated slot and bridge being inserted into a dispenser with a cartridge opening wedge contacting an edge of the cartridge.
Figure 26:
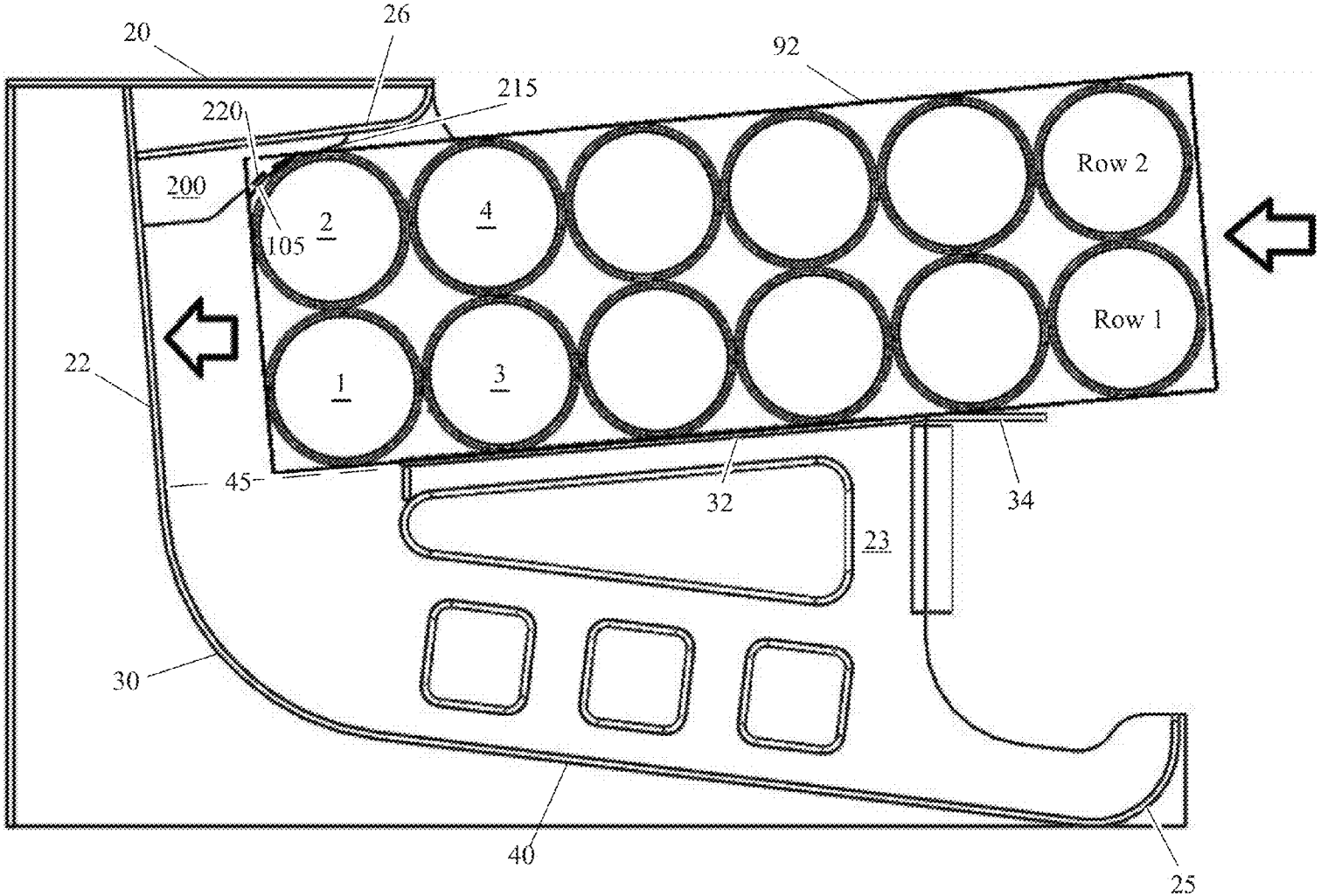
FIG. 26 shows an open side view of a cartridge having a perforated slot and bridge being inserted into a dispenser with a cartridge opening wedge pushing the bridge so that it starts to contact a first can in a second row of the cartridge and starts to push cans in the cartridge toward the a cartridge retaining flap and entry port as insertion of the cartridge continues.
Figure 27:
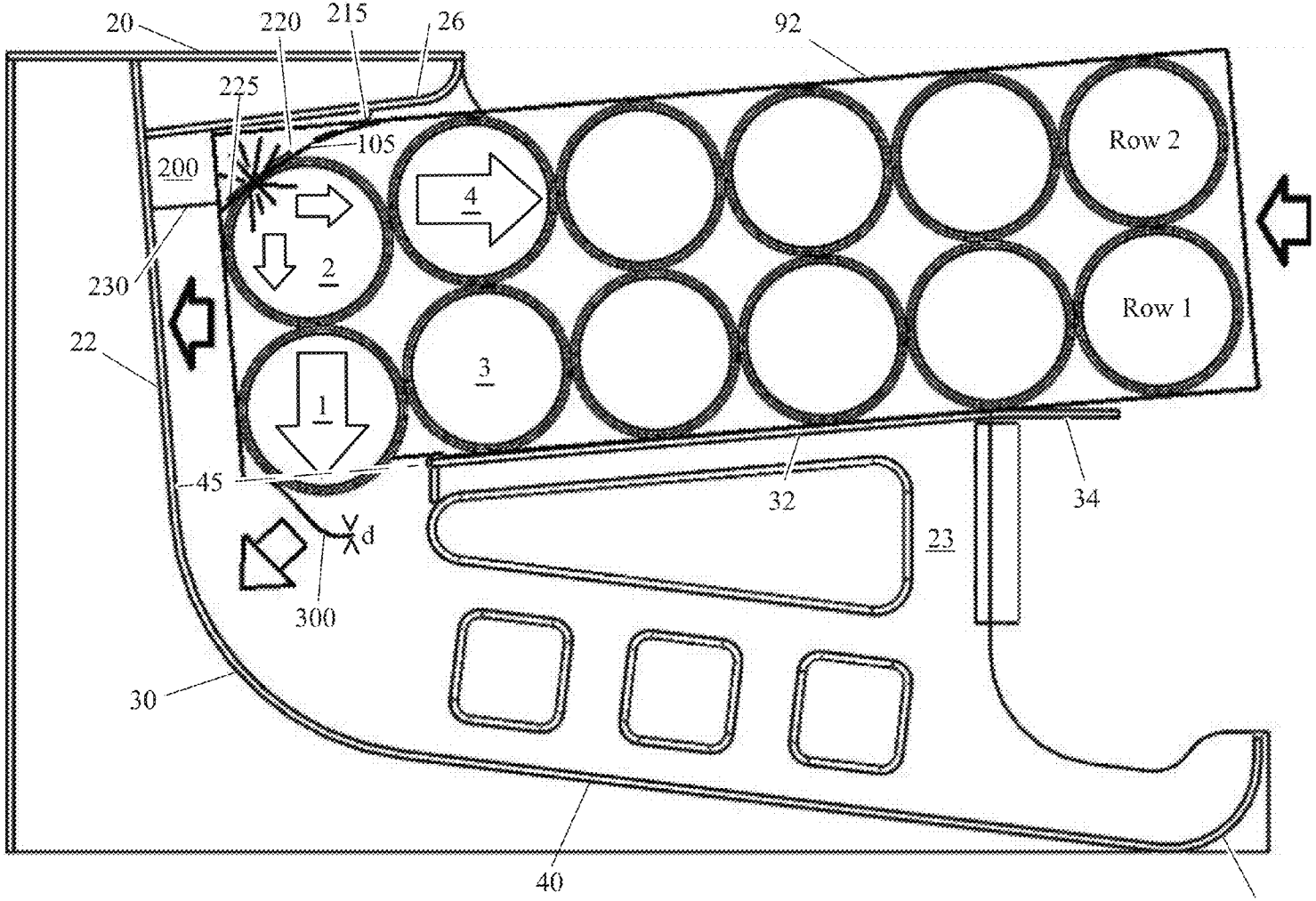
FIG. 27 shows an open side view of cartridge having a perforated slot and bridge being inserted into a dispenser with a cartridge opening wedge and the opening wedge and bridge forcing cans in the cartridge to open the cartridge retaining flap.
Figure 28:
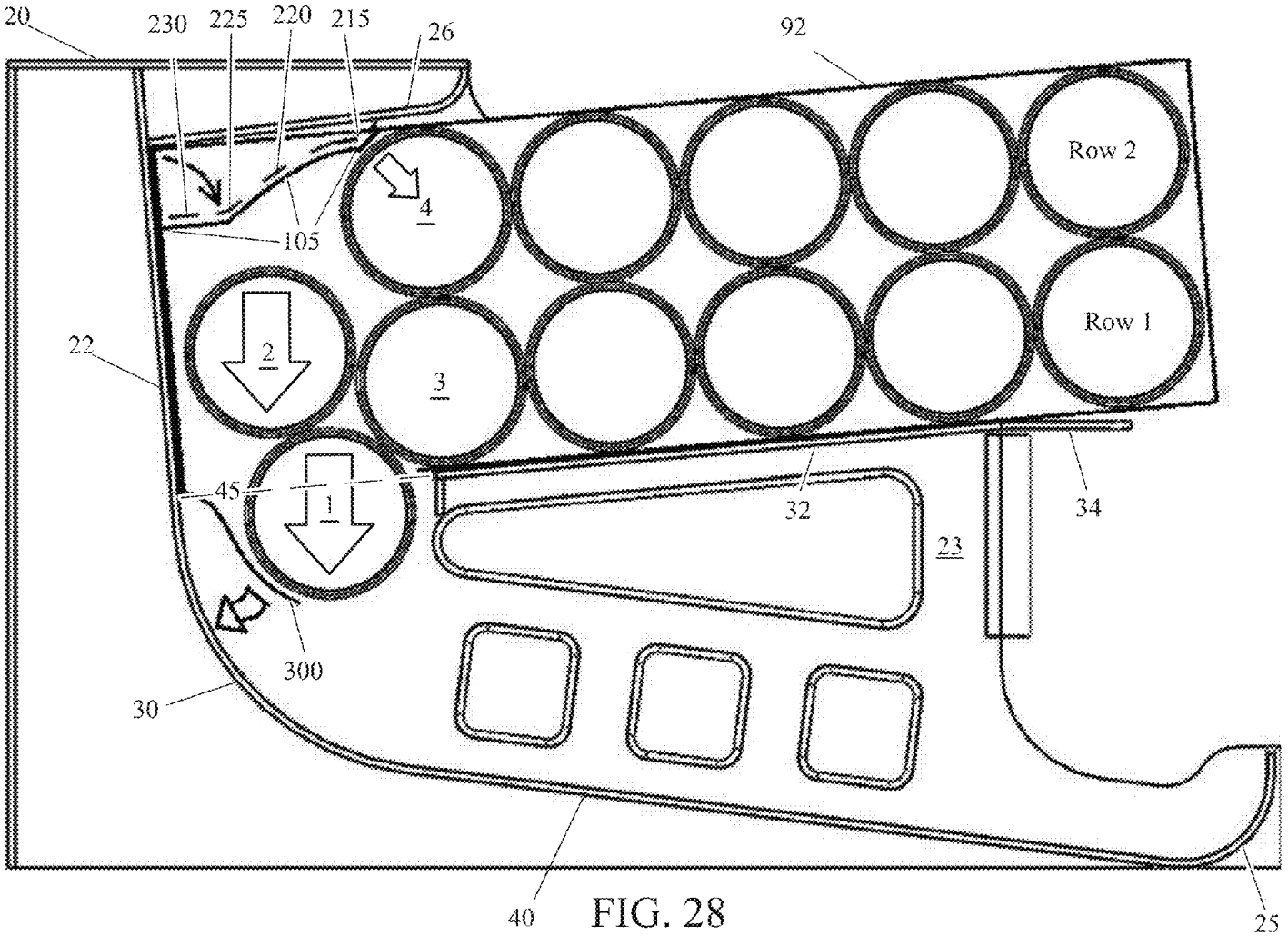
FIG. 28 shows an open side view of cartridge having a perforated slot and bridge after being inserted into a dispenser with a cartridge opening wedge, an open retaining flap continuing to be forced open, and cans beginning to feed into the dispenser.

As shown in FIGS. 24-26, the wedge 200 front-most arcuate section 215 preferably extends downward toward the entry port 45 so that it contacts the upper rear edge of the cartridge 92, 94 as the cartridge 92, 94 is pushed into the dispenser 20. When the cartridge 92, 94 is inserted into the dispenser 20 sufficiently far to reach the wedge 200, as shown in FIG. 25, the front-most arcuate section 215 contacts the upper rear edge of the cartridge 92, 94 and pushes a die cut bridge 105 (including 150*a*, 150*b*, 150*c*, 150*d*, 160*a* and 160*b* shown in FIG. 42 to FIG. 49, inward and downward into the cartridge 92, 94. As shown in FIGS. 26-28, as the cartridge 92, 94 moves further into the dispenser 20, the die cut bridge 105 (including 150*a*, 150*b*, 150*c*, 150*d*), being trapped between the wedge 200 and can 2, begins sliding along, and conforming to, the shape of the central arcuate section 220 of the wedge 200. As the cartridge 92, 94 is pushed further into the dispenser 20, as shown in FIG. 27, the wedge 200 translates the lateral rearward motion of the cartridge 92, 94 into a downward force and motion upon the cans 1, 2 contained in lower row 1 and upper row 2 of the cartridge 92, 94.

The overall front to rear length of the wedge 200 should be sufficient to contact, and apply downward pressure on, the cartridge 92, 94 (see FIG. 25) and against can 2 (see FIGS. 26-27), so that can 2 and can 1 force open a retaining flap 300 below can 1 (see FIGS. 27-29) as cans 2 and 1 are pushed down by the wedge 200. The wedge 200 is preferably short enough (see FIG. 28) that the front-most arcuate section 215 does not forcibly contact can 4 when the cartridge 92, 94 is completely inserted in the dispenser 20, as it would dent can 4 during forcible cartridge 92, 94 insertion and possibly render can 4 unsalable. Similarly, if the wedge 200 front-most arcuate section 215 extends too far downward into the dispenser 20, can 4 may also be dented.

If the wedge 200 is too short, or does not extend downwardly into the dispenser 20 far enough, the wedging action as the cartridge 92, 94 is inserted into the dispenser 20 can fail. If the wedge 200 does not extend far enough downwardly into the dispenser 20, the wedge 200 may not create sufficient downward force on can 2 and can 1 to force the perforated retaining flap 300 (see FIGS. 27-29) completely open. If the wedge 200 is too short, it will not extend far enough forward toward can 4 when the cartridge 92, 94 is fully inserted in the dispenser to cause the deflected die cut bridge 105 (including 150*a*, 150*b*, 150*c*, 150*d*) to impede movement of can 4, as shown in FIGS. 27-31, so that can 3 exits the cartridge 92, 94 before can 4.

The wedge 200 is preferably sufficiently wide to perform two functions. It should be thick enough to be both structurally stable and durable, as many cartridge 92, 94 insertions will occur during the dispenser 20 useful life cycle. It is also preferably sufficiently thick to distribute forces acting upon can 2 over a large enough surface area to prevent can 2 from being dented during forceful insertion of the cartridge 92, 94 into the dispenser 20. If the wedge 200 is too narrow, can 2 will regularly be dented during insertion, possibly rendering that can 2 unsalable. However, the wedge 200 is preferably narrow enough so that the matching die cut slot 105 (including 150*a*, 150*b*, 150*c*, 150*d*, see FIG. 42) in the cartridge 92, 94 will not be so wide as to render the cartridge 92, 94 structurally unsound during shipment.

Figure 3:
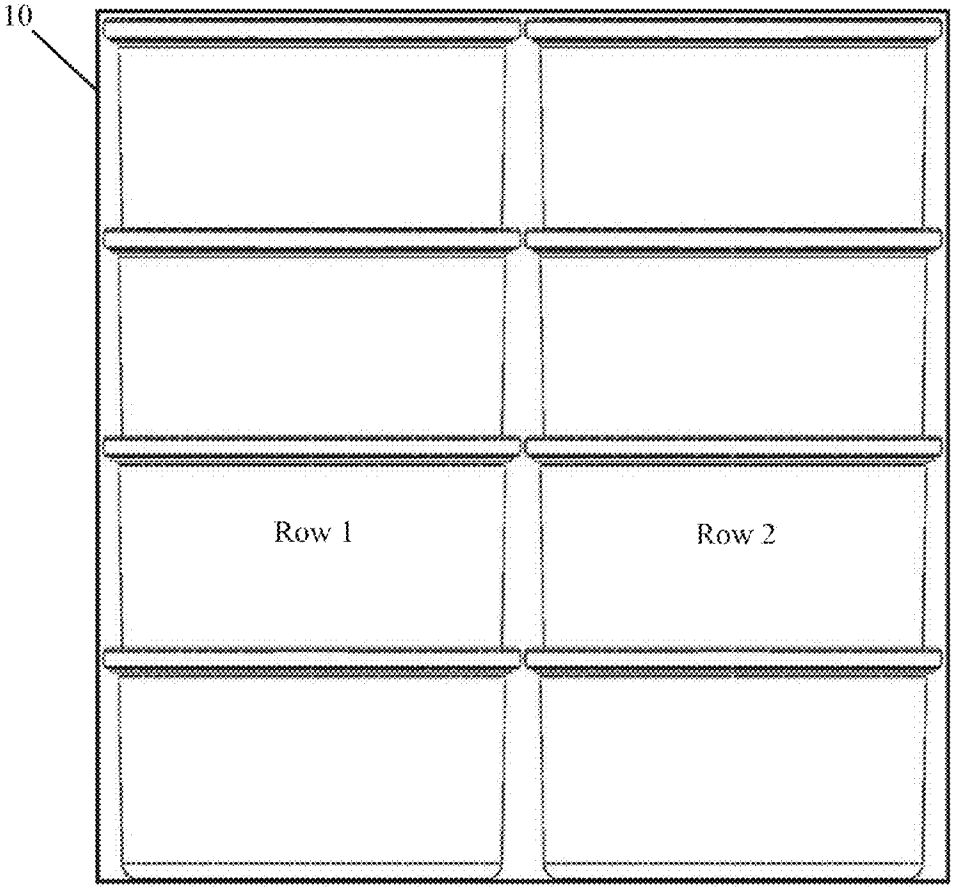
FIG. 3 PRIOR ART
FIG. 3 shows an open side view of a prior art stacked and nested double row product cartridge.
Figure 4:
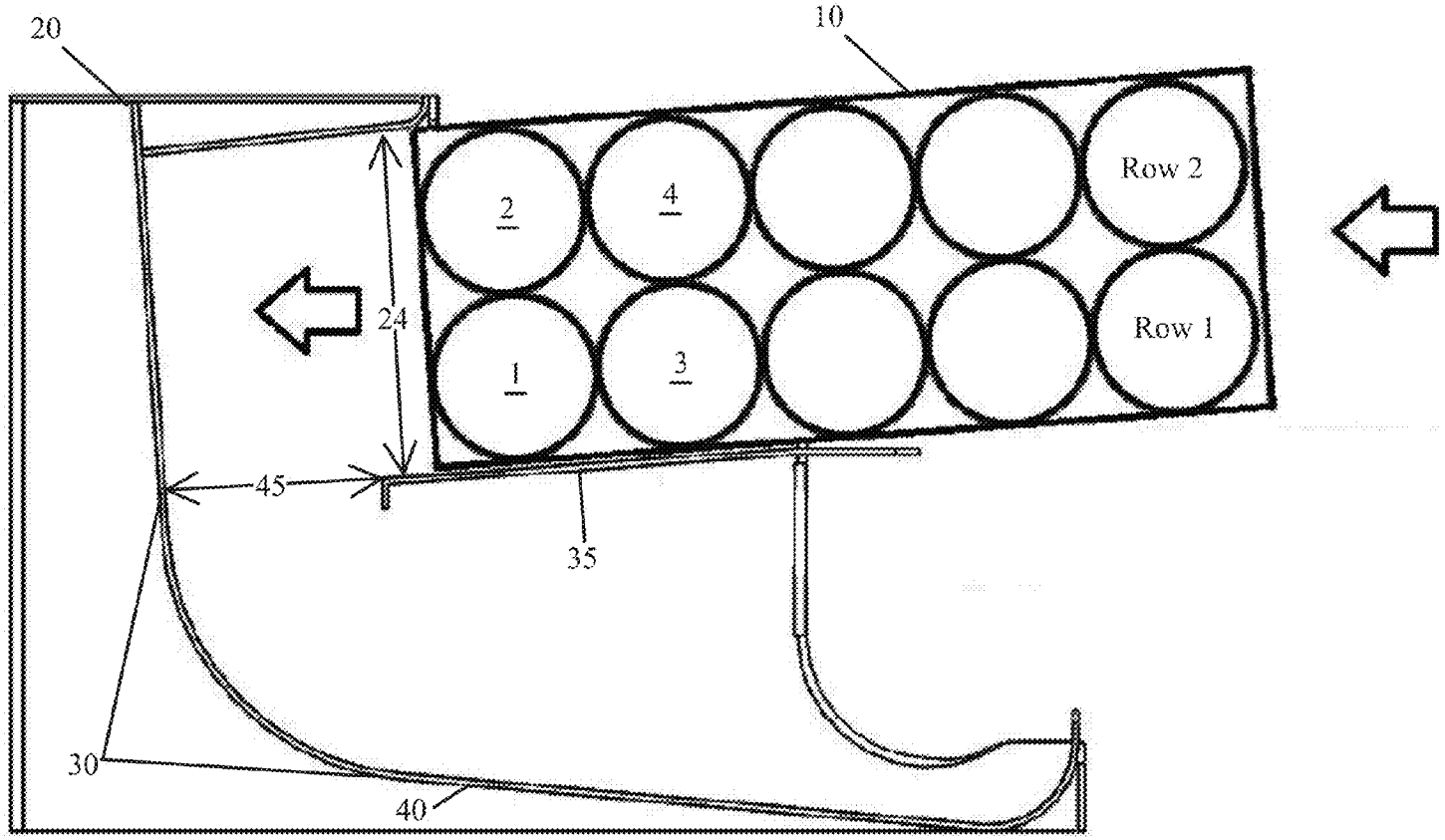
FIG. 4 PRIOR ART
FIG. 4 shows an open side view of a prior art double row product cartridge partially inserted in a prior art product dispenser.
Figure 5:
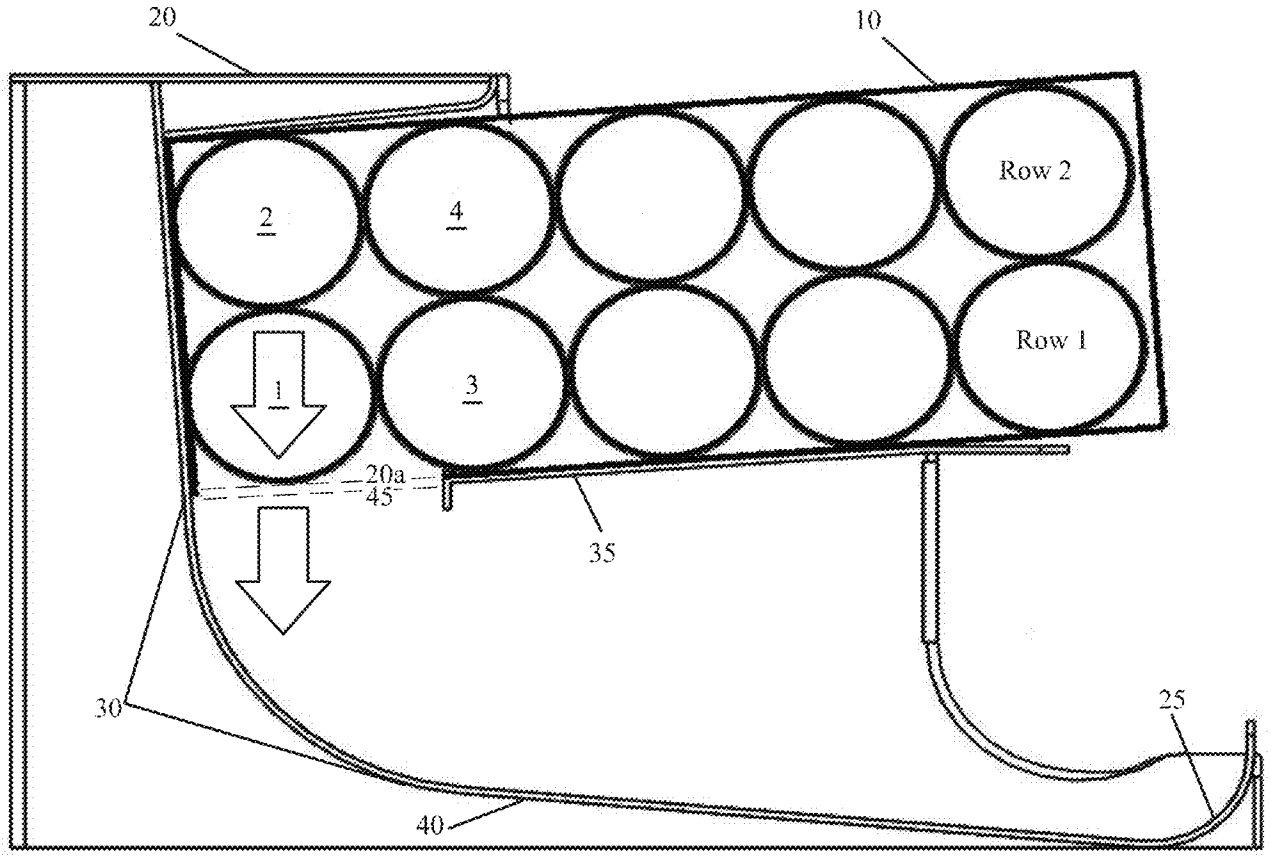
FIG. 5 PRIOR ART
FIG. 5 shows an open side view of a prior art double row product cartridge in a prior art dispenser with a down chute prior to cans exiting from the cartridge.
Figure 6:
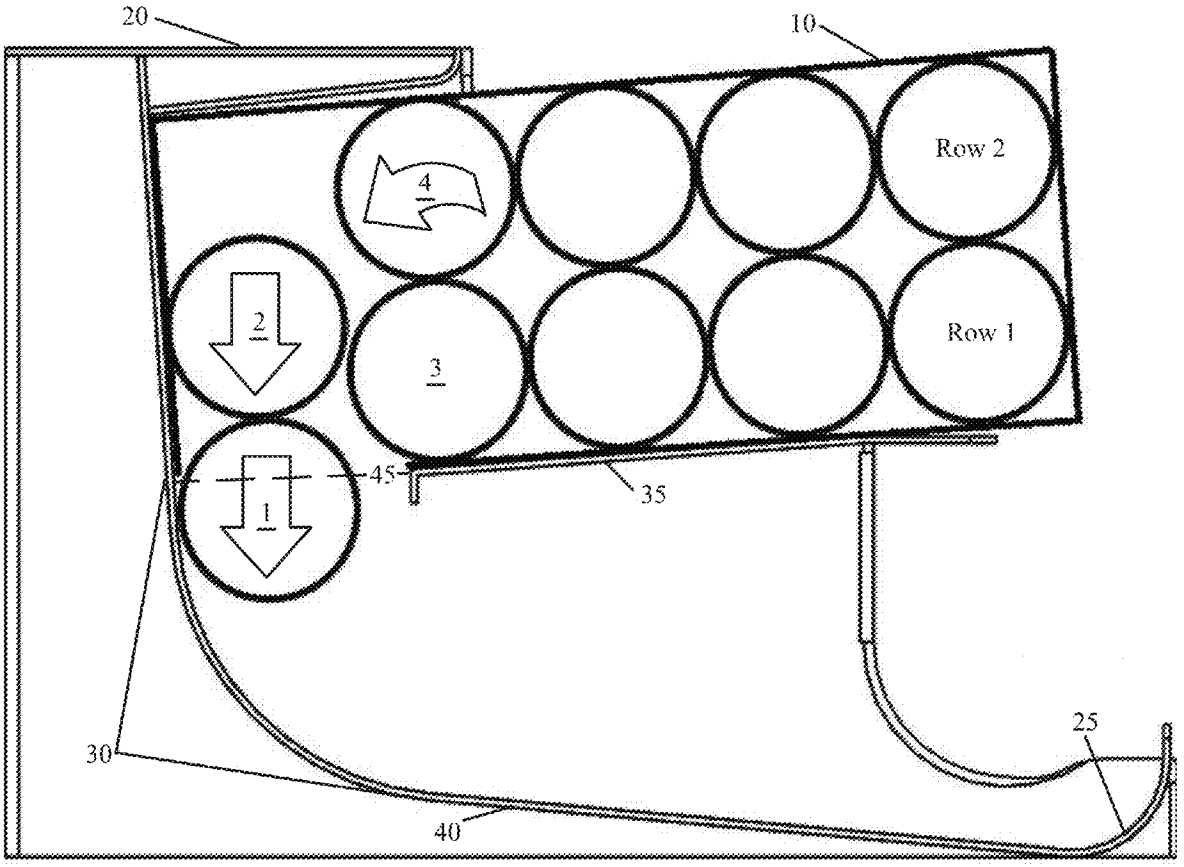
FIG. 6 PRIOR ART
FIG. 6 shows an open side view of a prior art double row product cartridge at the start of a typical dispensing sequence, with the first cans in each row of product moving toward the prior art dispenser down chute.
Figure 7:
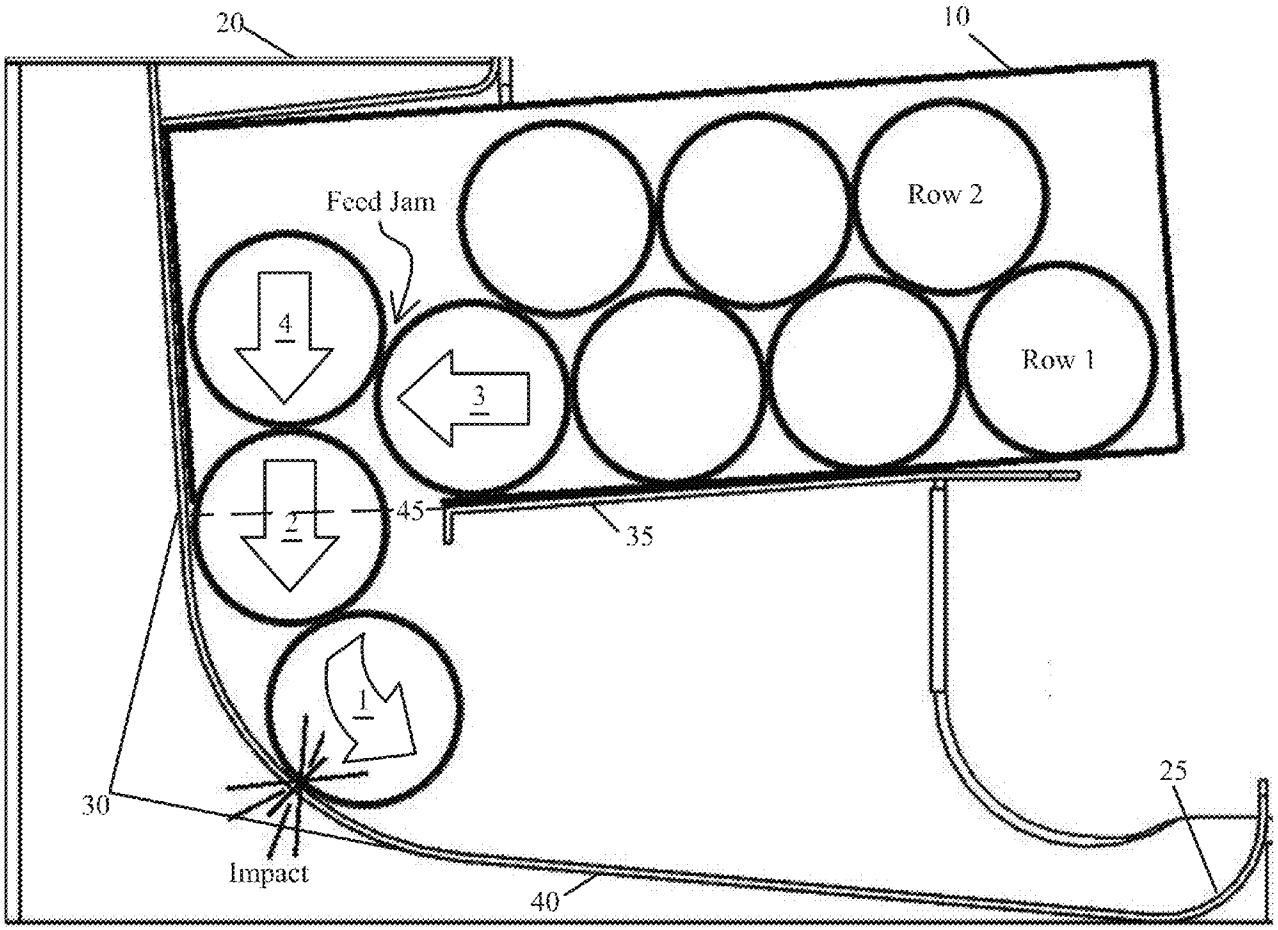
FIG. 7 PRIOR ART
FIG. 7 shows an open side view of a prior art double row product cartridge after the first cans in each row of product have entered the prior art dispenser down chute, and the second can of the second row has started to move toward the down chute.
Figure 8:
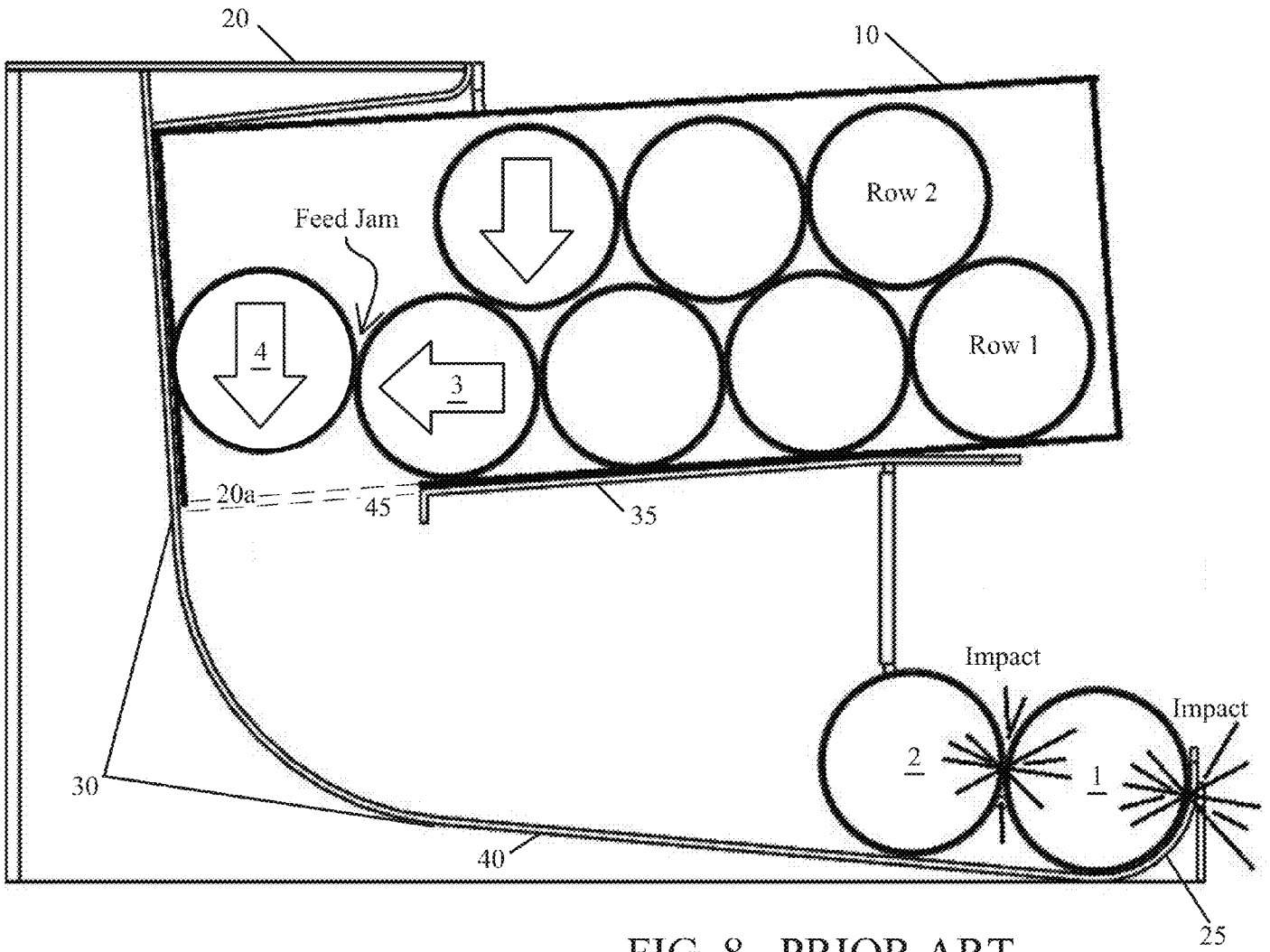
FIG. 8 PRIOR ART
FIG. 8 shows an open side view of a prior art double row product cartridge in which the second can of the second row of product contained in the cartridge has encountered a feed jam inside the cartridge.
Figure 9:
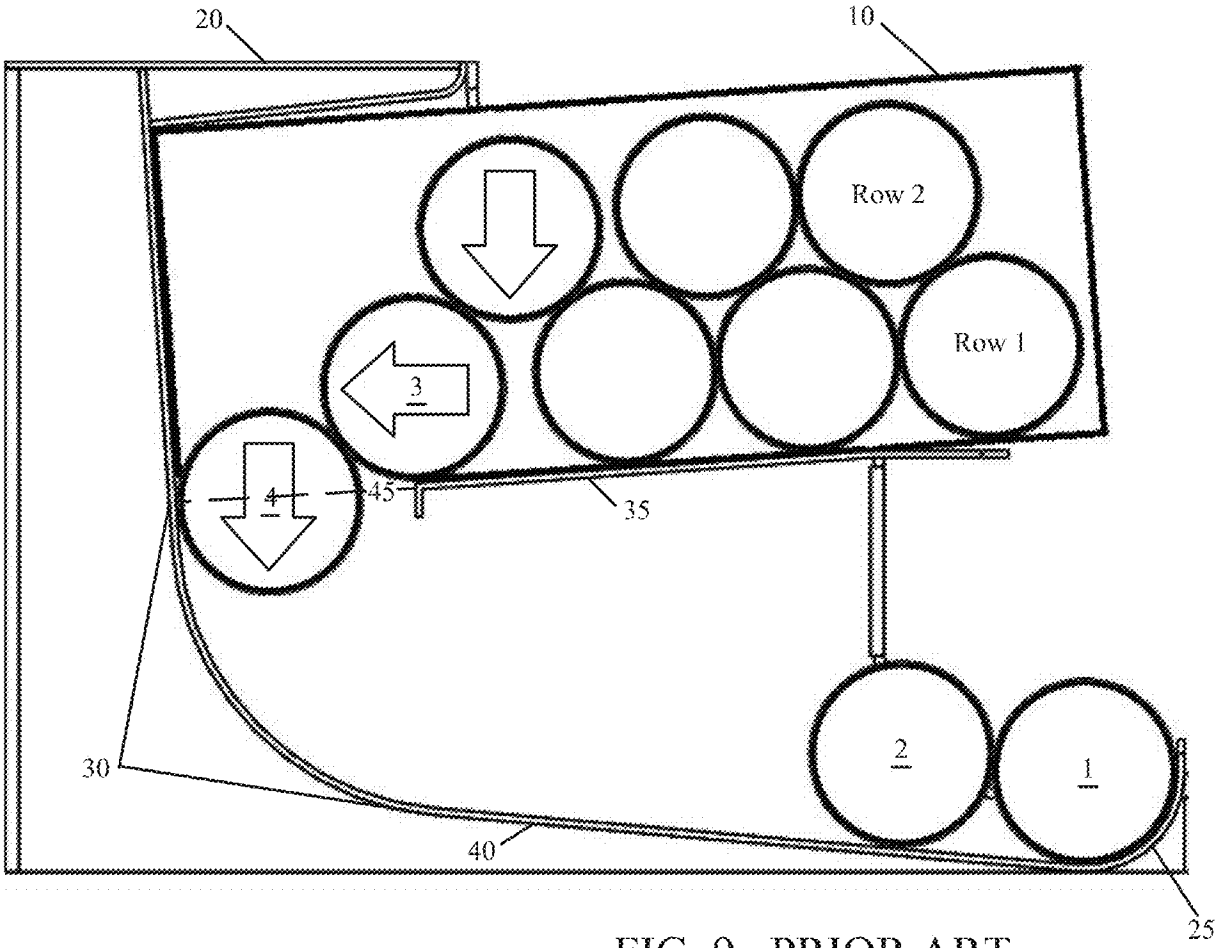
FIG. 9 PRIOR ART
FIG. 9 shows an open side view of a prior art double row product cartridge in which the feed jam inside the cartridge has been cleared and the second can in the second row of product in the cartridge has moved into the prior art dispenser down chute.
Figure 10:
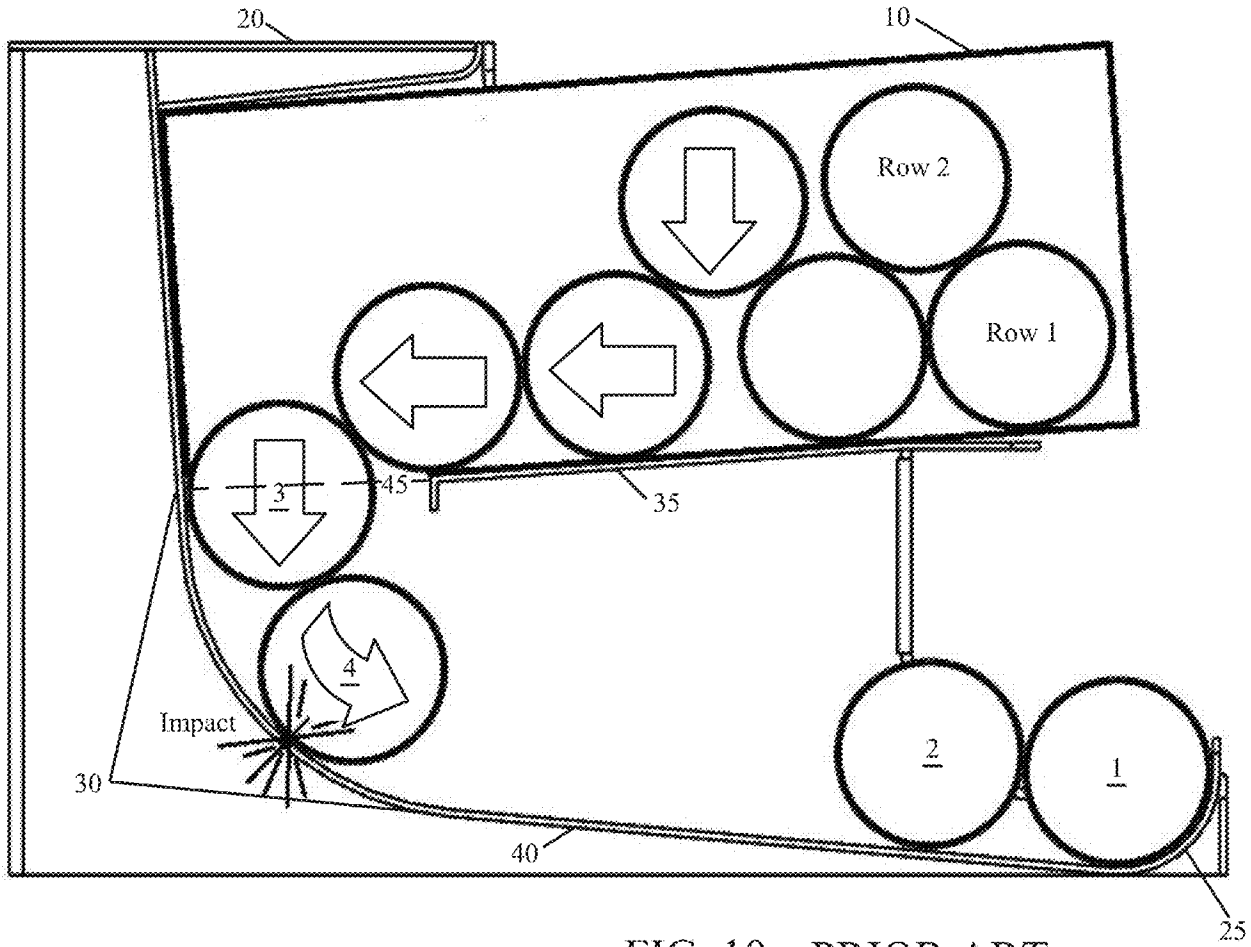
FIG. 10 PRIOR ART
FIG. 10 shows an open side view of a prior art double row product cartridge in which the feed jam inside the cartridge has been cleared and the second can and third can in the first row of product in the cartridge are free to feed normally into the prior art dispenser down chute.
Figure 11:
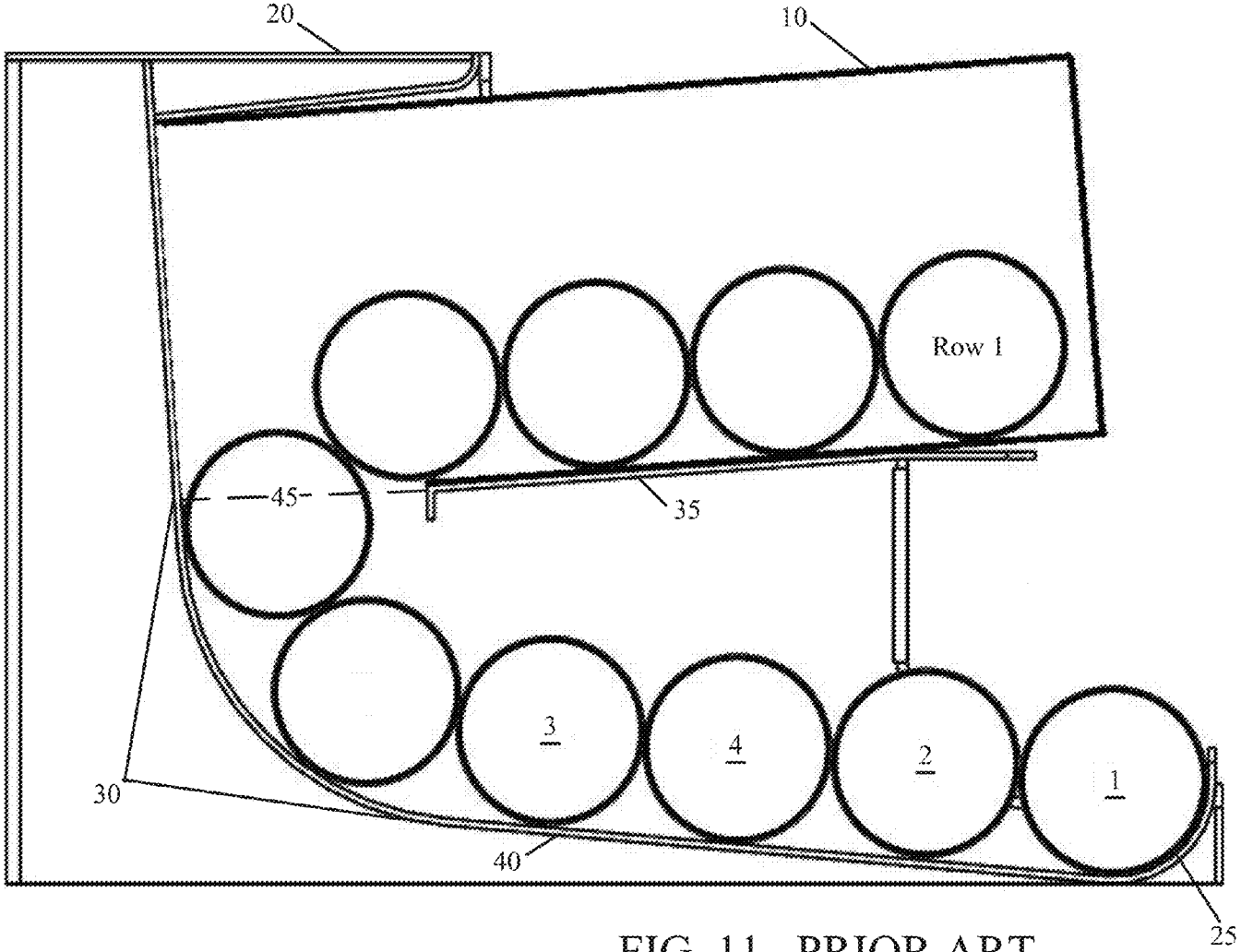
FIG. 11 PRIOR ART
FIG. 11 shows an open side view of a prior art double row product cartridge in which the lower feed ramp of the prior art dispenser has been filled with cans, and the cans remaining in the cartridge are free to feed normally.
Figure 12:
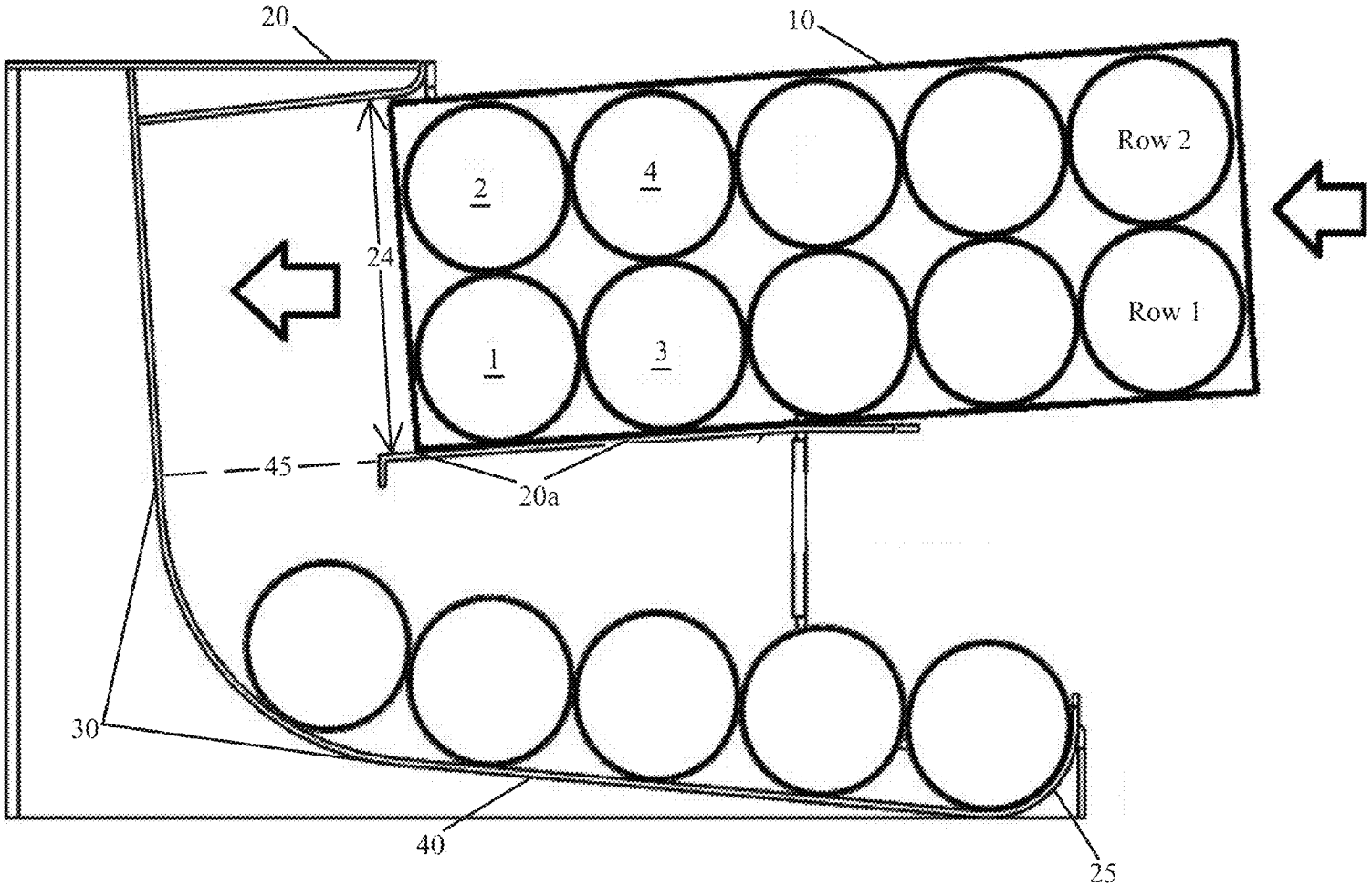
FIG. 12 PRIOR ART
FIG. 12 shows an open side view of a full prior art double row product cartridge partially inserted into a prior art dispenser that remains partially full.
Figure 13:
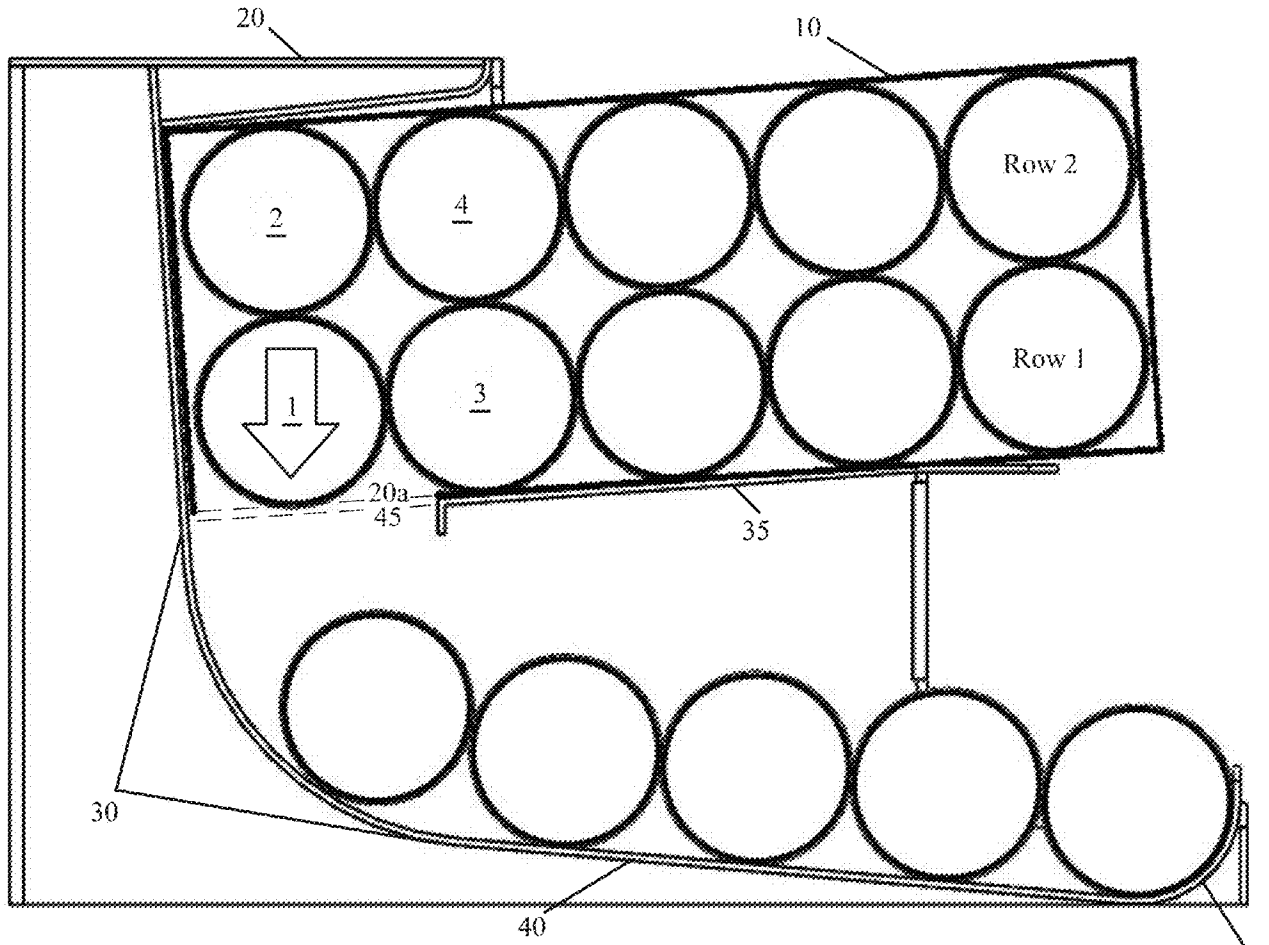
FIG. 13 PRIOR ART
FIG. 13 shows an open side view of a prior art double row product cartridge in a prior art dispenser with a down chute and a lower feed ramp partially full of cans prior to cans exiting from the cartridge.
Figure 14:
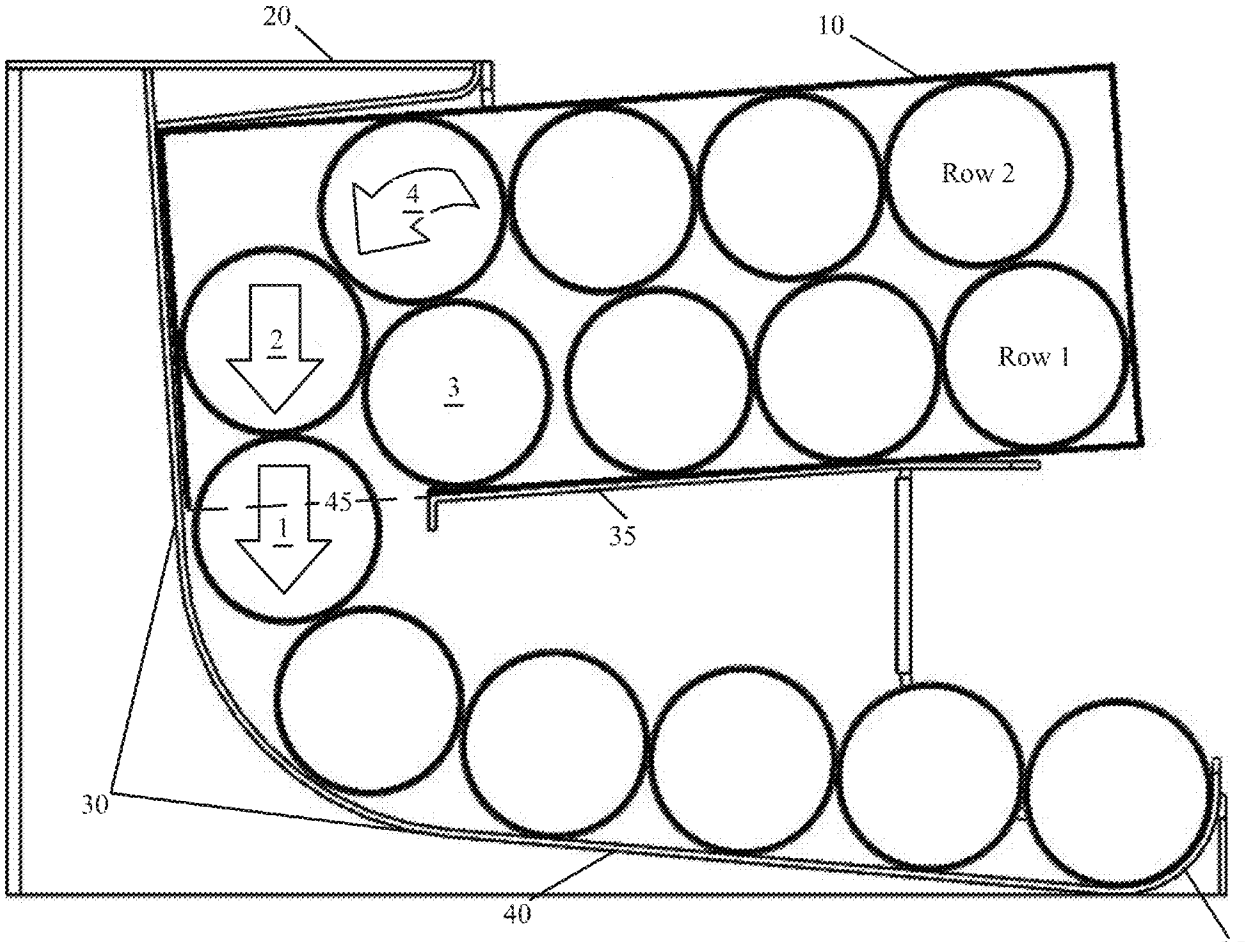
FIG. 14 PRIOR ART
FIG. 14 shows an open side view of a prior art double row product cartridge and partially full prior art dispenser, while the first cans in the first and second rows of product in the cartridge move toward and into the down chute.
Figure 15:
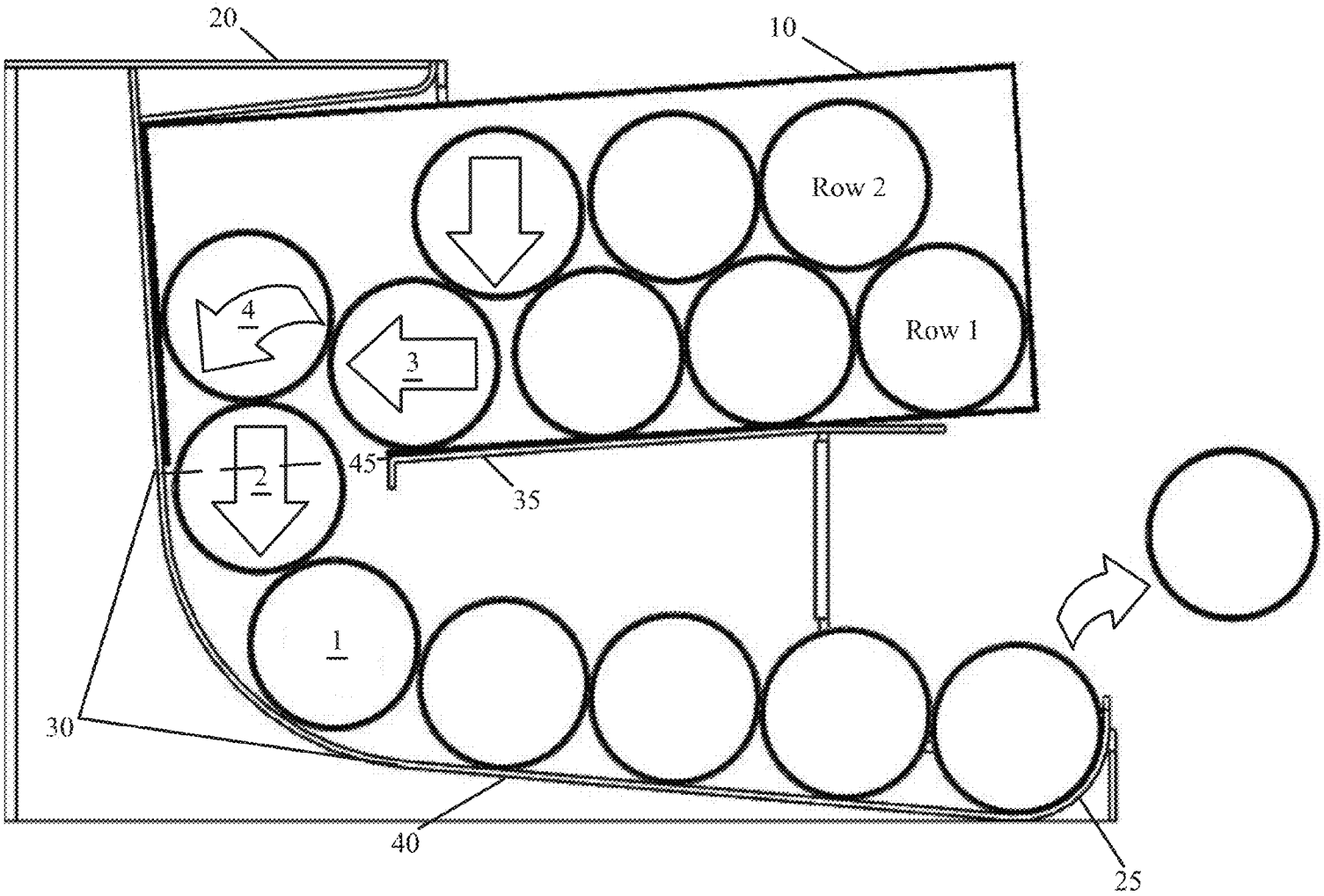
FIG. 15 PRIOR ART
FIG. 15 shows an open side view of a prior art double row product cartridge and partially full dispenser and the motion of cans in the cartridge when a can is removed from the product selection area of the prior art dispenser.
Figure 16:
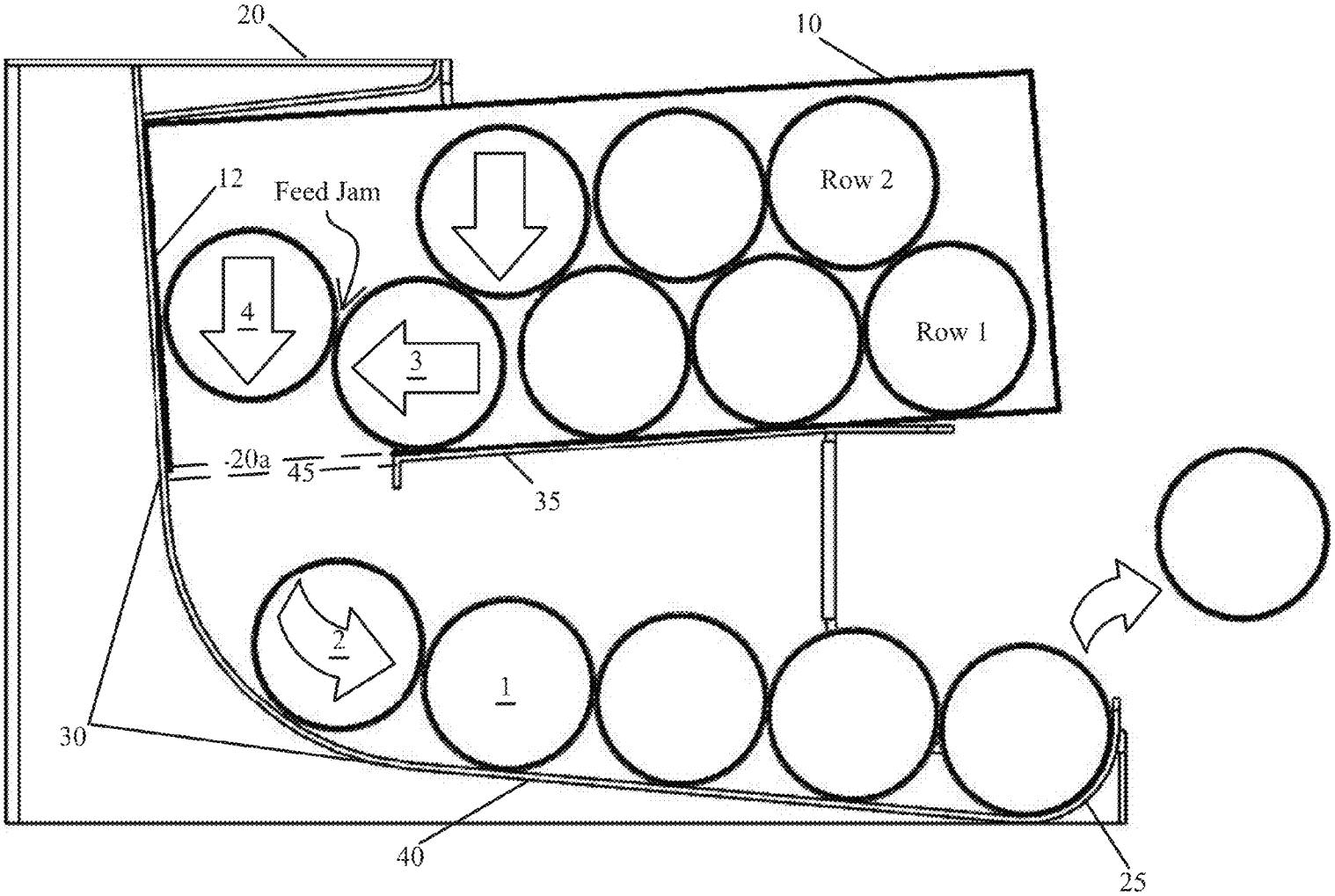
FIG. 16 PRIOR ART
FIG. 16 shows an open side view of a prior art double row product cartridge in which the second can of the second row of product contained in the cartridge has encountered a feed jam inside the cartridge.
Figure 17:
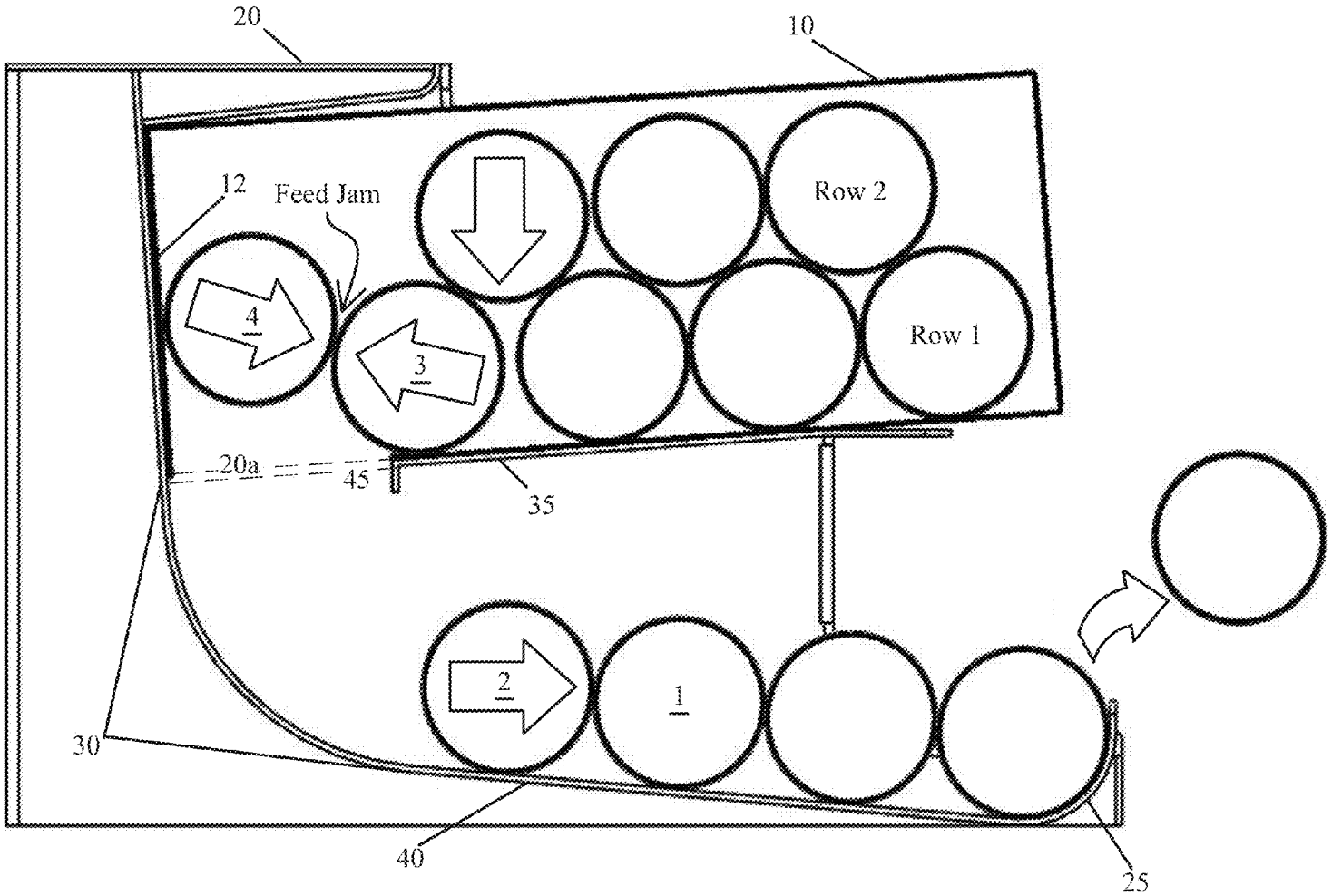
FIG. 17 PRIOR ART
FIG. 17 shows an open side view of a prior art double row product cartridge in which the feed jam remains inside the cartridge even as product is dispensed from a product selection area.
Figure 18:
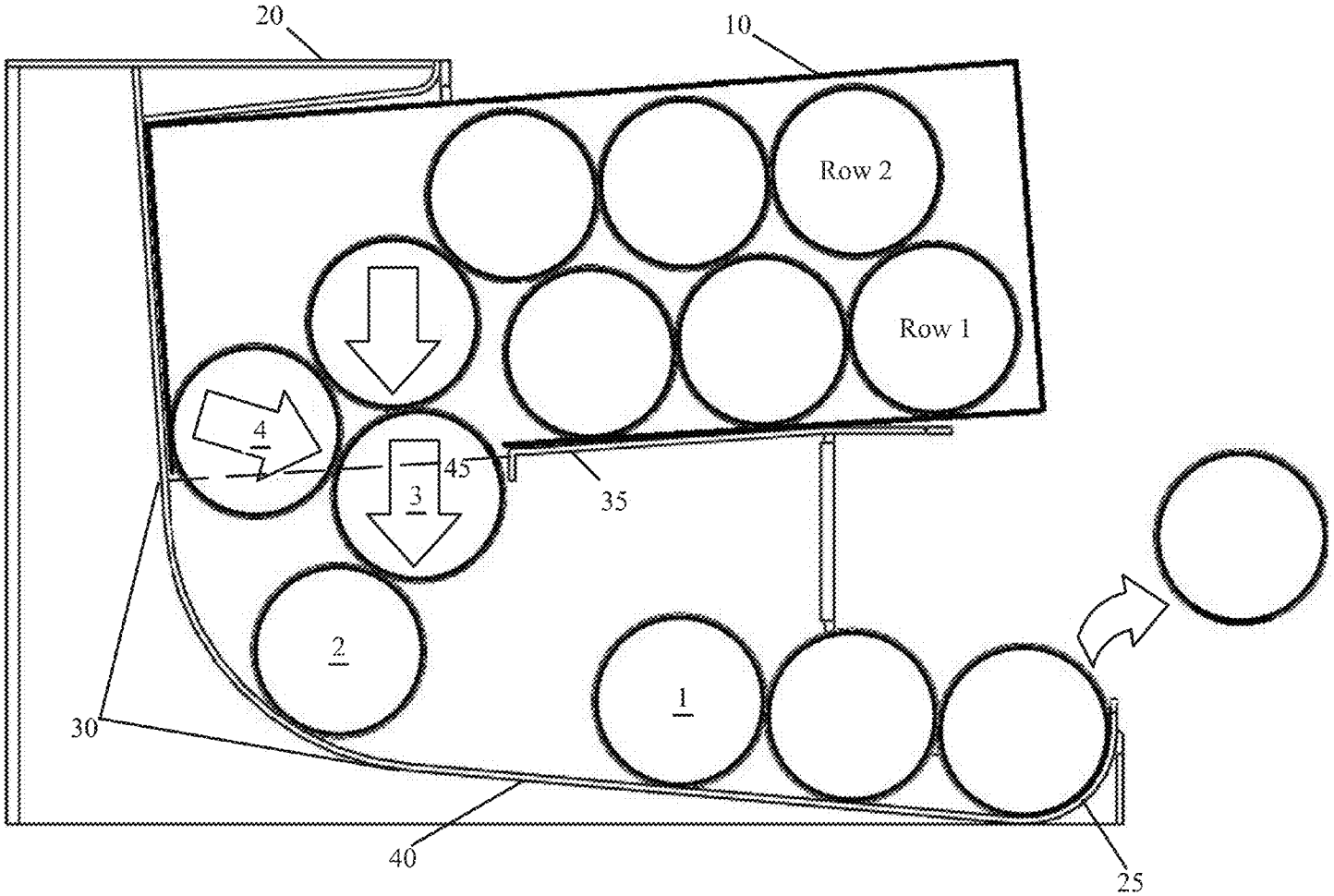
FIG. 18 PRIOR ART
FIG. 18 shows an open side view of a prior art double row product cartridge in which products cause a feed jam even when the size of the entry port and the down chute are increased.
Figure 52:
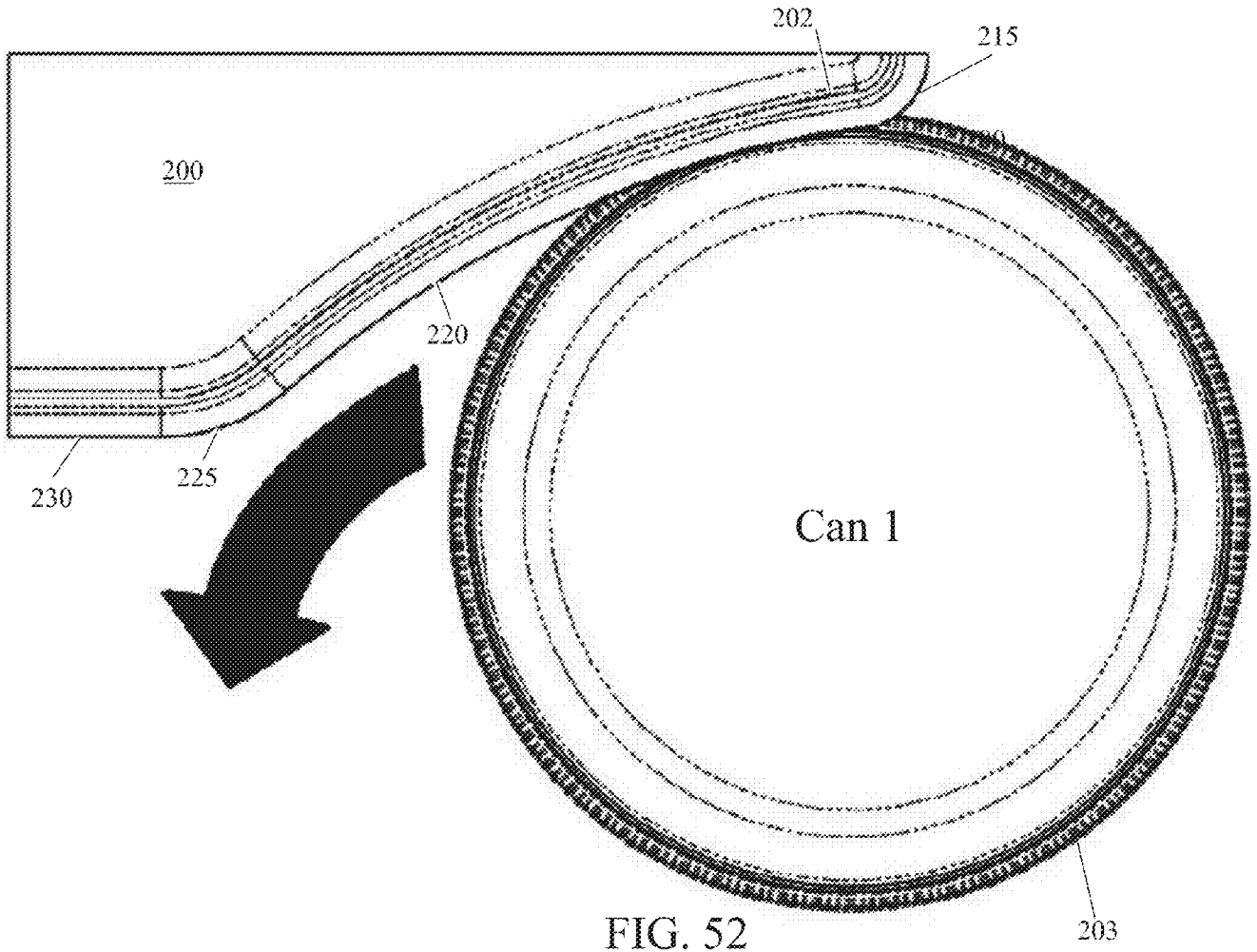
FIG. 52 shows a side view of an opening wedge having a channel for receiving circumferential surface features of a rolling product interacting with the rim of a can in a stack of nested cans.

In some embodiments, shown in FIGS. 50A-52, multiple cans may be present in a single row of cans within a cartridge. Prior art cans in the nested configuration described here are shown in prior art FIG. 3. For example, when cans are nested and the bottom of one can is formed to fit neatly within the rim 203 of the top of the can below it, two or more cans may be packed in each row of a cartridge. In these embodiments, for example, a single wedge 200 may only contact one can in the stack to un-nest and thereby cause a feed jam. It may therefore be advantageous to use two or more wedges in the dispenser, located so that they apply pressure to the rims 203 of the cans where they nest together. Thus, the entire stack of nested cans will be more uniformly forced downwardly and a feed jam may be avoided. A channel 202 may also be provided along a side 215, 220, 225, 230 of the wedge 200 to accept a can rim 203, or other circumferential surface features of cans in the cartridge, so that pressure is not applied only to the rim 203 of a can and more uniformly to the side of a can above the nesting rim 203 and the side of a can below the nesting rim. As shown in FIG. 52, the operation of a wedge 200 with a channel 202 is otherwise the same as the wedge 200 described herein, and a stack of nested cans will similarly be forced downwardly in unison.

Figure 29:
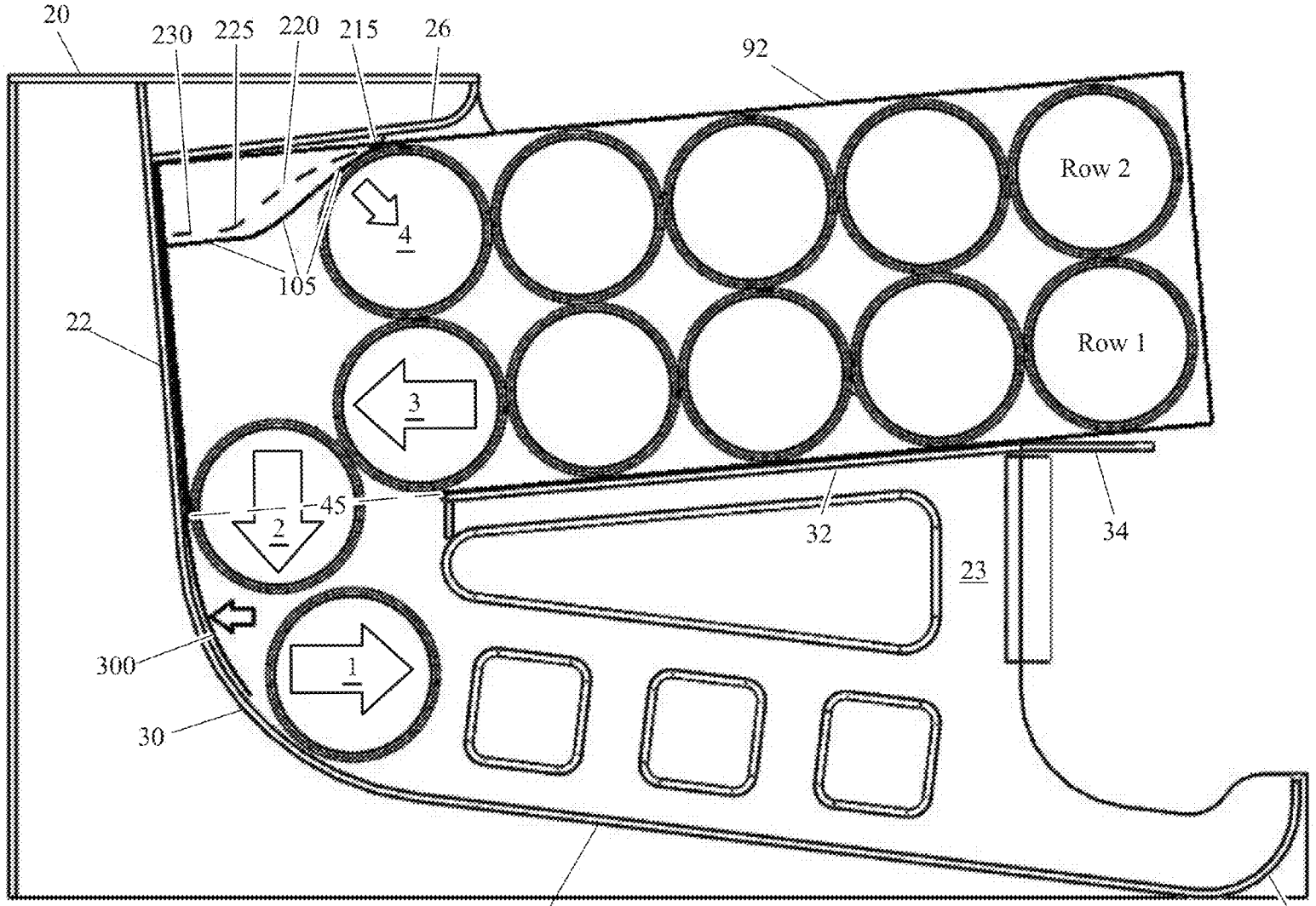
FIG. 29 shows an open side view of cartridge having a perforated slot and bridge after being fully inserted into a dispenser with a cartridge opening wedge, and the wedge and bridge impeding motion of a second can in an upper row in the cartridge until a first can in a first row of the cartridge has moved into a down chute and a first can in a second row of the cartridge have moved into the entry port.
Figure 30:
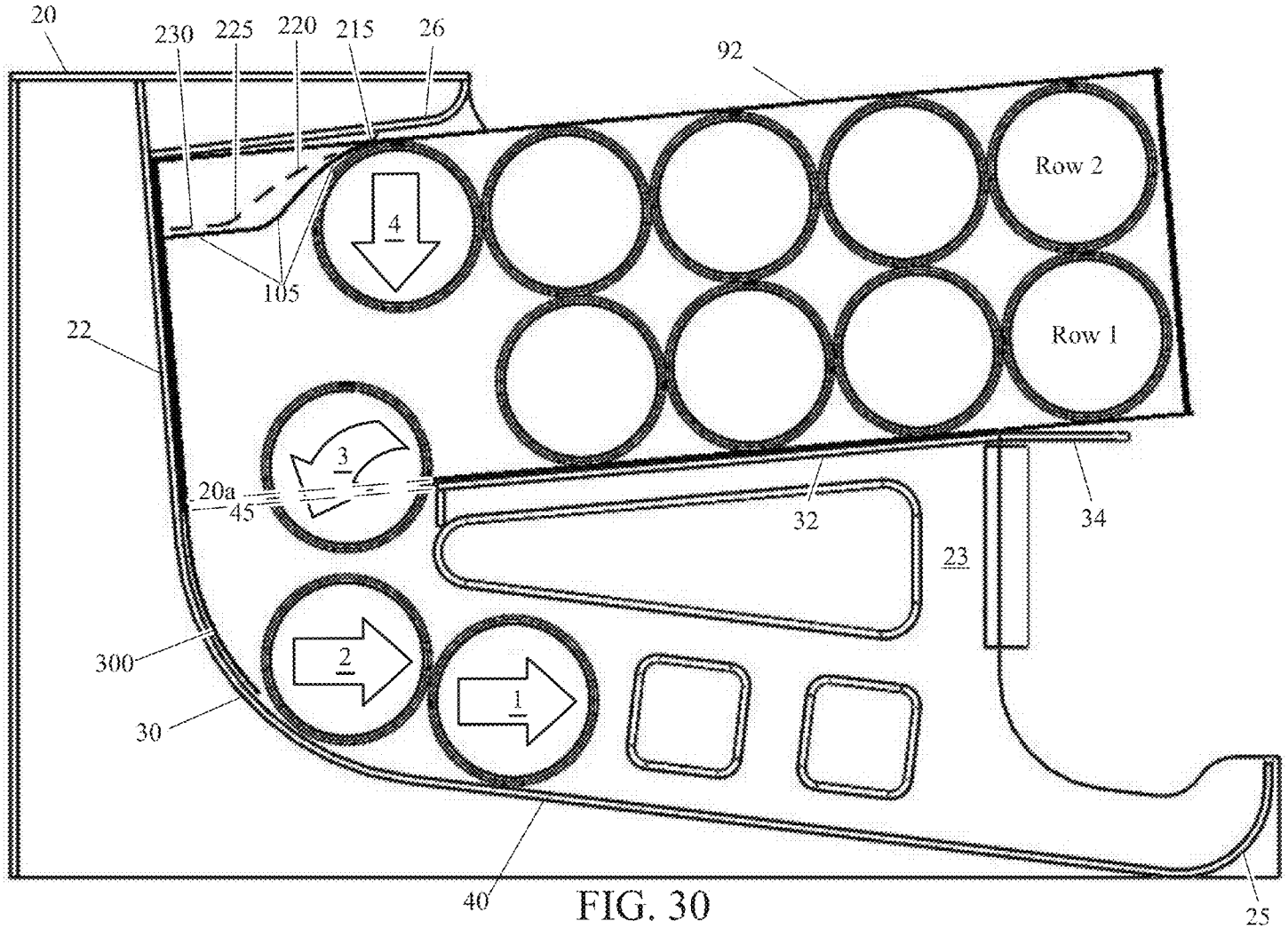
FIG. 30 shows an open side view of cartridge having a perforated slot and bridge after being inserted into a dispenser with a cartridge opening wedge and cans in a lower row of the cartridge exiting the cartridge.
Figure 31:
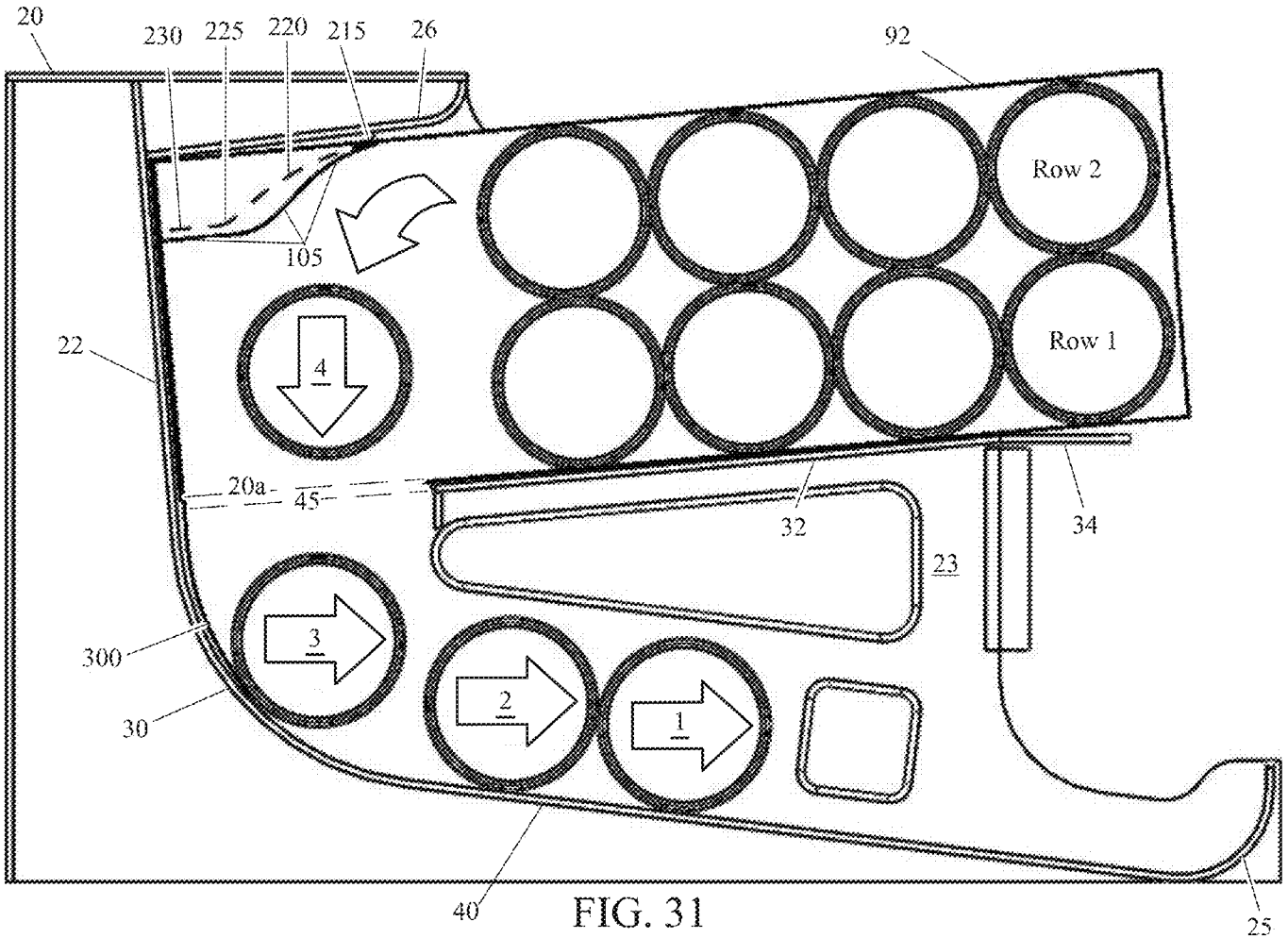
FIG. 31 shows an open side view of cartridge having a perforated slot and bridge after being inserted into a dispenser with a cartridge opening wedge and the first three cans in the cartridge have exited the cartridge.
Figure 32:
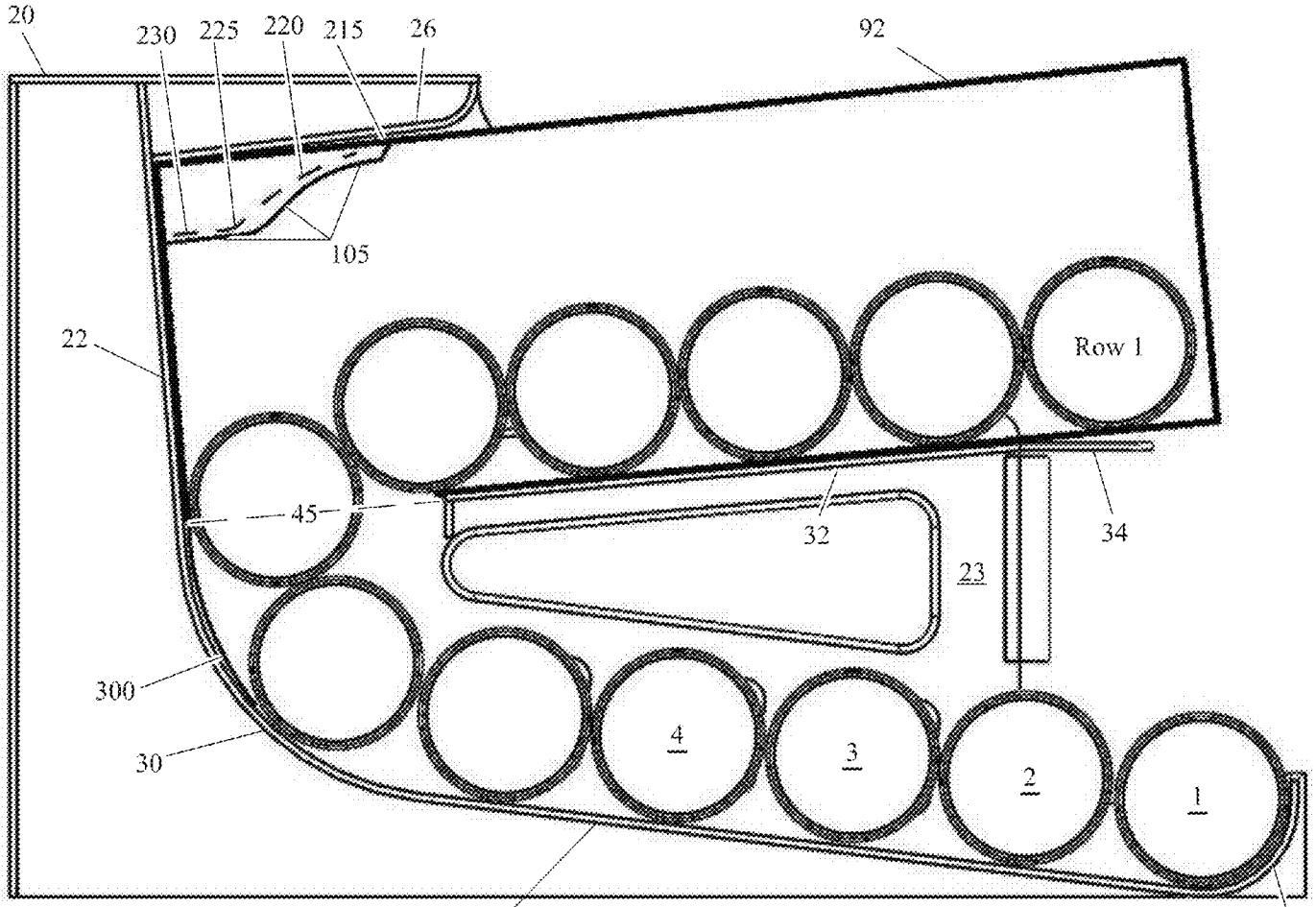
FIG. 32 shows an open side view of cartridge having a perforated slot and bridge after being inserted into a dispenser with a cartridge opening wedge and the dispenser lower feed ramp and product selection area have been filled.
Figure 33:
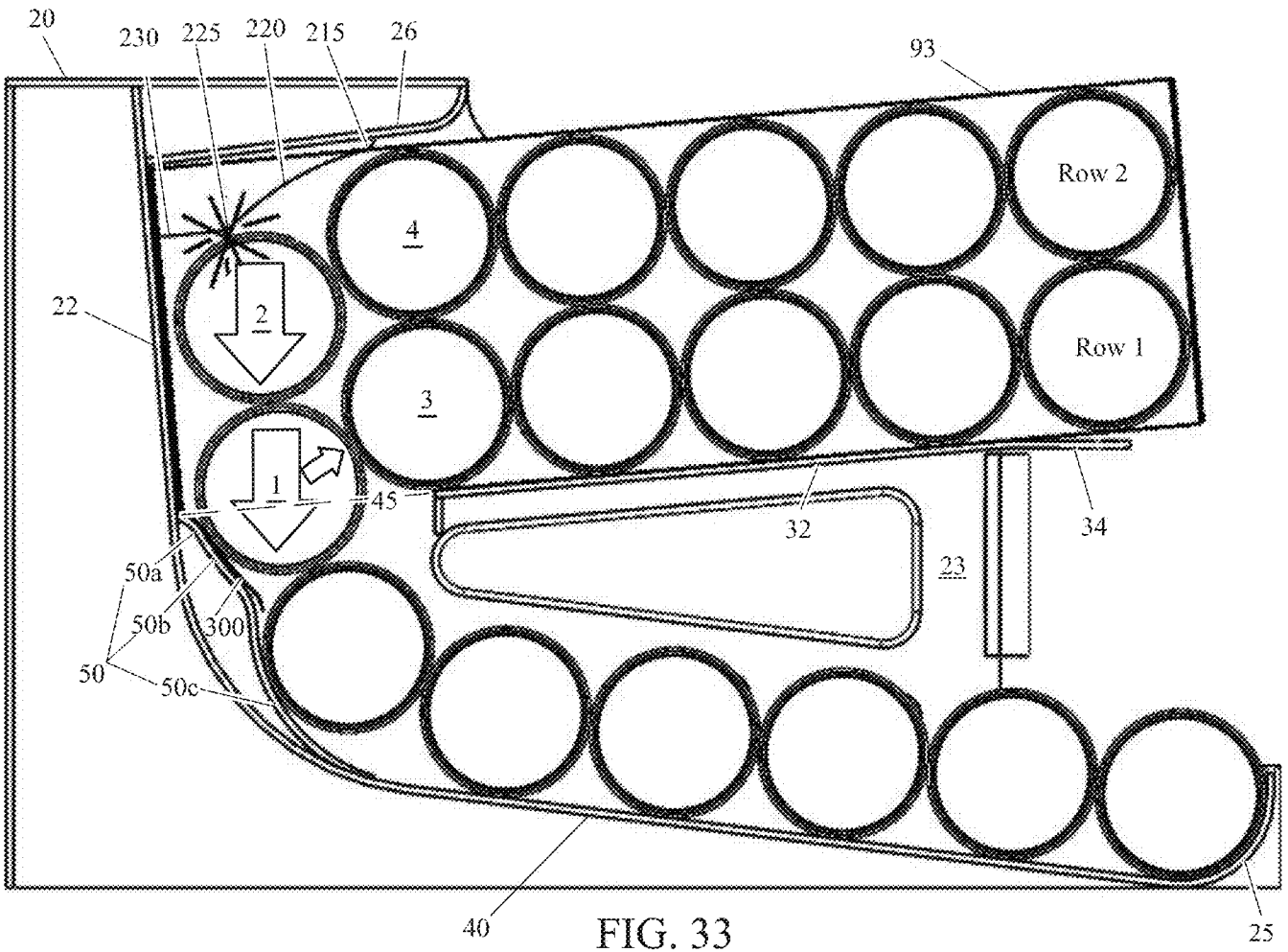
FIG. 33 shows an open side view of a cartridge having an always open or field openable slot that does not comprise a bridge after the cartridge has been inserted into a partially filled dispenser having a cartridge opening wedge and an S-shaped down ramp.
Figure 34:
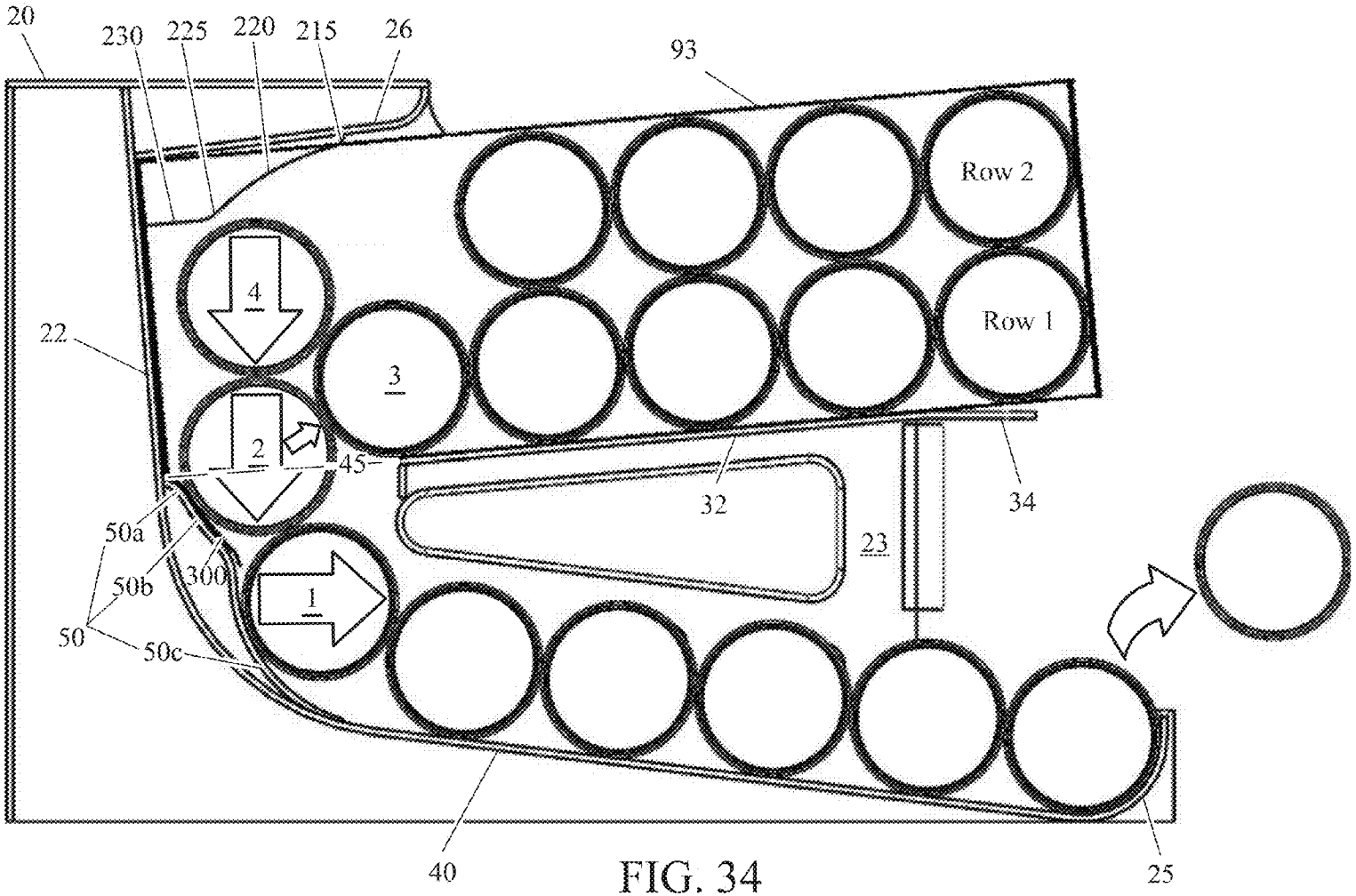
FIG. 34 shows the first two cans exiting a cartridge having an always open or field openable slot after the cartridge has been inserted into a partially filled dispenser having a cartridge opening wedge and an S-shaped down ramp.
Figure 35:
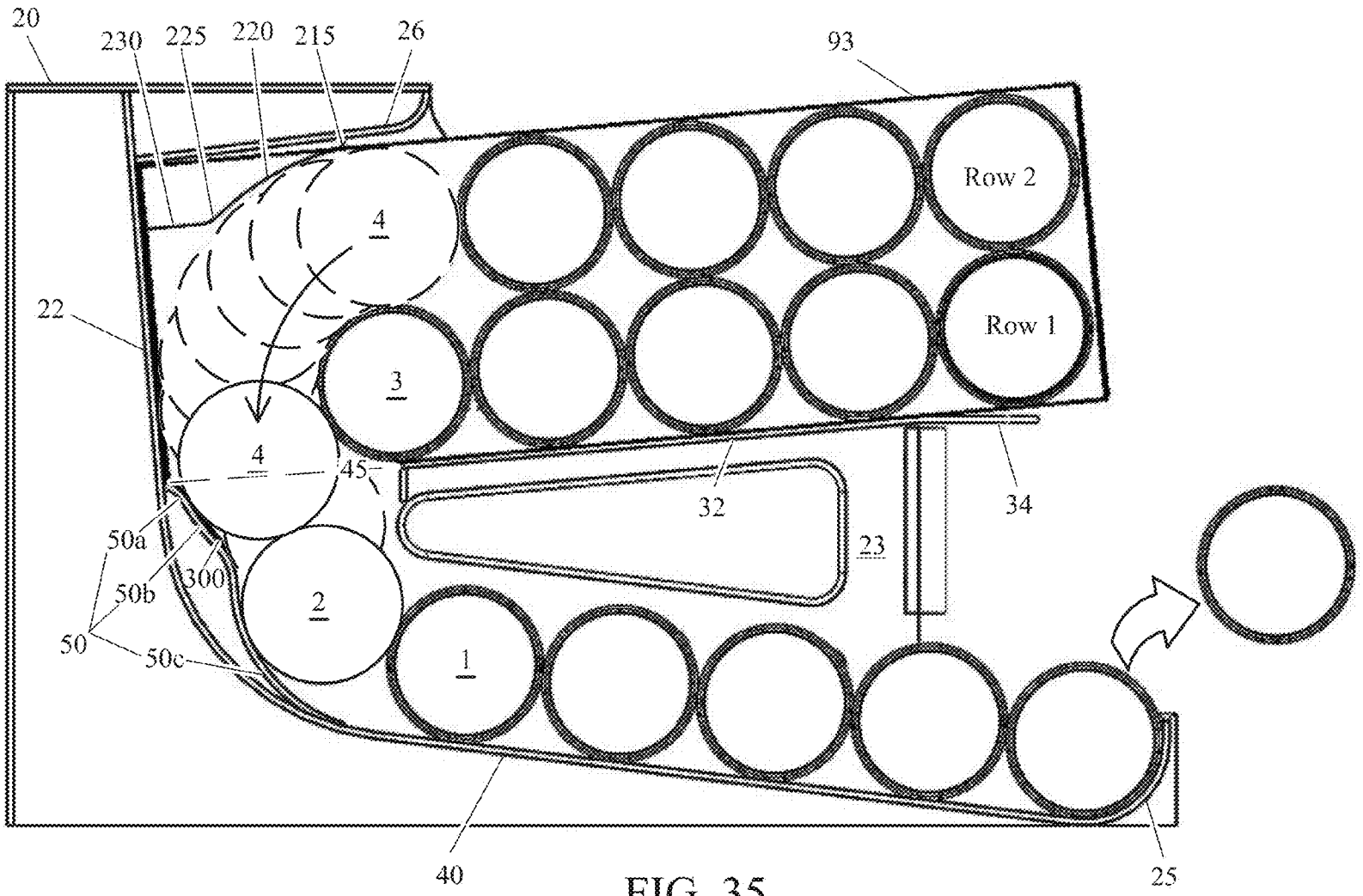
FIG. 35 shows a movement pathway of a second can in the second row of a cartridge having an always open or field openable slot exiting the cartridge after the cartridge has been inserted into a partially filled dispenser having a cartridge opening wedge and an S-shaped down ramp.
Figure 36:
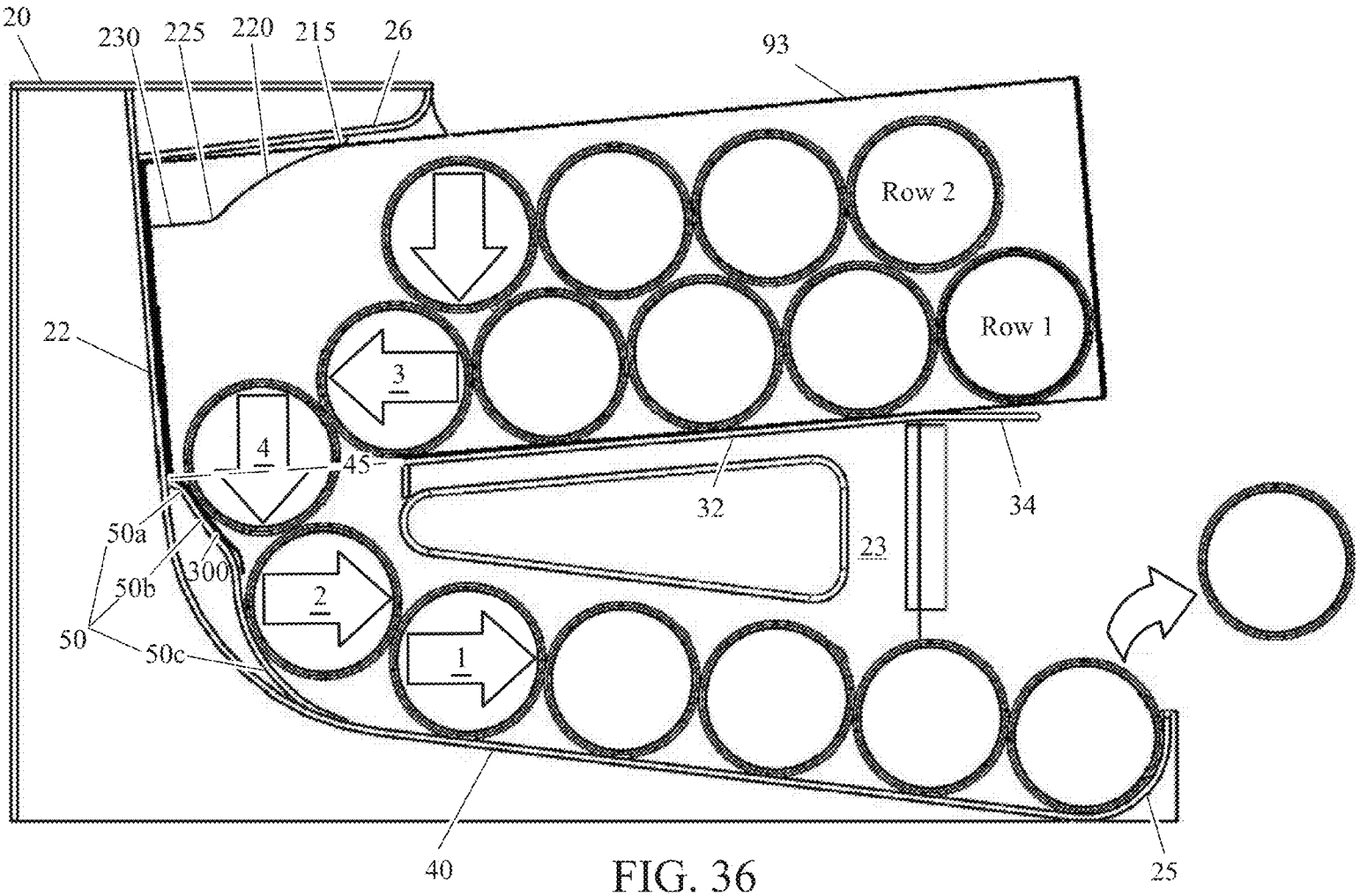
FIG. 36 shows an open side view of a cartridge having an always open or field openable slot after the cartridge has been inserted into a partially filled dispenser having a cartridge opening wedge and an S-shaped down ramp and the first three cans in the cartridge have exited the cartridge in the order shown.
Figure 37:
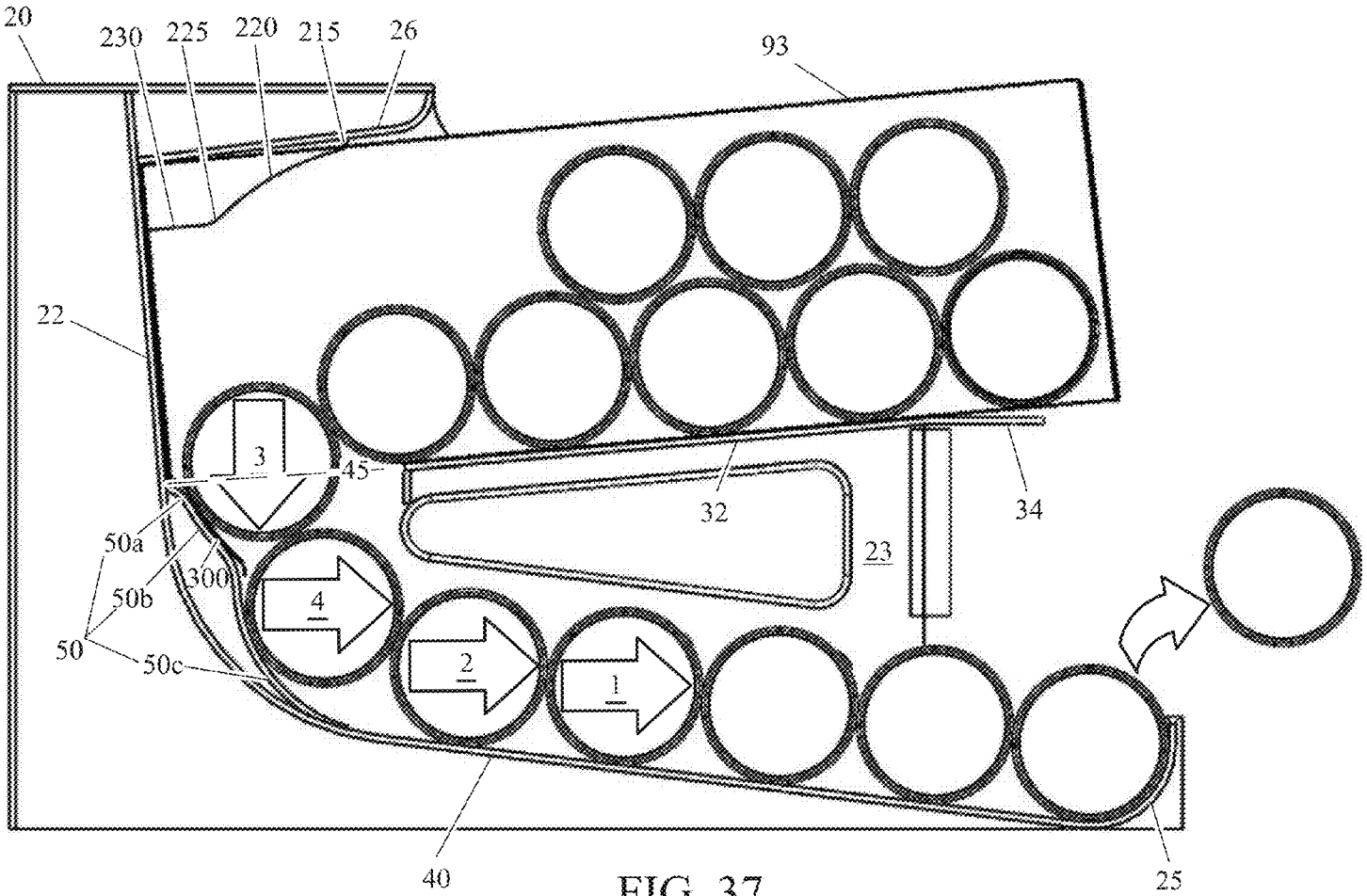
FIG. 37 shows a cartridge having an always open or field openable slot after it has been inserted into a partially filled dispenser having a cartridge opening wedge and an S-shaped down ramp and the first four cans in the cartridge have exited.
Figure 42:
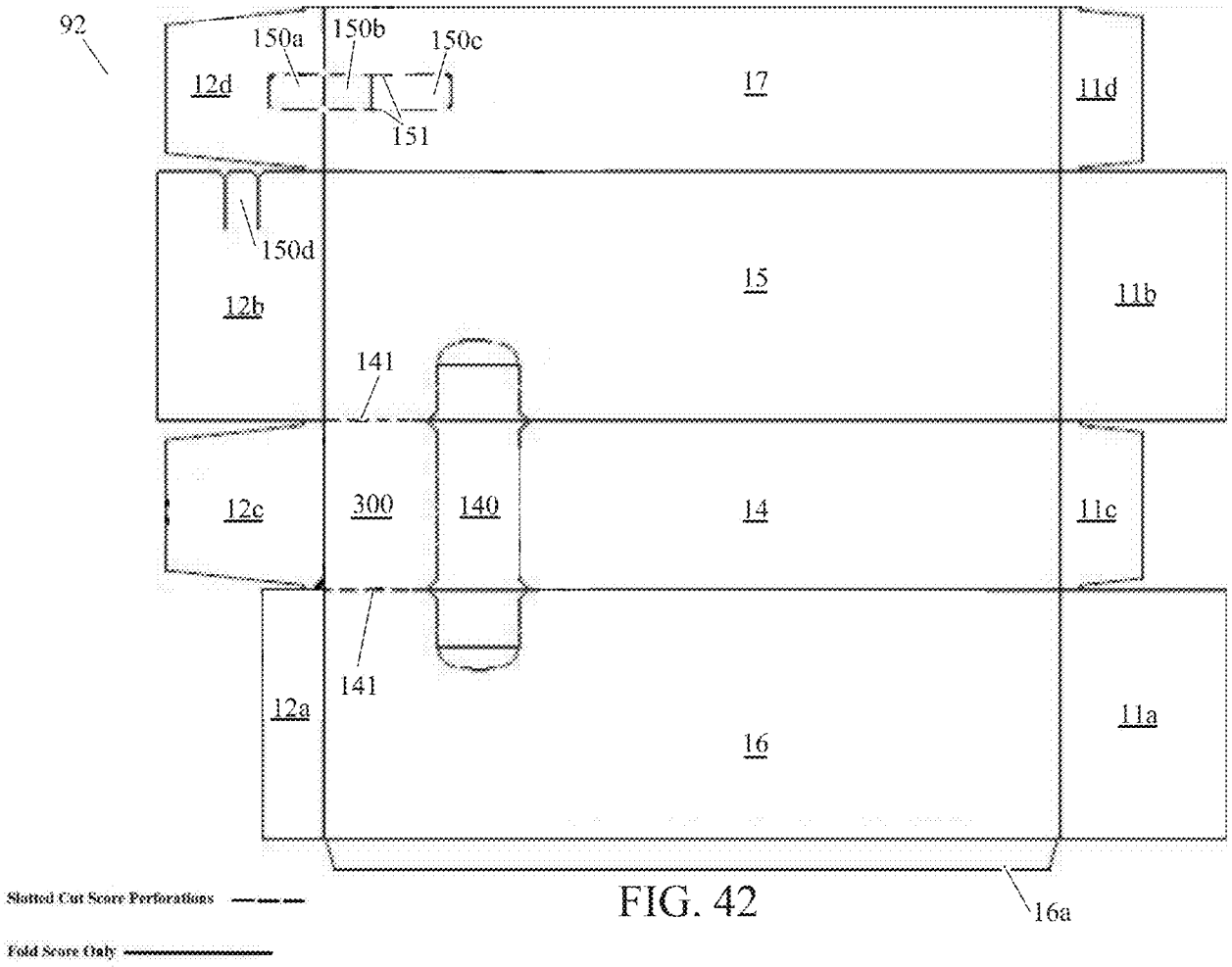
FIG. 42 shows a die cut flat blank lay out of a cartridge having a perforated slot and bridge, a perforated openable priming flap, and a perforated retaining flap.
Figure 49:
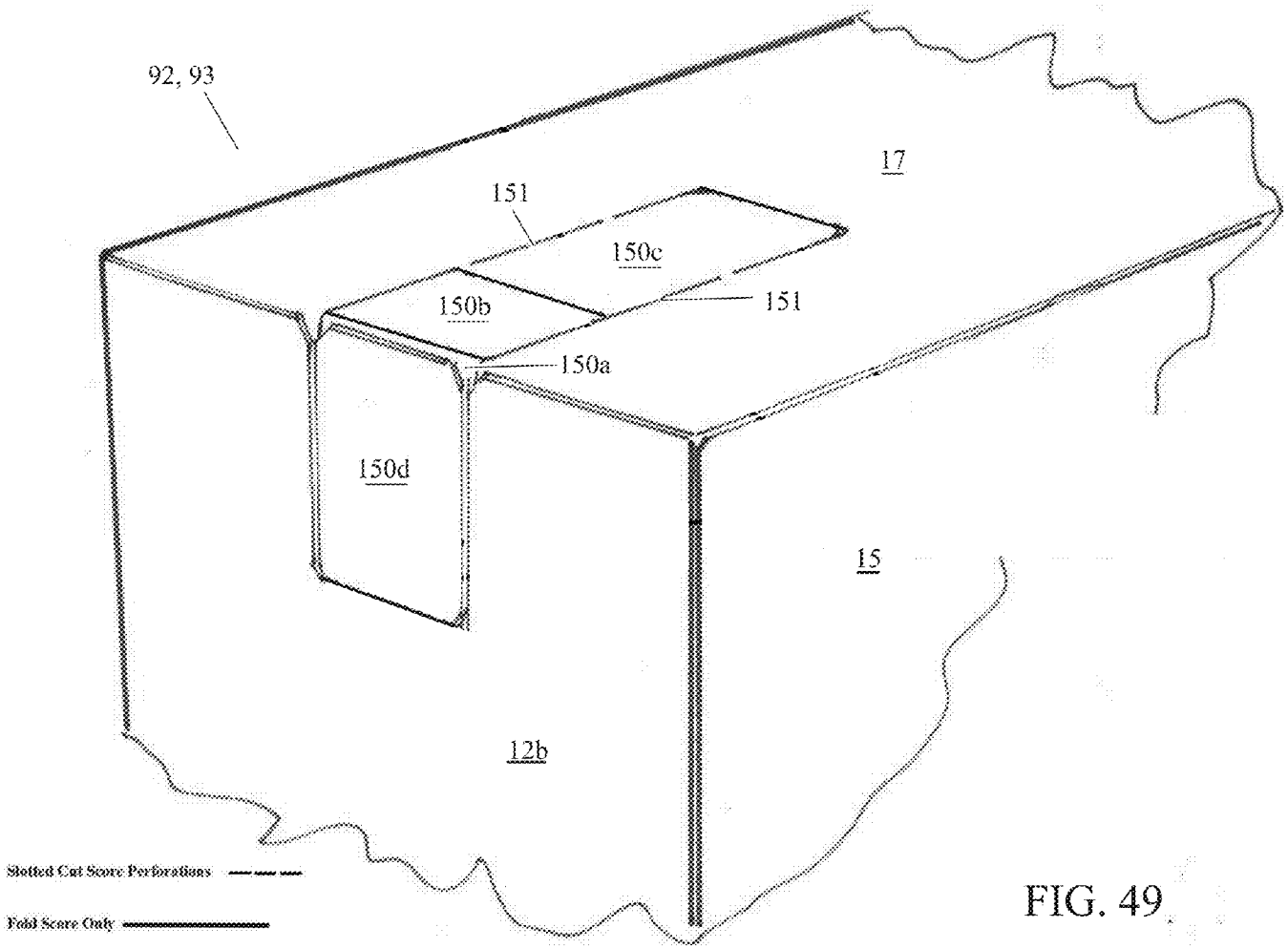
FIG. 49 shows a perspective view of a cartridge with a perforated slot and bridge.
Figure 50B:
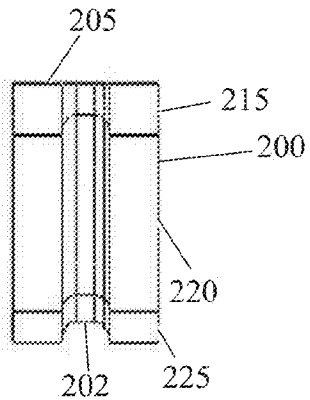
FIG. 50B shows a front view of an opening wedge having a channel for receiving circumferential surface features of a rolling product.
Figure 50D:
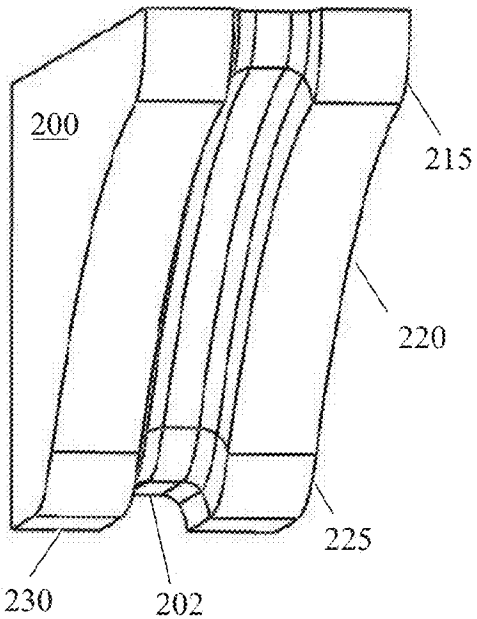
FIG. 50D shows a perspective view of an opening wedge having a channel for receiving circumferential surface features of a rolling product.
Figure 50A:
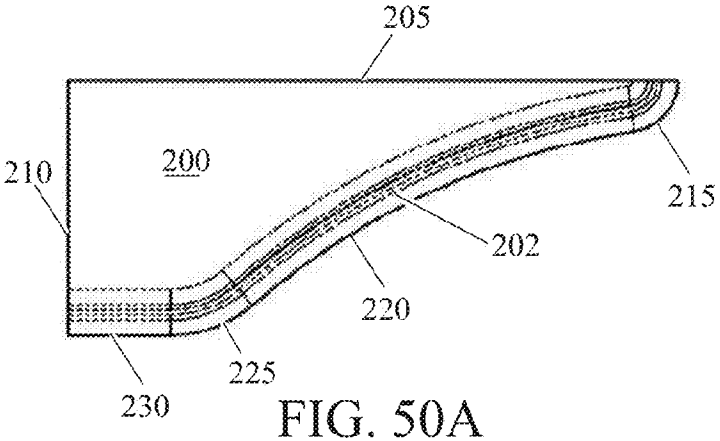
FIG. 50A shows a side view of an opening wedge having a channel for receiving circumferential surface features of a rolling product.
Figure 50C:
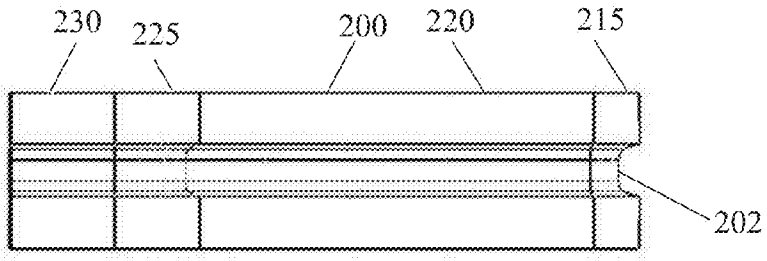
FIG. 50C shows a bottom view of an opening wedge having a channel for receiving circumferential surface features of a rolling product.
Figure 51:
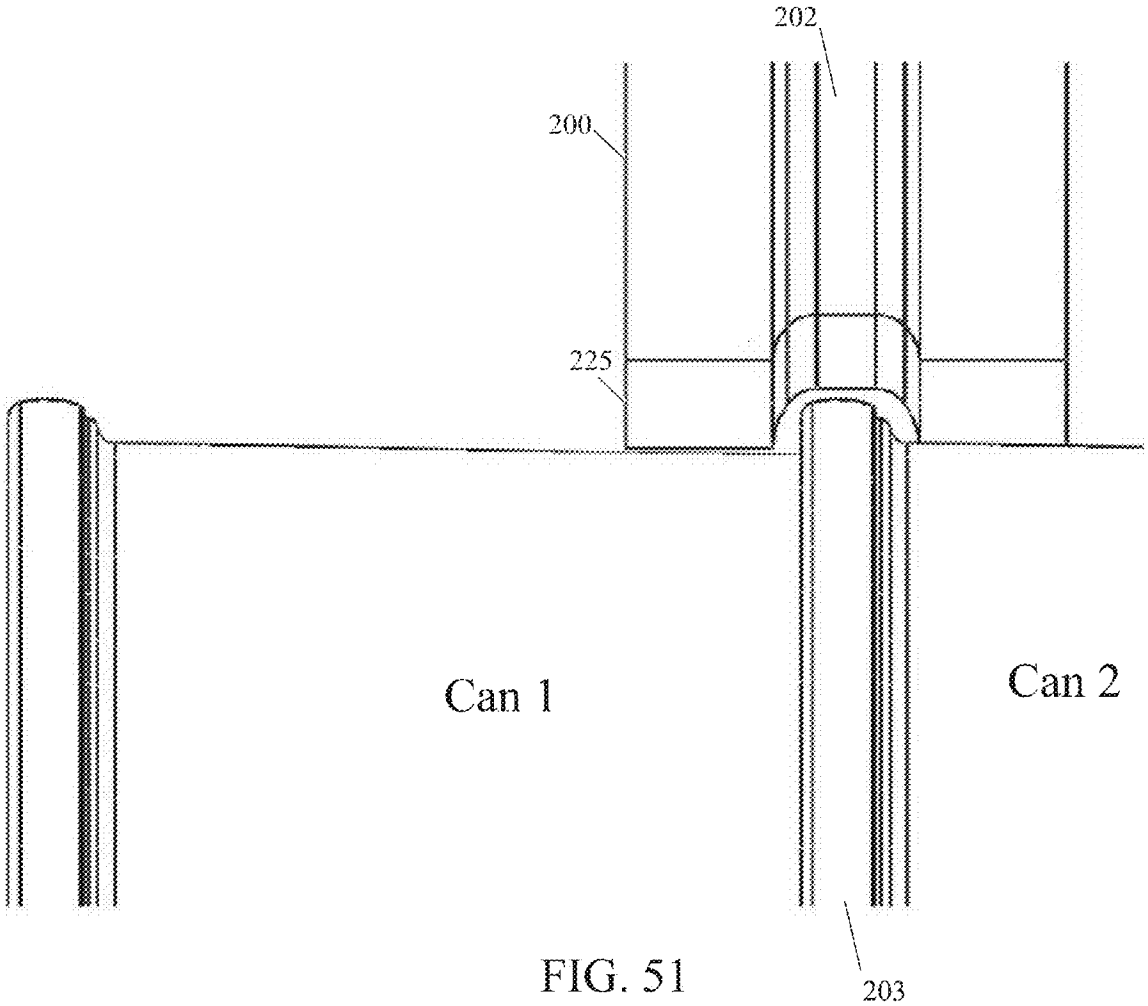
FIG. 51 shows a front view detail of an opening wedge having a channel for receiving circumferential surface features of a rolling product interacting with the rim of a can in a stack of nested cans.

The dispenser 20 and cartridge 92 embodiments shown in FIGS. 19-32 may be implemented in alternate embodiments as well. If the cartridge 92 is die cut by perforations 151 with a slot and bridge 150*a*, 150*b*, 150*c*, 150*d* design, as shown in FIG. 42 and FIG. 49, can 4 will be impeded, as shown in FIGS. 28-29, by the wedge 200 and die cut bridge 105 (including 150*a*, 150*b*, 150*c*, 150*d*) once the die cut bridge 105 is deflected downward by the wedge 200 during insertion of the cartridge 92. Cans in the cartridge 92 are then forced to exit the cartridge in the one, two, three, four dispensing order, as shown sequentially in FIGS. 28-32. In this embodiment, a conventional dispenser 20, simple arcuate down chute 30, and cartridge loading ramp 32 design, as shown in FIG. 20 and FIGS. 22-32, are used as the down chute 30 and cartridge loading ramp 32 are no longer determinative in the can 1, 2, 3, 4 movements, or jams, in this embodiment.

Figure 43:
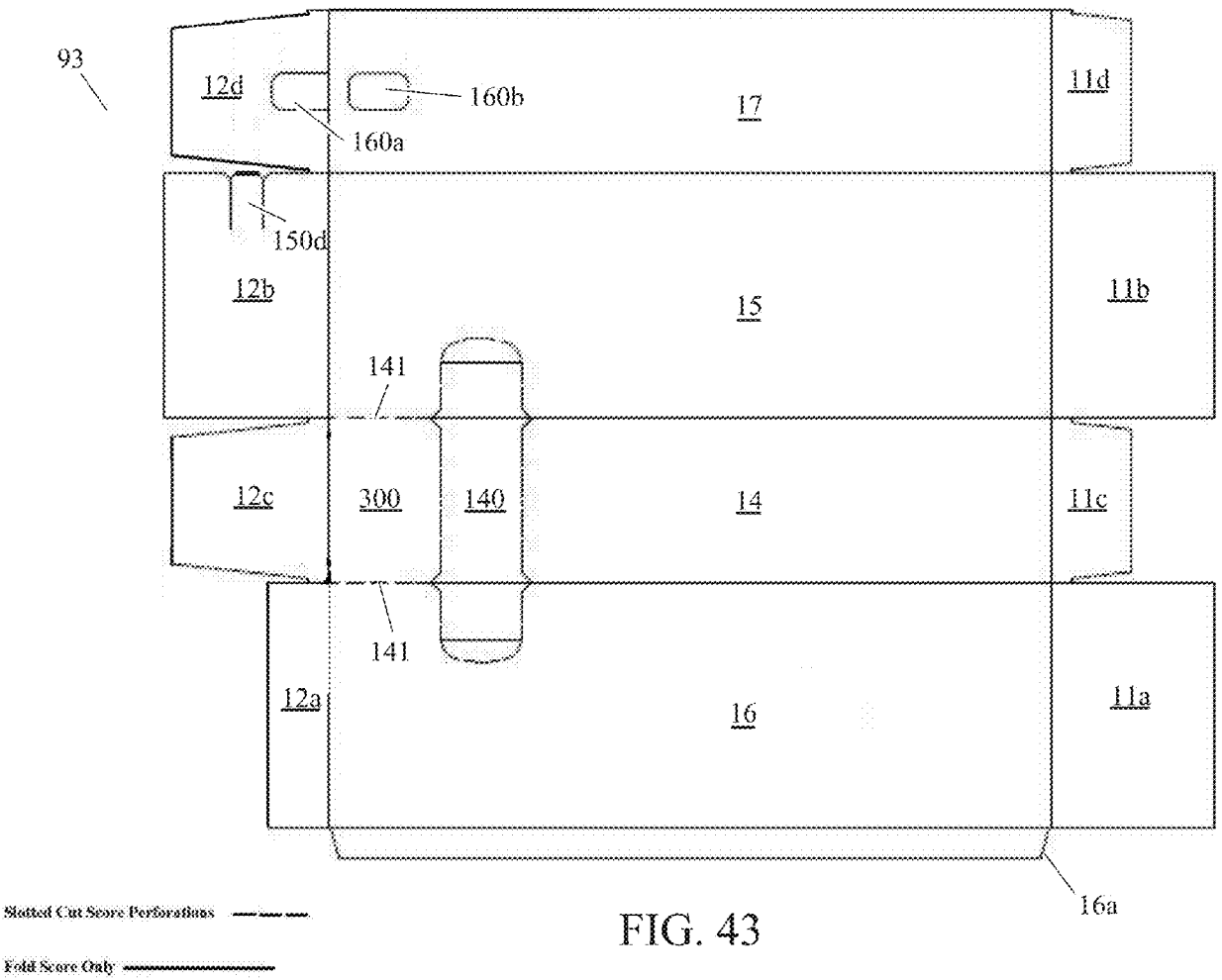
FIG. 43 shows a die cut flat blank lay out of a cartridge having an always open slot, a perforated openable priming flap, and a perforated retaining flap.

In another cartridge 93 embodiment, shown in FIG. 43, the cartridge 93 has either an "always there" die cut opening 160*a*, 160*b*, or may be field openable by tearing cartridge material out of the cartridge at the die cut opening 106*a*, 106*b*. In either embodiment, the opening defined by die cuts at 160*a*, and 160*b* aligns with the dispenser 20 wedge 200. Alternatively, the cartridge 93 may have a die cut perforation score design which enables the dispenser 20 wedge 200 to tear open an area corresponding to the "always there" slot 160*a*, 160*b* during insertion. These cartridge 93 embodiments eliminate any cartridge 93 wall material from deflecting into the space between the wedge 200 and the cans 2, 4. As a result, the space between the wedge 200 central arcuate section 230 and the cans 2, 4 will be empty during and after cartridge 93 insertion.

Referring to FIGS. 33-37, the cartridge 93 having an "always there" slot 106*a*, 106*b* (shown in FIG. 43) provides can 4 with clearance between the wedge 200 and can 3, and motion of can 4 is not impeded by the wedge 200 after cartridge 93 insertion. As a result, can 4 will exit the cartridge 93, 95 after can 2 and before can 3. In this embodiment, a dispenser 20 with an S-curved down chute 50 (as shown in FIGS. 33-37, or other jam prevention improvement is preferably used. The critical first four cans 1, 2, 3, 4 will then exit the cartridge 93, 95 through the entry port 45, without jamming, in the one, two, four, three dispensing order.

Figure 38:
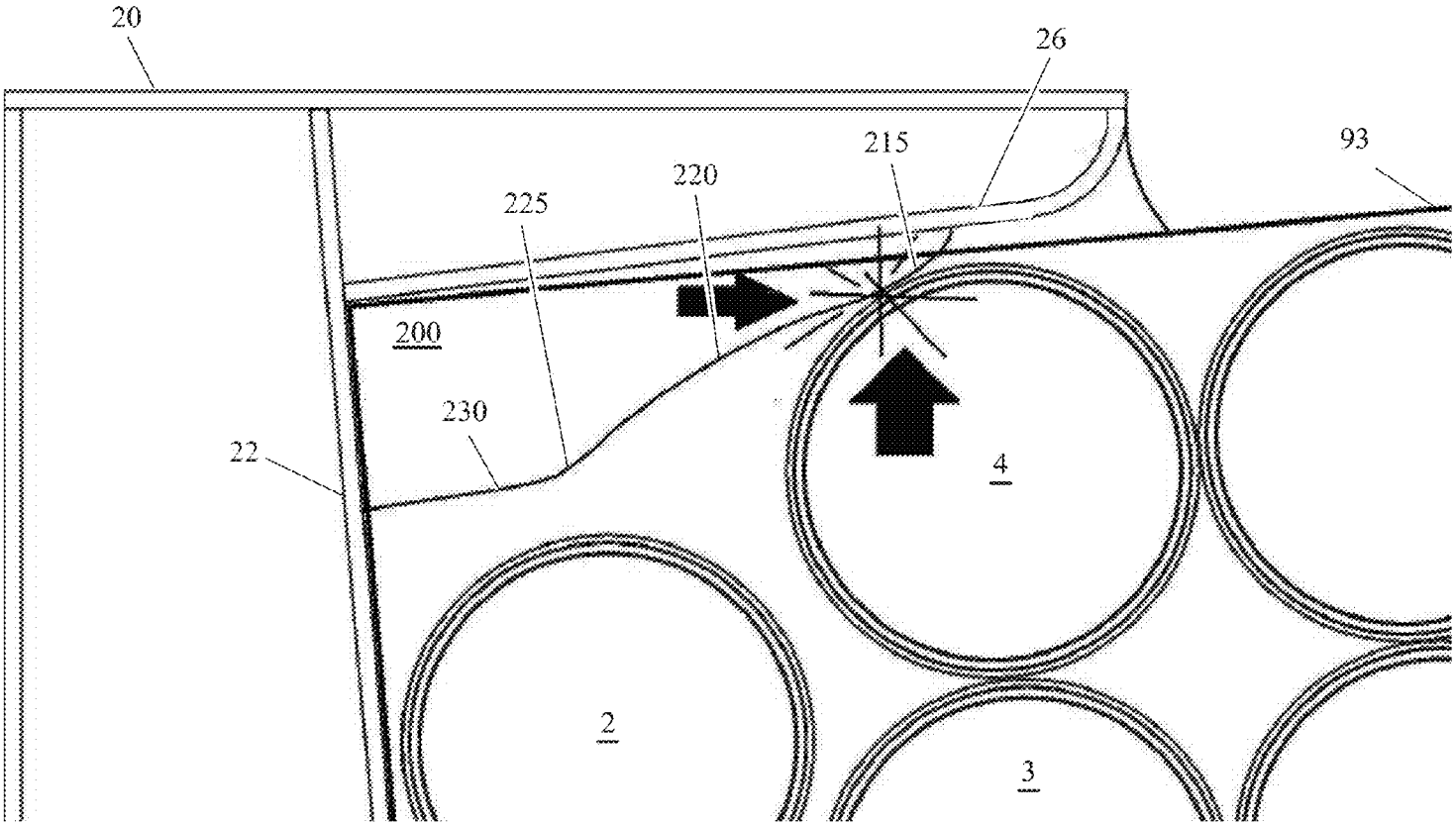
FIG. 38 shows a detail of a cartridge opening wedge interacting with a can in a cartridge having an always open or field openable slot.
Figure 39:
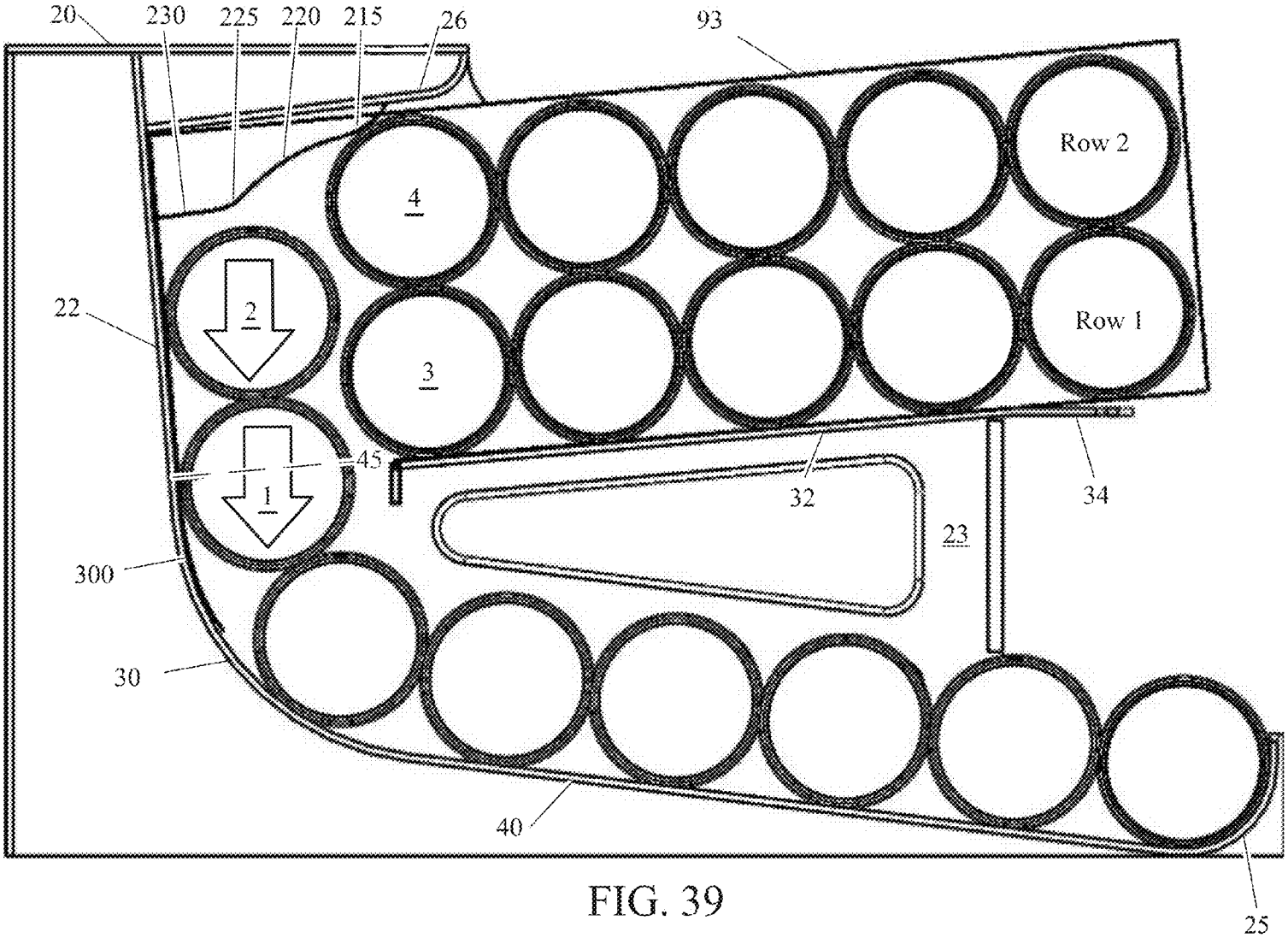
FIG. 39 shows a cartridge having an always open or field openable slot after it has been inserted into a partially filled dispenser having a cartridge opening wedge and an arcuate down chute.
Figure 40:
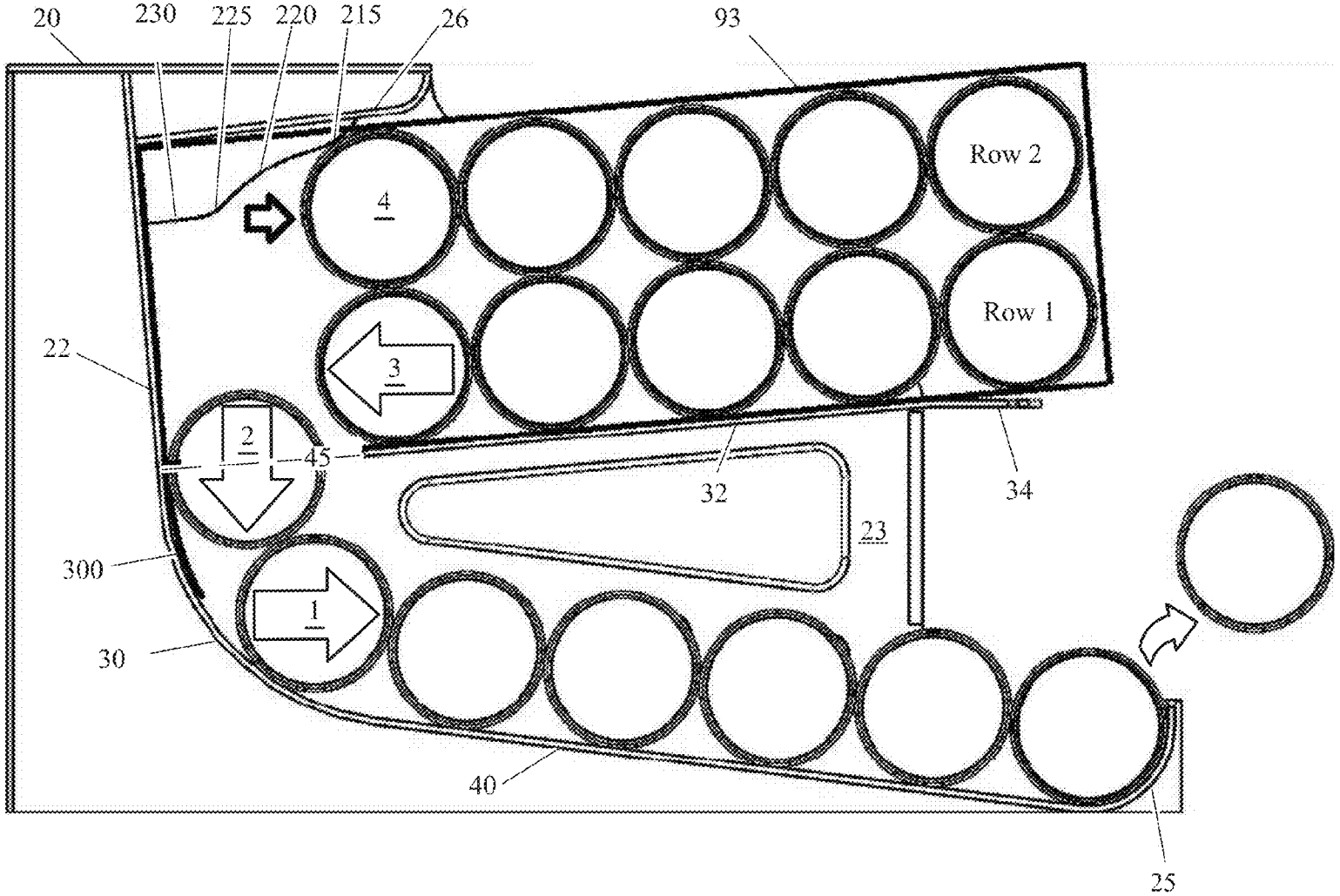
FIG. 40 shows the first two cans exiting a cartridge having an always open or field openable slot after it has been inserted into a partially filled dispenser having a cartridge opening wedge and an arcuate down chute.
Figure 41:
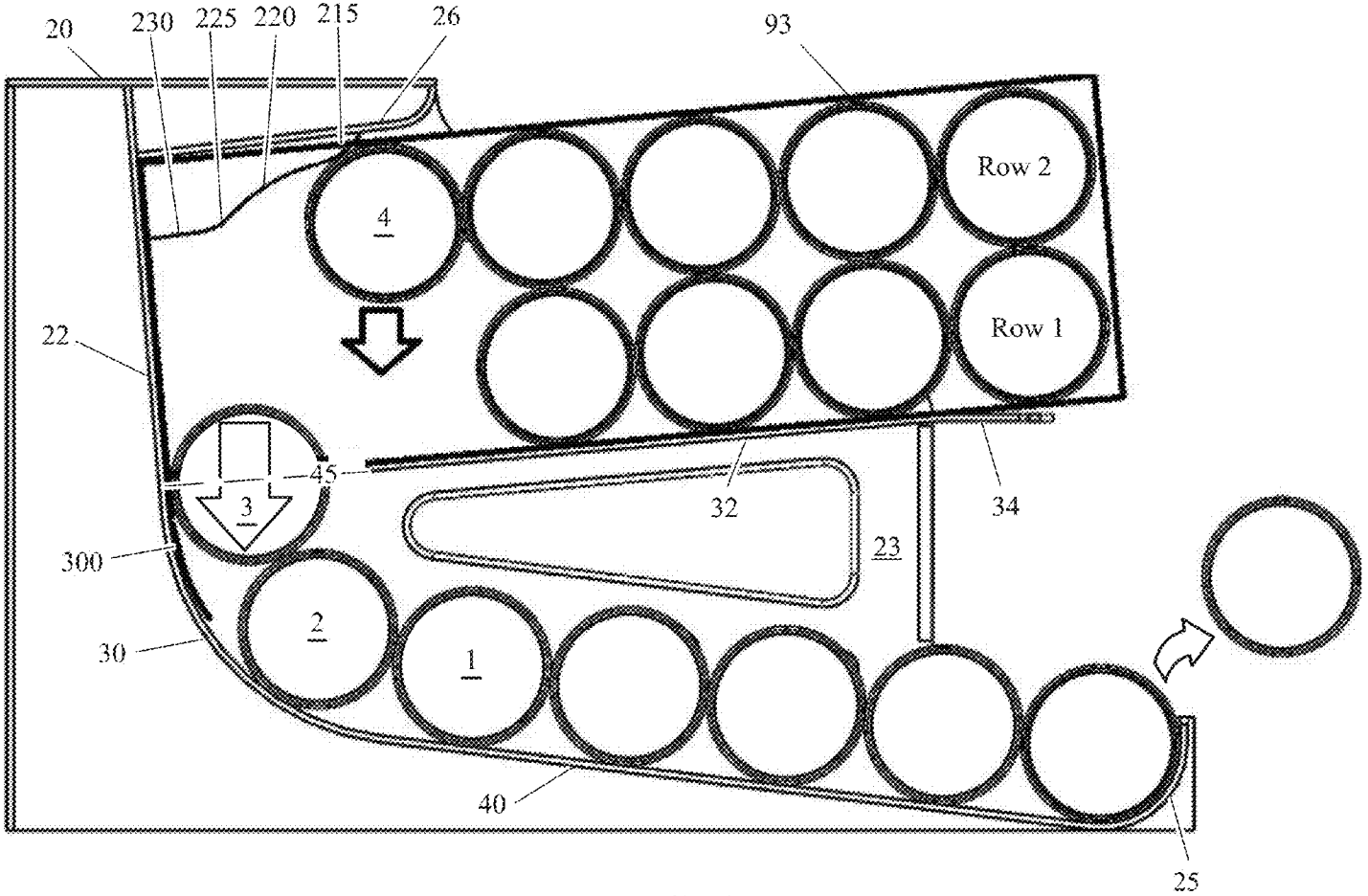
FIG. 41 shows a third can exiting a cartridge having an always open or field openable slot after it has been inserted into a partially filled dispenser having a cartridge opening wedge and an arcuate down chute.

In cartridge 93 embodiments with an "always-there" slot 106*a*, 106*b* (or a die cut that allows the wedge 200 to tear open a full slot 106*a*, 106*b* during insertion) there will be no cartridge 93 material in the space between the wedge 200 and the cans 2, 4 after insertion. However, the wedge 200 may also be modified to compensate for this difference. Accordingly, the wedge 200 overall length (front to rear) as defined by the base 205 may be increased, as may be the overall vertical extent of the wedge 200 first arcuate section 215, such that wedge 200 first arcuate section 215, as shown in FIG. 38, contacts can 4 upon complete insertion of the cartridge 93.

Referring to FIGS. 38-41, when the wedge 200 contacts can 4, rearward and downward movement of can 4 is impeded and delayed until can 3 exits the cartridge 93 before it. Therefore, this combination of cartridge 93 and wedge 200 embodiments forces the cans 1, 2, 3, 4 to exit the cartridge 93, and be dispensed, in the one, two, three, four dispensing order without jamming Therefore, a conventional arcuate down chute 30 and loading ramp 32, shown in FIGS. 38-41, may be used with this wedge 200 embodiment.

Referring now to FIG. 42, an inwardly and downwardly formable bridge 150*a*, 150*b*, 150*c*, 150*d* may be die cut, via perforation cuts and fold scores, into the cartridge 92 flat prior to assembly. The assembled cartridge 92 with a bridge 150*a*, 150*b*, 150*c*, 150*d* is shown in FIG. 49. When inserted into the dispenser 20, the parallel perforations 151 on either side of the bridge 150*a*, 150*b*, 150*c*, 150*d*, in the assembled and packed cartridge 92, are separated by the dispenser 20 wedge 200 pressing forcefully against them during cartridge 92 insertion. The bridge 150*a*, 150*b*, 150*c*, 150*d* is thus forced inwardly and downwardly by the wedge 200, as shown in FIGS. 25-32. When this cartridge 92 is inserted in the dispenser 20, as shown in FIGS. 25-32, the paperboard bridge fills the space between the wedge 200 and can 4, preventing can 4 from moving within the cartridge 92, until after can 3 is able to roll rearward and exit the cartridge 92 ahead of can 4. FIG. 42 also shows other structures of the cartridge 92, including flaps 11*a*, 11*b*, 11*c*, 11*d* and 16*a*, and cartridge sides 15 and 16.

A second cartridge 93 embodiment, shown in FIG. 43, includes an "always there" opening 160*a*, 160*b* through which the wedge 200 directly contacts can 2 and can 4, instead of a perforated paperboard bridge 105. When the cartridge 93 is assembled and packed at the point of manufacture, the die cut "always there" opening 160*a*, 160*b* creates a completely open or partially open L-shaped slot through the top rear edge of the cartridge 93 extending both forwardly along the top 17 of cartridge 93 and downwardly along the back 12 (including construction flaps 12*a*, 12*b*, 12*c* and 12*d*) of the cartridge 93. It will also be appreciated that a full open slot may be created at the time of insertion by a stocking clerk pulling a tab and removing a perforated L-shaped tear away area, thus creating the slot.

During cartridge 93 insertion into the dispenser 20, the wedge 200 is thus able to contact can 2 directly. Then, using sufficient additional clearance in the determination of "3r" (see FIG. 23), can 4 will clear the wedge 200 and transit the cartridge 93 ahead of can 3, as shown in FIGS. 33-37.

In various dispenser 20 and cartridge 92, 93, combinations, shown in FIGS. 24-37 for example, the cartridge retaining flap 300 partially covers the upper part of the down chute 30, 50 after the retaining flap 300 is pushed downward and open by can 1. In these embodiments, extra clearance is preferably included in down chute 30, 50 dimensions to accommodate the thickness—"d"—(see FIG. 27) of the paperboard so that down chute 30, 50 function is not compromised. A small clearance constant approximately equal to cartridge 92*b* paperboard thickness—"d"—is also preferably added in some embodiments to the wedge 200 central arcuate section 220 radius of curvature, shown in FIG. 23, to ensure proper wedge 200/cartridge 93 operation.

The interaction of the wedge 200 with cartridges 93 having an "always there" slot (without bridge 105 disposed between the wedge 200 and the cans 2, 4) is substantially the same as when cartridges 92, 94 having a bridge 105 are employed. However, when no bridge 105 is present, can 4 exits the cartridge 93 ahead of can 3, and therefore an S-shaped down chute 50, or other method of controlling the dispensing order of the first four cans 1, 2, 3, 4 is implemented to prevent the can 3 and can 4 jamming.

In some cartridge 92, 93 embodiments, alternative die cuts may be provided for the stocking person to partially open cartridges 92, 93 prior to insertion into a dispenser 20 that also prevent cans from prematurely falling out when the cartridge 92, 95 is inverted.

Figure 44:
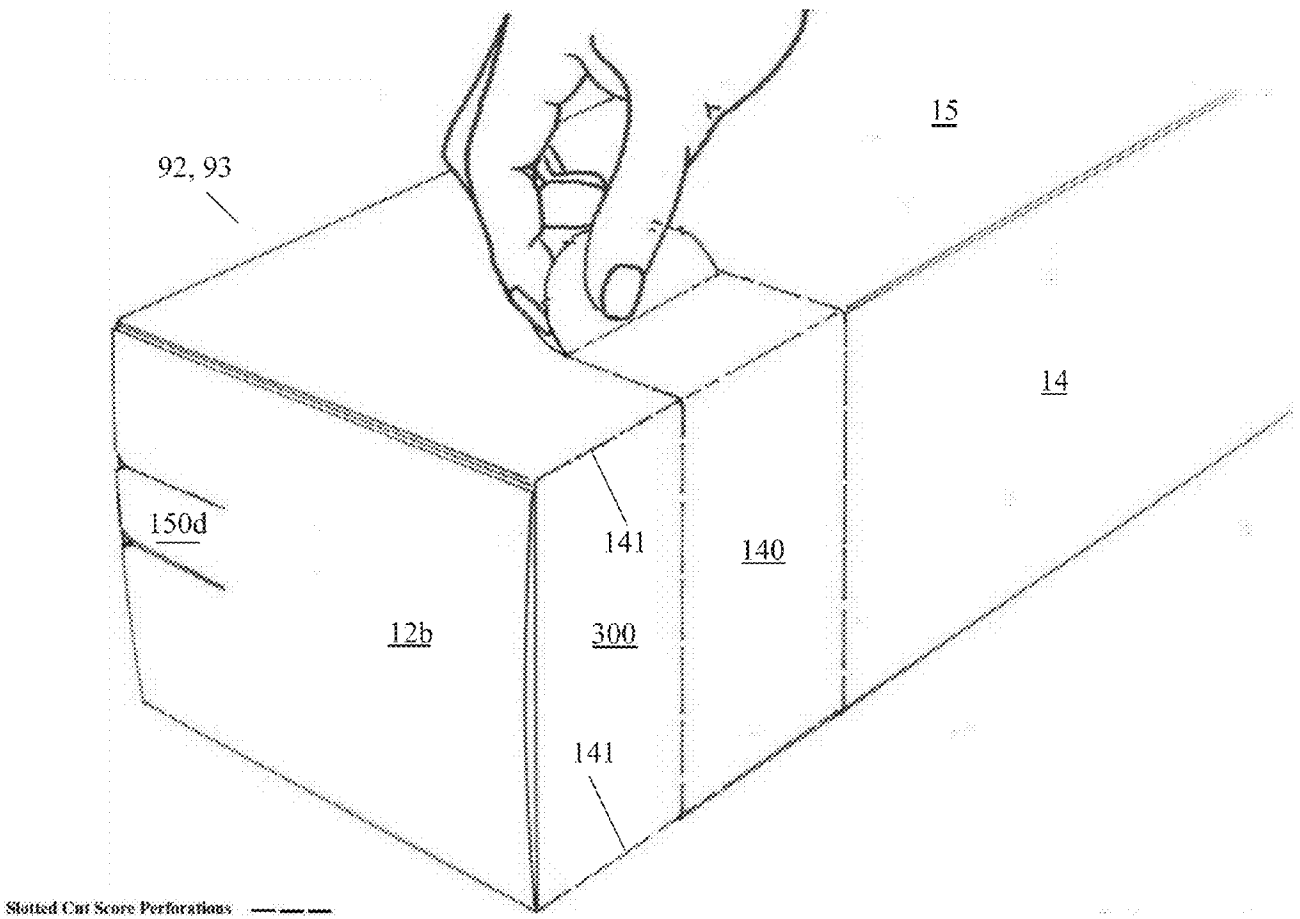
FIG. 44 shows a perspective view of a cartridge with a perforated openable priming flap removed being opened.
Figure 45:
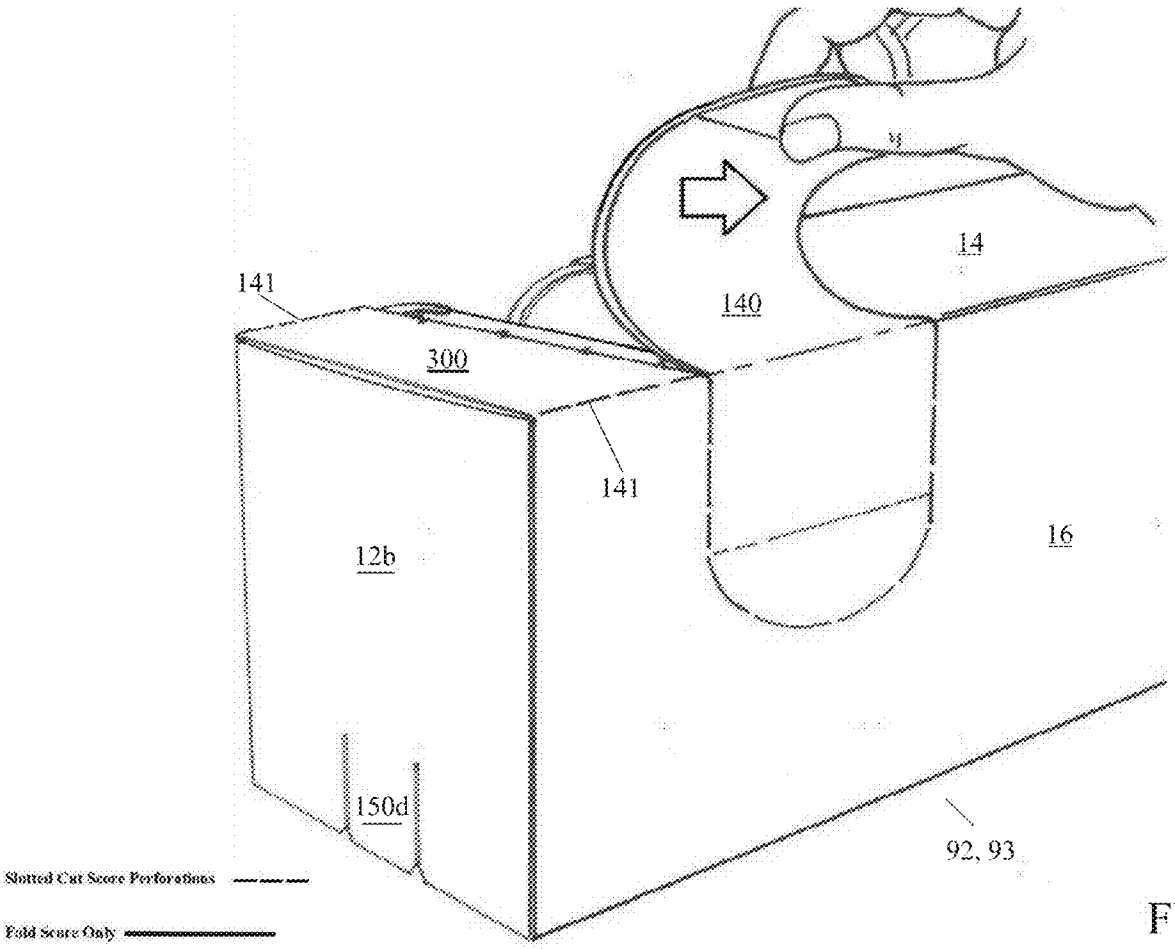
FIG. 45 shows a perspective view of a cartridge with a perforated openable priming flap that is partially opened.
Figure 46:
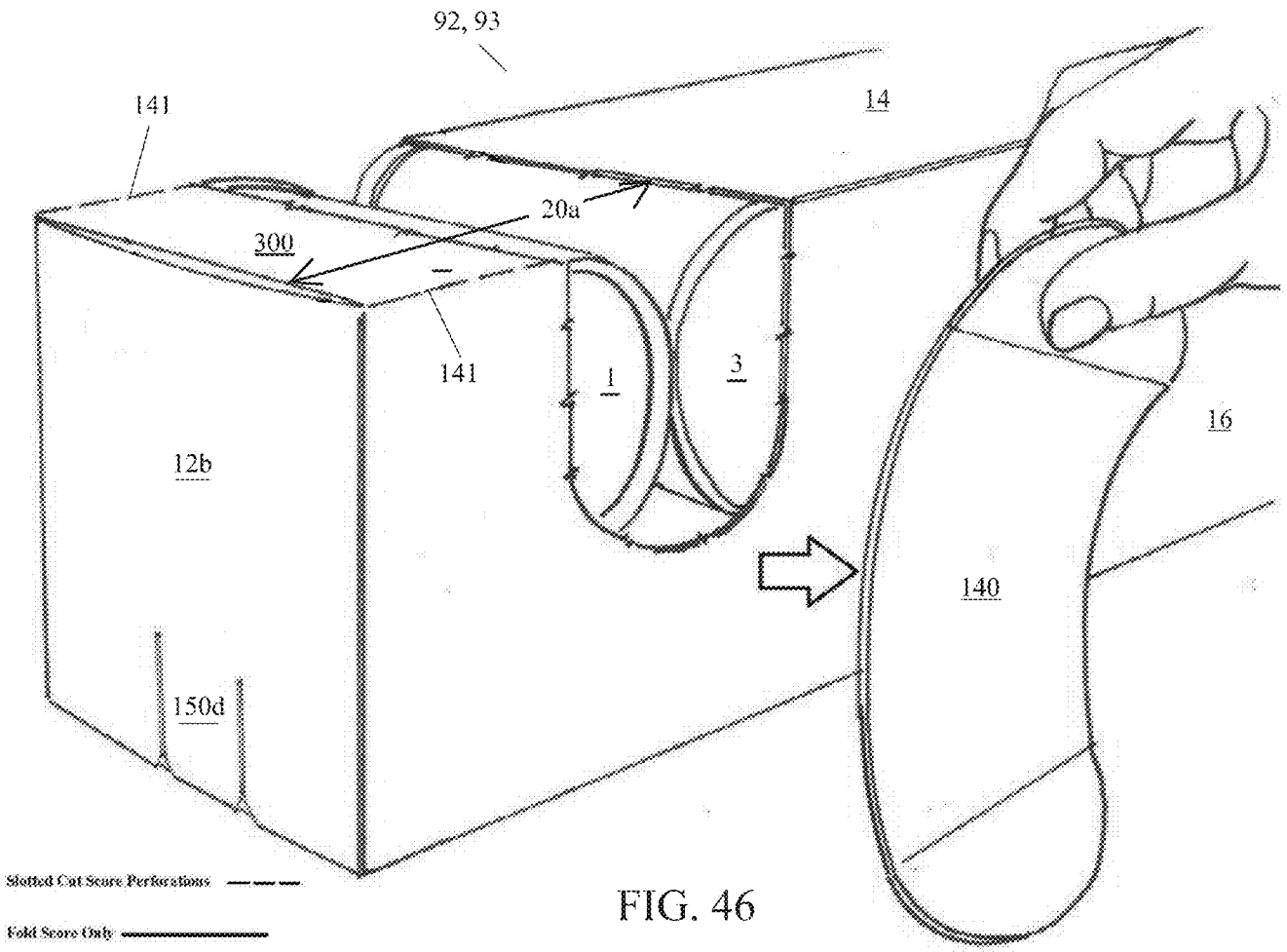
FIG. 46 shows a perspective view of a cartridge with a perforated openable priming flap that is fully opened and removed from the cartridge.
Figure 47:
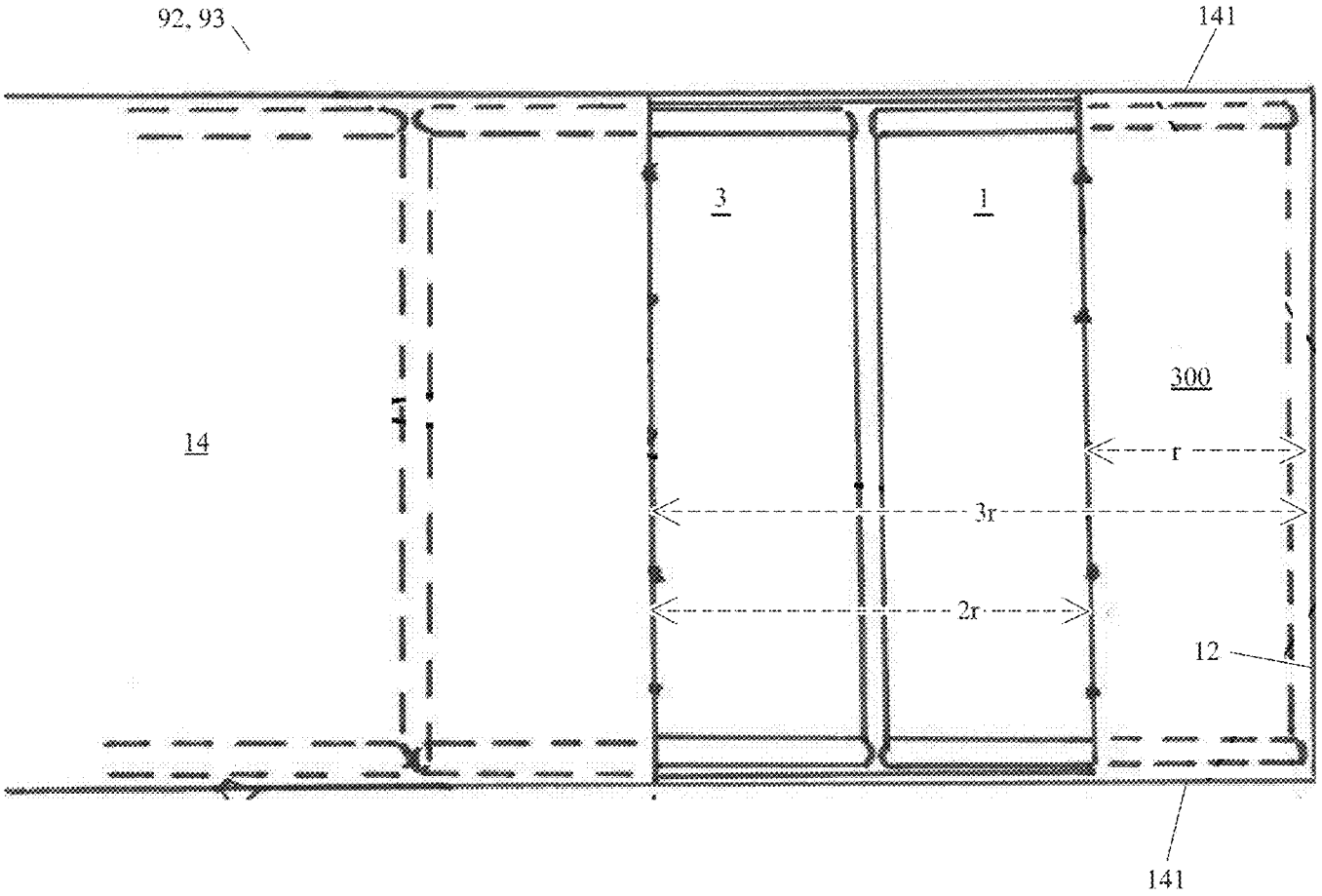
FIG. 47 shows a bottom view of a cartridge after removal of a perforated openable priming flap.

Referring now to FIGS. 42-43, a cartridge 92, 93 includes an openable priming flap 140 which, when removed as shown in FIGS. 44-46, opens a large slot in the cartridge bottom 14. The openable priming flap 140 (and opening created by its removal) is sized and positioned with two goals in mind. First, the openable priming flap 140 is preferably large enough to facilitate easy opening of the remaining retaining flap 300 by the wedge 200. Minimizing the retaining flap 300 size reduces the wedge 200 force necessary to open retaining flap 300. the openable priming flap 140 is also preferably sufficiently small so that after it is opened and the cartridge 92 is inverted, no cans will be able to fall out of the resulting opening. Second, the openable priming flap 140 is preferably positioned, as shown in FIG. 47, such that the front and rear edges of the opening defined by the removal of the openable priming flap 140 approximately coincide with the centerlines of can 1 and can 3, creating an opening in the cartridge 92, 93 that is approximately one can diameter (2r) wide. The openable priming flap 140 front edge over can 3 may be generally coincident with the location of a forward most edge of the entry port 45, as shown for example in FIGS. 39-41.

The openable priming flap 140 rear edge over the centerline of can 1 ensures the retaining flap 300 firmly holds can 1 (and thus all other cans) in the cartridge 92, 93 when inverted, and also reduces the size of the retaining flap 300. In preferred embodiments, for a cartridge 92, 93 containing cans with a diameter—"2r" the openable priming flap 140 rear edge is located approximately one can radius—"r"—forward of the cartridge 92, 93 back wall 12, and the openable priming flap 140 front edge is located a distance approximately 3r forward of the cartridge 92, 93 back wall 12. Thus when the openable priming flap 140 is removed, an opening in the desired location with a width of 2r results, and the goals of minimizing the retaining flap 300 size and preventing cans from falling out of the cartridge 92, 93 when it is opened are achieved. Subsequent separation of the cartridge retaining flap 300 from the cartridge 92, 93 bottom 14 defines an opening between the back wall 12 of the cartridge 92, 93 and a forward location on the cartridge 92, 93 that acts as a dispensing port 20*a* through which cans 1, 2, 3, 4 may exit the cartridge 92, 93.

The left and right edges 141 of the retaining flap 300 rearward of the opening created by removing the the openable priming flap flap 140, and coincident with the cartridge 92, 93 folded edges, may be cut scored perforations, as shown in FIGS. 42-47, to further facilitate the self-opening as described herein.

Figure 48:
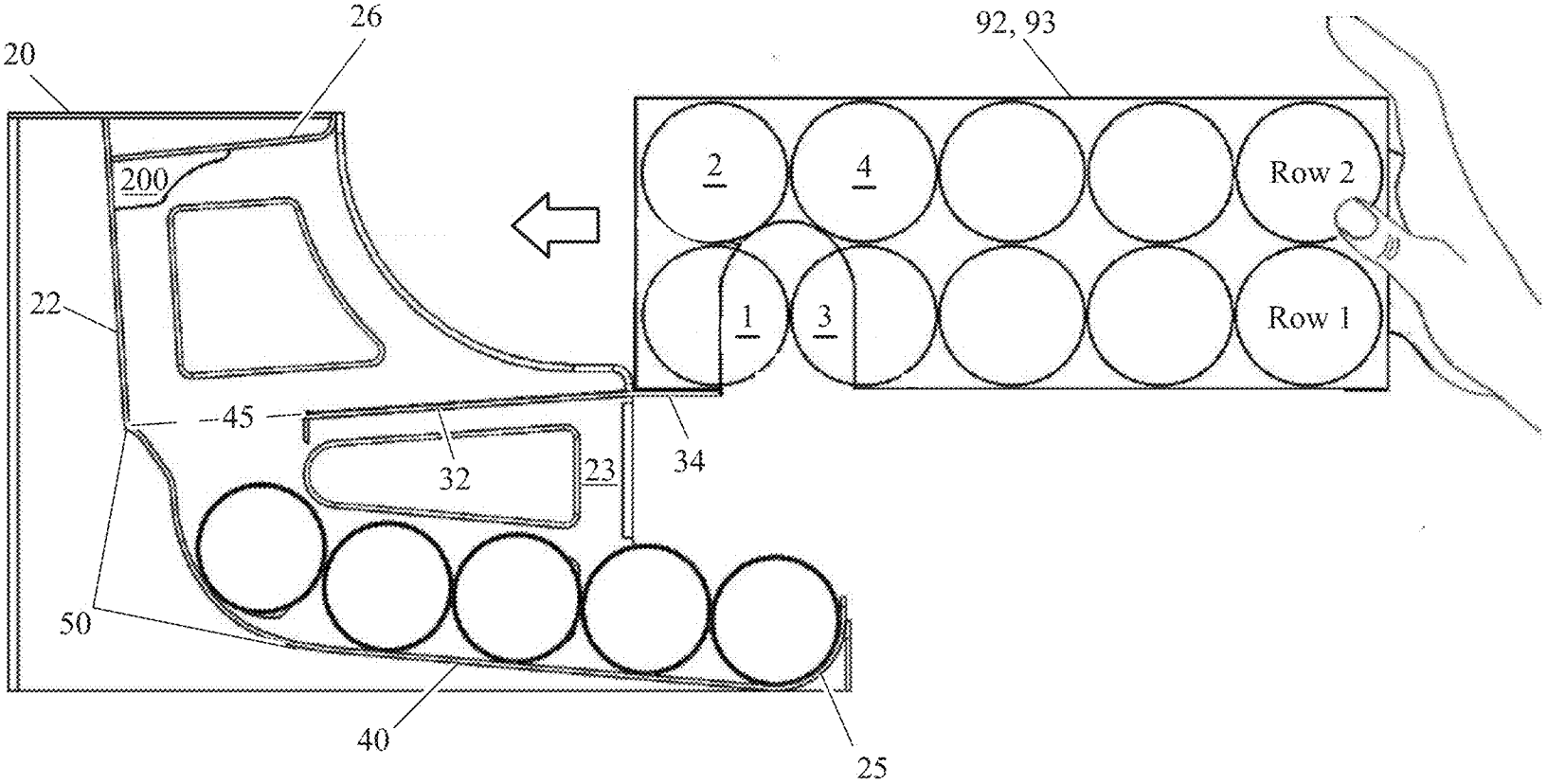
FIG. 48 shows a cartridge after removal of a perforated openable priming flap being inserted into a dispenser having a cartridge opening wedge and an S-shaped down chute.

An additional benefit of this modification, as shown in FIG. 48 is that, the stocker may use both hands to invert and position the cartridge 92, 93 for insertion into a dispenser 20. Once positioned on the resting ledge 34, the cartridge 92, 93 enables one handed insertion, which further eases and speeds the loading process.

Figure 53:
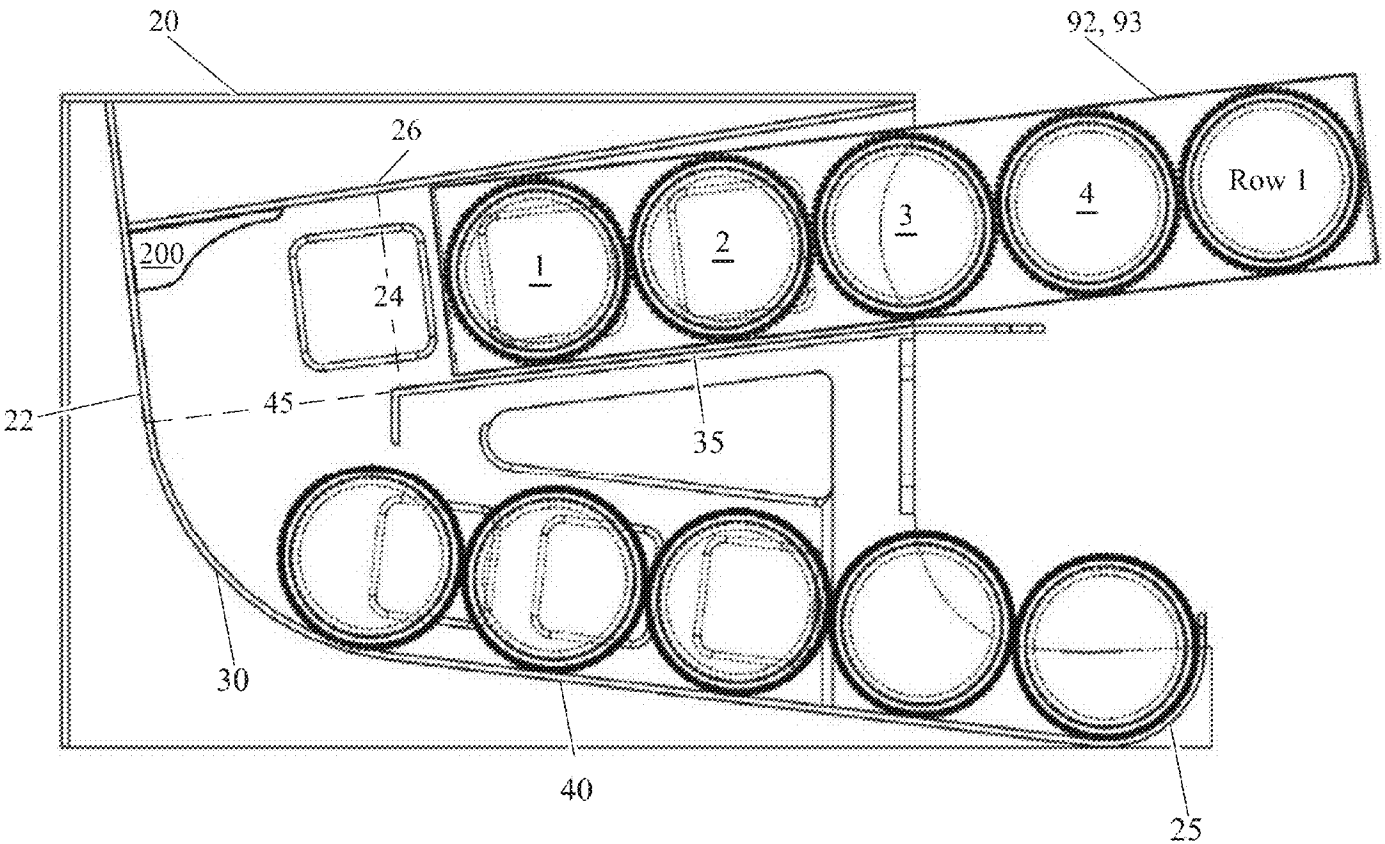
FIG. 53 shows an open side view of a cartridge containing one row of rolling products being inserted into the cartridge receiving area of a dispenser with an opening wedge.
Figure 54:
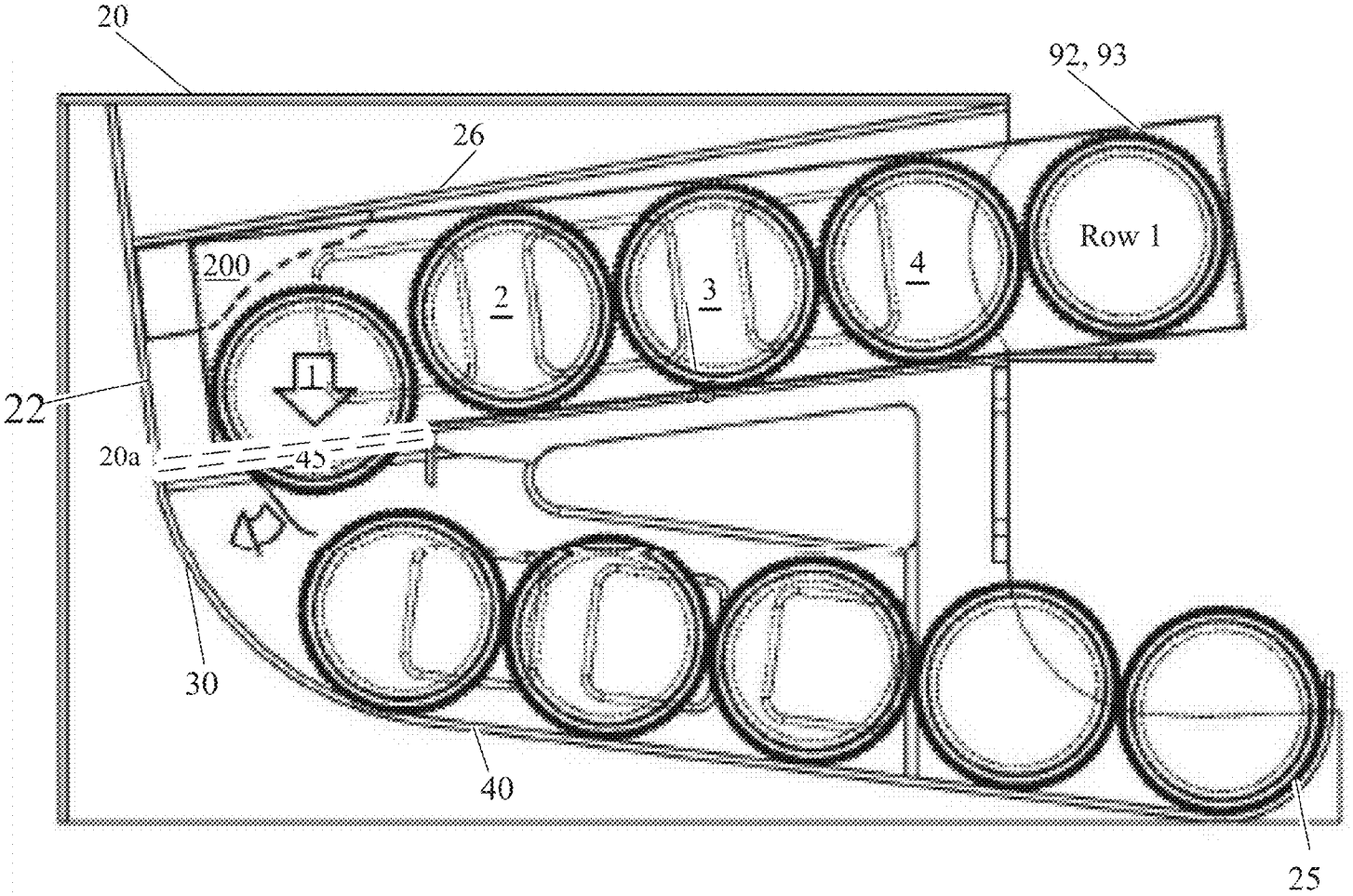
FIG. 54 shows an open side view of a cartridge containing one row of rolling products after being inserted into the cartridge receiving area of a dispenser with an opening wedge.

It will be appreciated that the various wedge/slot, down chute, and opening flap embodiments described herein may be used interchangeably with each other in any useful combination, and all such combinations are within the scope of the various alternative dispenser and wedge embodiments described herein. It will also be appreciated that the embodiments described herein, while shown in relation to a cartridge 92, 93, containing an upper row (Row 2) and a lower row (Row 1) of cans 1, 2, 3, 4, are equally applicable to cartridges 92, 93 containing a single row of cans, as shown in FIGS. 53-54, and that the forces applied to the first can in a single row of cans will also be directly translated downward to force open the retaining flap 300 of a cartridge 92, 93. Similarly, a cartridge 92, 93 may have additional rows of cans between the lower row (Row 1) and upper row (Row 2). In such embodiments, downward forces normally translated from a first can in the upper row (Row 2) directly to a first can in the lower row (Row 1), will be translated to the first can in the lower row (Row 1) through the first cans in the additional rows.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A rolling products dispenser for receiving and opening a cartridge containing at least one row of rolling products; the cartridge having a top, a bottom, a left side and a right side, a back, at least one slot passing through both the top and the back of the cartridge, and a flap in the bottom of the cartridge adjacent the back which is separable from the left side of the cartridge and the right side of the cartridge; the dispenser comprising:

a) a cartridge holding area for receiving the cartridge, the cartridge holding area having a top, a bottom, two sides, a rear wall, and an entry port in the bottom at the rear wall of the cartridge holding area;

b) at least one wedge disposed at a location adjacent to the top and rear wall of the cartridge holding area, having a base coupled to the top of the cartridge holding area, a first side coupled to the rear wall of the cartridge holding area, and a second side connecting the base and the first side, the base, first side and second side defining a wedge shape in which the second side slopes downwardly and rearwardly from the top of the cartridge holding area to a point on the rear wall of the cartridge holding area;

the top of the cartridge holding area having a length extending forwardly from the rear wall of the cartridge holding area to cover at least a part of the top of a cartridge when the cartridge is pushed into the cartridge holding area of the dispenser;

such that when the cartridge is pushed into the cartridge holding area of the dispenser, the top of the cartridge holding area covers a part of the top of the cartridge, retaining the cartridge within the cartridge holding area while the at least one wedge of the dispenser enters the at least one slot of the cartridge and applies a downward force to a first rolling product in the at least one row of rolling products, the downward force on the first rolling product in the at least one row of rolling products separating a portion of the flap of the cartridge at the left and right sides of the cartridge, defining a dispensing port in the cartridge through which rolling products in the cartridge move to the dispenser entry port.

2. The rolling products dispenser of claim 1, wherein the second side of the wedge comprises a central arcuate section with a radius of curvature.

3. The rolling products dispenser of claim 1, wherein the second side of the wedge comprises a channel for receiving a circumferential surface feature of the rolling product.

4. The rolling products dispenser of claim 2, wherein the radius of curvature of the central arcuate section of the second side of the wedge is approximately three times a radius of the rolling product.

5. The rolling products dispenser of claim 4, in which an origin of the radius of curvature of the central arcuate section is located forward of the rear wall of the cartridge holding area approximately three times the radius of the rolling product and also above the bottom of the cartridge holding area approximately one radius of the rolling product.

6. The rolling products dispenser of claim 4, in which an origin of the radius of curvature of the central arcuate section is located forward of the rear wall of the cartridge holding area approximately three times the radius of the rolling product plus at least one thickness of the material of the cartridge and also above the bottom of the cartridge holding area approximately one radius of the rolling product plus at least one thickness of the material of the cartridge.

7. The rolling products dispenser of claim 1, wherein a length of the base of the wedge is selected such that when the cartridge is fully inserted into the dispenser, at least a portion of the second side of the wedge contacts a second rolling product in an upper row portion of the second side of the wedge contacts a second rolling product in an upper row of rolling products and impedes movement of the second rolling product in the upper row of rolling products.

8. The rolling products dispenser of claim 1, wherein the slot of the cartridge comprises a bridge of a cartridge material which is separable from the cartridge, and a length of the base of the wedge is selected such that when the cartridge is fully inserted into the dispenser, at least a portion of the second side of the wedge separates the bridge from the cartridge and holds the bridge in contact with a second rolling product in an upper row of rolling products and impedes movement of the second rolling product in the upper row of rolling products.

* * * * *